US009453342B2

(12) United States Patent
Tsai

(10) Patent No.: US 9,453,342 B2
(45) **Date of Patent: *Sep. 27, 2016**

(54) BRACING DEVICE

(71) Applicant: Chong-Shien Tsai, Taichung (TW)

(72) Inventor: Chong-Shien Tsai, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/610,698

(22) Filed: Jan. 30, 2015

(65) Prior Publication Data

US 2015/0225952 A1 Aug. 13, 2015

(30) Foreign Application Priority Data

Feb. 10, 2014 (TW) ..... 103104200 A

(51) Int. Cl.

| | |
|---|---|
| ***E04C 3/02*** | (2006.01) |
| ***E04H 9/02*** | (2006.01) |
| ***E04C 3/06*** | (2006.01) |
| ***E04B 1/98*** | (2006.01) |
| *E04C 3/04* | (2006.01) |

(52) U.S. Cl.

CPC . *E04C 3/02* (2013.01); *E04B 1/98* (2013.01); *E04C 3/06* (2013.01); *E04H 9/02* (2013.01); *E04C 2003/026* (2013.01); *E04C 2003/0408* (2013.01)

(58) Field of Classification Search

CPC ..... E04H 9/02; E04H 9/021; E04H 9/024; E04H 9/028; E04B 1/98; E04B 1/985; E04C 3/02; E04C 3/06; E04C 2003/026; E04C 2003/0408; E04C 2003/0413

USPC ..... 52/167.3

See application file for complete search history.

(56) References Cited

U.S. PATENT DOCUMENTS

| | | | | |
|---|---|---|---|---|
| 7,373,758 | B2 * | 5/2008 | Tsai | E04H 9/02 52/167.1 |
| 7,461,481 | B2 * | 12/2008 | Tsai | E04B 1/2403 52/167.3 |
| 9,309,672 | B2 * | 4/2016 | Tsai | E04C 3/00 |
| 9,322,170 | B2 * | 4/2016 | Tsai | E04C 3/04 |
| 9,322,171 | B2 * | 4/2016 | Tsai | E04C 3/06 |
| 2005/0166487 | A1 * | 8/2005 | Tsai | E04H 9/02 52/167.3 |
| 2005/0257450 | A1 * | 11/2005 | Tsai | E04B 1/2403 52/167.1 |
| 2007/0240368 | A1 * | 10/2007 | Tsai | E04H 9/02 52/167.3 |
| 2008/0250732 | A1 * | 10/2008 | Tsai | E04H 9/02 52/167.3 |
| 2010/0018134 | A1 * | 1/2010 | Tsai | E04H 9/02 52/167.3 |

(Continued)

FOREIGN PATENT DOCUMENTS

| | | |
|---|---|---|
| TW | M321445 | 11/2007 |
| TW | M345092 | 11/2008 |

(Continued)

*Primary Examiner* — Robert Canfield

(74) *Attorney, Agent, or Firm* — patenttm.us

(57) ABSTRACT

A bracing device has a supporting module and a restraining element mounted around the supporting module to provide a restraining-supporting effect to the supporting module. The supporting module has at least one supporting element. The at least one supporting element is elongated and has an axial segment and two connecting heads. The axial segment has at least one concave edge and at least one loading section. The connecting heads are respectively formed on two connecting ends of the axial segment. The restraining element has at least one pair of side boards, two restraining boards and at least one viewing hole. Each one of the restraining boards is hollow and has an inner panel and an outer panel. The at least one viewing hole is formed through the restraining element and aligns along the at least one loading section of the axial segment.

33 Claims, 86 Drawing Sheets

(56) References Cited

U.S. PATENT DOCUMENTS

2010/0319274 A1* 12/2010 Tsai ..... E04H 9/02 52/167.3
2012/0233955 A1* 9/2012 Tsai ..... E04H 9/02 52/653.1
2013/0139452 A1* 6/2013 Tsai ..... E04B 1/98 52/167.3
2015/0225951 A1* 8/2015 Tsai ..... E04C 3/04 52/836
2015/0225952 A1* 8/2015 Tsai ..... E04C 3/04 52/836
2015/0225954 A1* 8/2015 Tsai ..... E04C 3/06 52/836
2015/0225972 A1* 8/2015 Tsai ..... E04C 3/00 52/848
2015/0259899 A1* 9/2015 Tsai ..... E04H 9/02 248/542

FOREIGN PATENT DOCUMENTS

TW M345836 12/2008
TW M389142 9/2010

* cited by examiner

BRACING DEVICE

BACKGROUND OF THE INVENTION

1. Field of the Invention

The present invention relates to a strengthening support device for buildings and civil engineering structures, and more particularly to a bracing device that has at least one viewing hole to enable an inspector to see an interior structure of the bracing device conveniently to ensure the structural safety of a building or a civil engineering structure.

2. Description of Related Art

To strengthen the structural toughness and the supporting strength of a large building and civil engineering structures, conventional bracing devices are used between the beams and the pillars of the building to provide a proper axial resilience, to strengthen the structure and to eliminate the vibration energy and other performance. The applicant had previously proposed a bracing device for a structure such as the Taiwan Patent Numbers: M321445, M345092, M345836 and M389142. In the above-mentioned patents, the bracing device has a supporting element and a restraining element. The restraining element is mounted around the supporting element to provide a supporting and restraining effect to the supporting element, and this can prevent the supporting element from buckling under pressure.

The applicant has previously proposed various types of bracing device that can able to meet the different supporting needs of buildings. When the buildings are deformed by an earthquake or a strong wind, the conventional bracing devices can be used to against the lateral forces that are produced by the earthquake or the strong wind to reduce the shaking conditions of buildings. However, after the earthquake or the strong wind, an inspector cannot inspect the damage of the supporting element due to the restraining element is fully mounted around the supporting element. Then, the inspector needs to dismantle the restraining element from the supporting element during an inspecting process of the structural safety of the building. Particularly, the cost of re-constructing the restraining element is high, the re-construction of the restraining element is difficult and this will become a major limit when inspecting the structural safety of the building. Consequently, the inspector only can skip the inspection of the supporting element of the conventional bracing device and this will generate hidden worries of the structural safety of the building.

To overcome the shortcomings, the present invention tends to provide a bracing device to mitigate or obviate the aforementioned problems.

SUMMARY OF THE INVENTION

The main objective of the invention is to provide a bracing device that has at least one viewing hole to enable an inspector to see an interior structure of the bracing device conveniently to ensure the structural safety of a building or a civil engineering structure.

The bracing device in accordance with the present invention has a supporting module and a restraining element mounted around the supporting module to provide a restraining-supporting effect to the supporting module. The supporting module has at least one supporting element. The at least one supporting element is elongated and has an axial segment and two connecting heads. The axial segment has at least one concave edge and at least one loading section. The connecting heads are respectively formed on two connecting ends of the axial segment. The restraining element has at least one pair of side boards, two restraining boards and at least one viewing hole. Each one of the restraining boards is hollow and has an inner panel and an outer panel. The at least one viewing hole is formed through the restraining element and aligns along the at least one concave edge of the axial segment.

Other objects, advantages and novel features of the invention will become more apparent from the following detailed description when taken in conjunction with the accompanying drawings.

DETAILED DESCRIPTION OF PREFERRED EMBODIMENT

Figure 1:
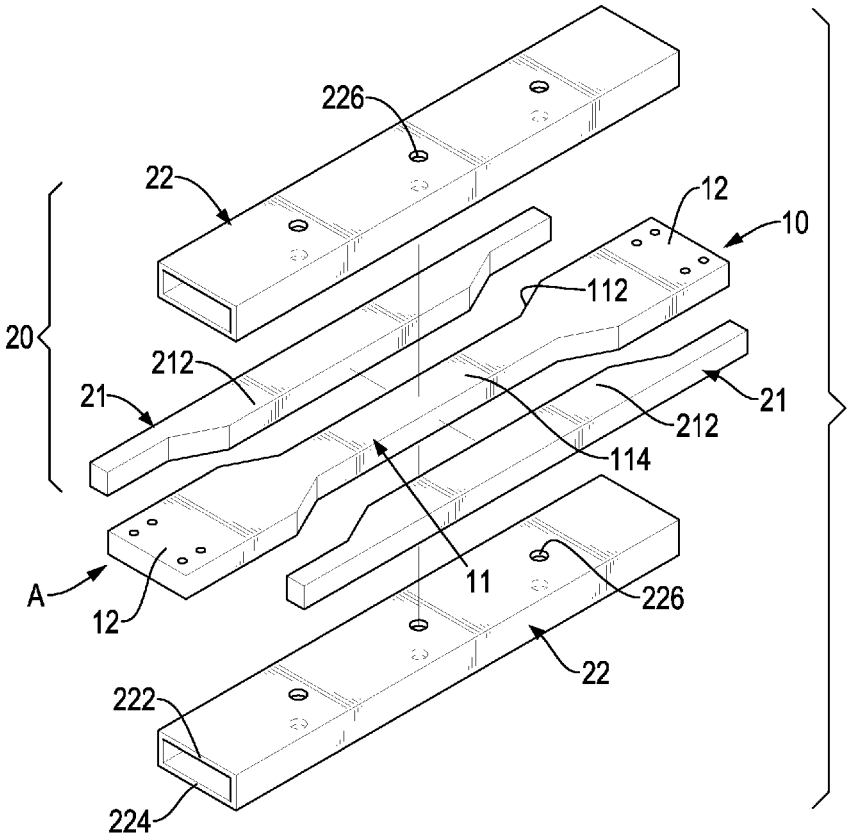
FIG. 1 is an exploded perspective view of a first embodiment of a bracing device in accordance with the present invention.

A bracing device in accordance with the present invention can be applied to a building, a bridge or an instrument between pillars and beams of such structures, and comprises a supporting module A and a restraining element 20 mounted around the supporting module A to provide a restraining-supporting effect to the supporting module A. The supporting module A has at least one supporting element 10. The at least one supporting element 10 is elongated and has a first sidewall, a second sidewall, an axial segment 11 and two connecting heads 12.

The axial segment 11 is elongated-plate-shaped and has a first side, a second side, two sidewalls, two connecting ends, at least one concave edge 112 and at least one loading section 114. The at least one concave edge 112 is nonlinear and is formed in one of the sidewalls of the axial segment 11 to form the corresponding sidewall of the axial segment 11 as an nonlinear sidewall. The at least one loading section 114 is formed on the axial segment 11 at a position corresponding to the at least one concave edge 112 between the connecting ends of the axial segment 11. The connecting heads 12 are respectively formed on the connecting ends of the axial segment 11.

The restraining element 20 has at least one pair of side boards 21, two restraining boards 22 and at least one viewing hole 214, 226. Each one of the at least one pair side boards 21 is mounted in one of the at least one concave edge 112 of the axial segment 11. Each one of the at least one pair of side boards 21 has a first side and a second side. The restraining boards 22 are respectively mounted on the first sides and the second sides of the at least one pair of side boards 21. The at least one viewing hole 214, 226 is formed through one of the at least one pair of side boards 21 or one of the restraining boards 22 to corresponding a position of the at least one loading section 114 of the supporting element 10. Then, a user can easily see the at least one loading section 114 of the supporting element 10 via the at least one viewing hole 214, 226 of the restraining element 20 without dismantling the restraining element 20.

The bracing device in accordance with the present invention has several embodiments and will be described as follows.

With reference to FIG. 1, in a first embodiment of a bracing device in accordance with the present invention, the bracing device has a supporting module A and a restraining element 20 mounted around the supporting module A to provide a restraining-supporting effect to the supporting module A. The supporting module A has an elongated-plate-shaped supporting element 10. The supporting element 10 has an axial segment 11 and two connecting heads 12. The axial segment 11 has two concave edges 112 and a loading section 114. The concave edges 112 are respectively formed in the sidewalls of the axial segment 11. The loading section 114 is formed on the axial segment 11 between the two concave edges 112.

Each one of the connecting heads 12 is flat and has a first side, a second side and multiple connecting holes. The connecting holes are formed through the first side and the second side of the connecting head 12. Then, the supporting element 10 can be connected to a pillar or a beam of a building by fasteners such as bolts or rivets mounting through the connecting holes of the connecting heads 12 or by welding to connect the supporting element 10 with the pillar or the beam of the building.

The restraining element 20 is mounted around the axial segment 11 of the supporting element 10 and has two side boards 21 and two restraining boards 22. The side boards 21 are respectively mounted in the concave edges 112 of the axial segment 11 at a strong axis direction, and each one of the side boards 21 has an inner side and a convex edge 212. The inner sides of the side boards 21 respectively face the concave edges 112 of the axial segment 11. The convex edges 212 are respectively formed on and protrude from the inner sides of the side boards 21 and respectively matched with the concave edges 112 of the axial segment 11 at intervals. Preferably, the supporting element 10 and the side boards 21 can be formed by a cutting machine cutting an elongated board to take the maximum advantage of the economic efficiency of the material of the elongated board. In addition, the supporting element 10 has a thickness thinner than the thicknesses of the side boards 21.

The restraining boards 22 are hollow flat tubes, are securely connected to the side boards 21 by welding, fastening or riveting to enable the restraining element 20 to mount around the supporting element 10. Each one of the restraining board 22 has a rectangular-shaped cross section, an inner side, an outer side, two sidewalls, an inner panel 222, an outer panel 224 and at least one viewing hole 226. The inner side of the restraining board 22 faces the supporting element 10. The sidewalls of the restraining board 22 are formed with the inner side and the outer side of the restraining board 22 to form the rectangular and hollow restraining board 22. The inner panel 222 is formed on the inner side of the restraining board 22 and abuts on the first side or the second side of the axial segment 11 of the supporting element 10. The outer panel 224 is formed on the outer side of the restraining board 22 and is opposite to the inner panel 222. The at least one viewing hole 226 is formed through the inner panel 222 and the outer panel 224 of the restraining board 22 and aligns along the loading section 114 of the supporting element 10. Furthermore, each one of the restraining boards 22 has three viewing holes 226 formed through the restraining board 22 at intervals. Then, a user can easily see the loading section 114 of the supporting element 10 via the viewing holes 226 of the restraining boards 22 of the restraining element 20.

Figure 2:
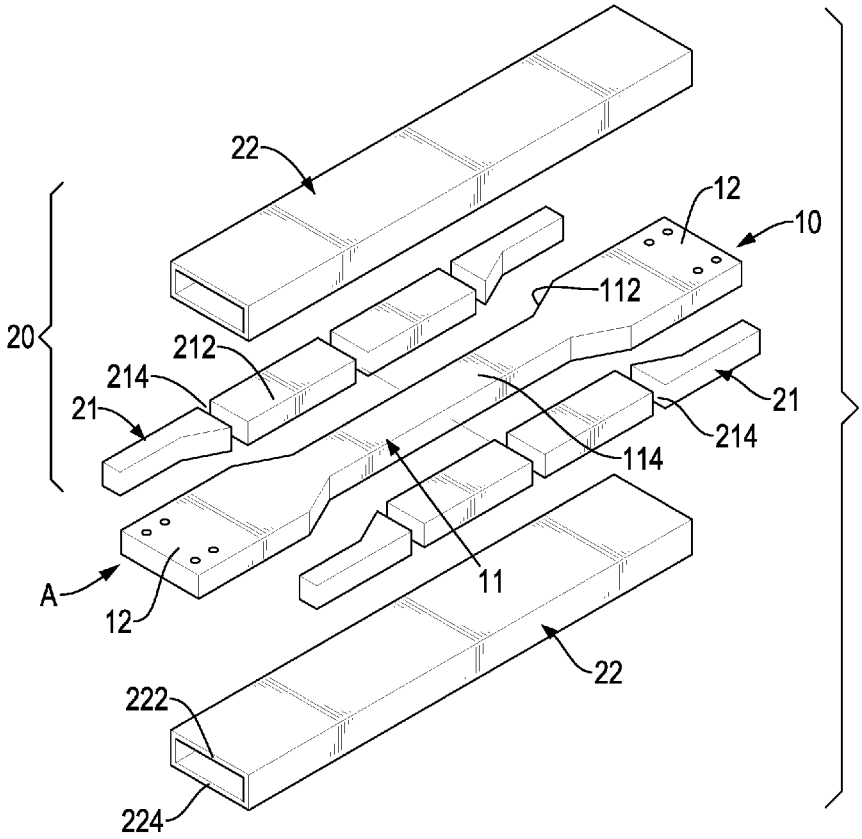
FIG. 2 is an exploded perspective view of a second embodiment of a bracing device in accordance with the present invention.

With reference to FIG. 2, a second embodiment of a bracing device in accordance with the present invention is substantially the same as the first embodiment in FIG. 1 except the following features. Each one of the side boards 21 has three viewing holes 214 formed through the side board 21 at intervals, and the restraining boards 22 do not have the viewing holes 226. Then, the user can easily see the loading section 114 of the supporting element 10 via the viewing holes 214 of the side boards 21 of the restraining element 20.

Figure 3:
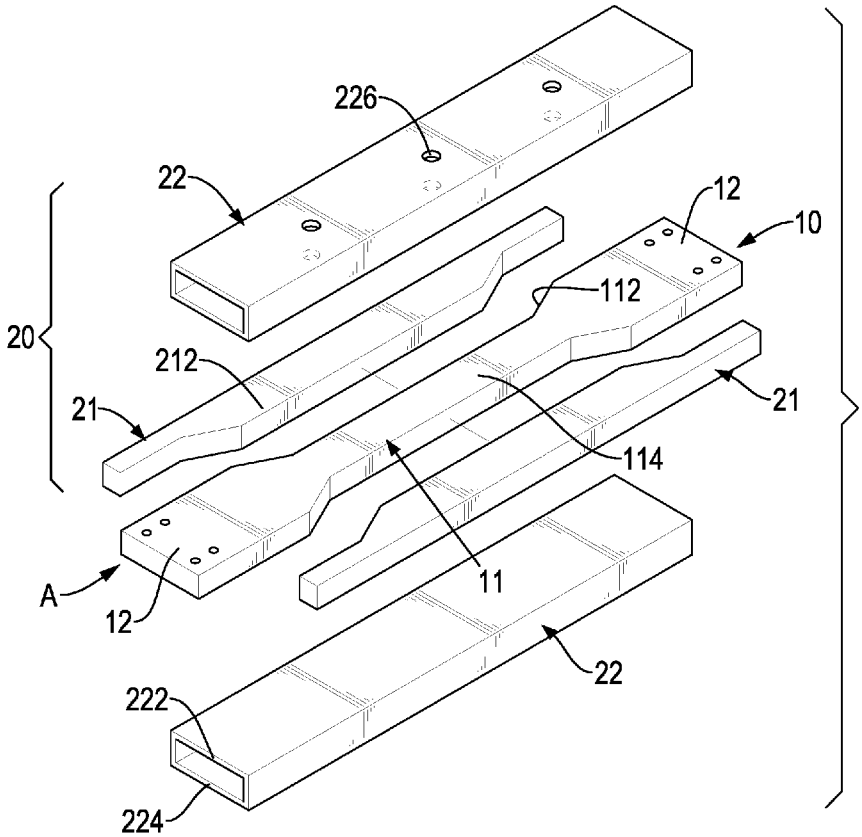
FIG. 3 is an exploded perspective view of a third embodiment of a bracing device in accordance with the present invention.

With reference to FIG. 3, a third embodiment of a bracing device in accordance with the present invention is substantially the same as the first embodiment in FIG. 1 except the following features. One of the restraining boards 22 has three viewing holes 226 formed through the restraining board 22 at intervals. Then, a user can easily see the loading section 114 of the supporting element 10 via the viewing holes 226 of the corresponding restraining board 22 of the restraining element 20.

Figure 4:
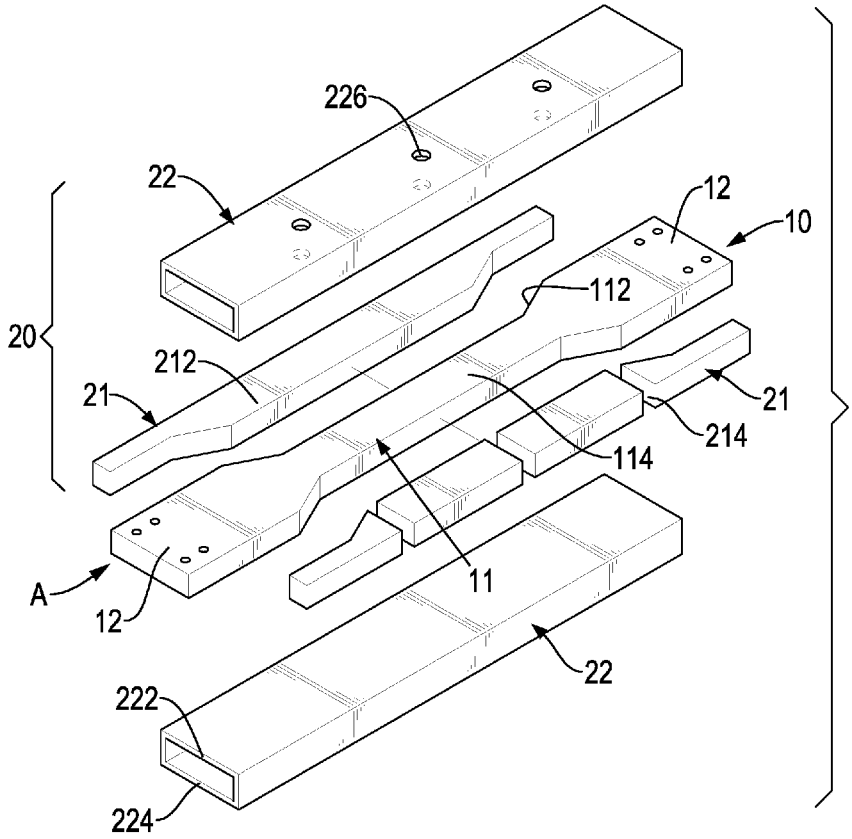
FIG. 4 is an exploded perspective view of a fourth embodiment of a bracing device in accordance with the present invention.

With reference to FIG. 4, a fourth embodiment of a bracing device in accordance with the present invention is substantially the same as the first embodiment FIG. 1 except the following features. One of the side boards 21 has three viewing holes 214 formed through the side board 21 at intervals, and one of the restraining boards 22 has three viewing holes 226 formed through the restraining board 22 at intervals. Then, the user can easily see the loading section 114 of the supporting element 10 via the viewing holes 214 of the corresponding side board 21 or the viewing holes 226 of the corresponding restraining board 22 of the restraining element 20.

Figure 5:
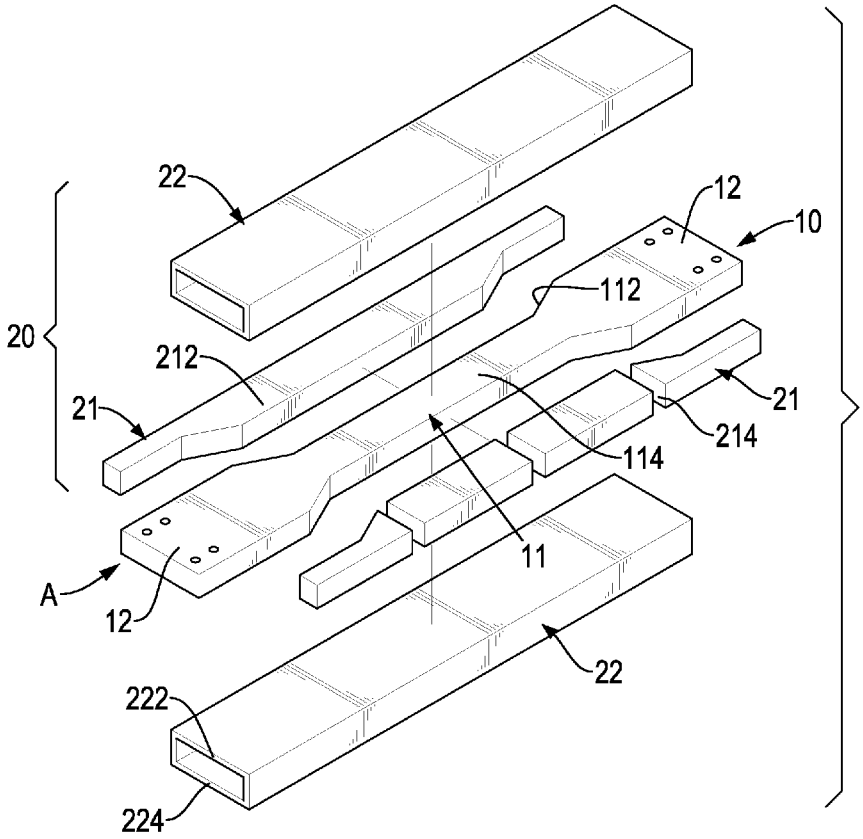
FIG. 5 is an exploded perspective view of a fifth embodiment of a bracing device in accordance with the present invention.

With reference to FIG. 5, a fifth embodiment of a bracing device in accordance with the present invention is substantially the same as the first embodiment in FIG. 1 except the following features. One of the side boards 21 has three viewing holes 214 formed through the side board 21 at intervals. Then, the user can easily see the loading section 114 of the supporting element 10 via the viewing holes 214 of the corresponding side board 21.

Figure 6:
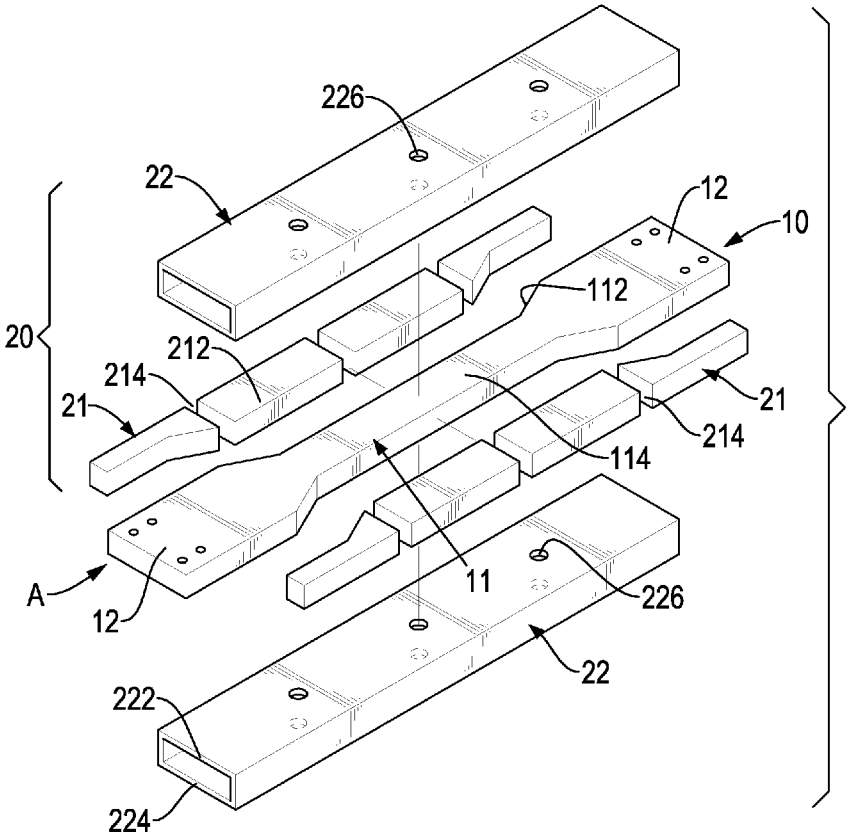
FIG. 6 is an exploded perspective view of a sixth embodiment of a bracing device in accordance with the present invention.

With reference to FIG. 6, a fourth embodiment of a bracing device in accordance with the present invention is substantially the same as the first embodiment in FIG. 1 except the following features. Each one of the side boards 21 has three viewing holes 214 formed through the side board 21, and each one of the restraining boards 22 has three viewing holes 226 formed through the restraining board 22. Then, the user can easily see the loading section 114 of the supporting element 10 via the viewing holes 214 of the side boards 21 and the viewing holes 226 of the restraining boards 22 of the restraining element 20.

Figure 7:
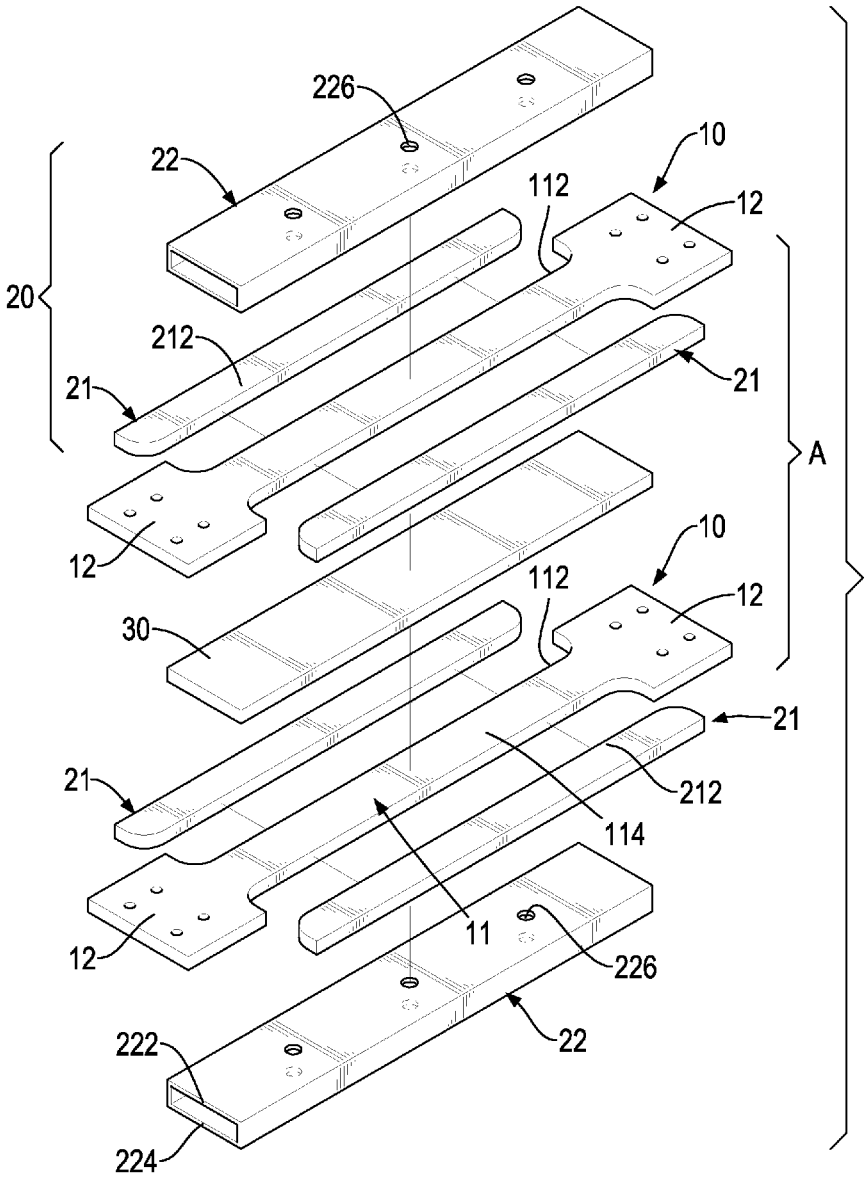
FIG. 7 is an exploded perspective view of a seventh embodiment of a bracing device in accordance with the present invention.

With reference to FIG. 7, a seventh embodiment of a bracing device in accordance with the present invention is substantially the same as the first embodiment in FIG. 1 except the following features. The supporting module A has a connecting board 30 and two supporting elements 10. The connecting board 30 is elongated-plate-shaped and has a first side and a second side. The supporting elements 10 respectively abut on the first side and the second side of the connecting board 30, and each supporting element 10 has an axial segment 11 and two connecting heads 12.

The axial segments 11 abut on the connecting board 30, and each one of the axial segments 11 has a first side, a second side, two sidewalls, two connecting ends, two concave edges 112 and a loading section 114. The concave edges 112 are nonlinear and are respectively formed in the sidewalls of the axial segment 11. The loading section 114 is formed on the axial segment 11 at a position corresponding to the concave edges 112. The connecting heads 12 are respectively formed on the connecting ends of the axial segment 11, and each one of the connecting heads 12 has a first side, a second side and multiple connecting holes. The connecting holes are formed through the first side and the second side of the connecting head 12.

The restraining element 20 has four side boards 21 and two restraining boards 22. Two of the side boards 21 are mounted in the concave edges 112 of one of the supporting elements 10, and the other two side boards 21 are mounted in the concave edges 112 of the other supporting element 10. The restraining boards 22 respectively abut on the axial segments 11 of the supporting elements 10. The side boards 21, the restraining boards 22 and the connecting board 30 are securely connected to each other by welding, fastening or riveting to enable the restraining element 20 to mount around the supporting elements 10.

Each one of the restraining boards 22 is a hollow flat tube and has a rectangular-shaped cross section, an inner side, an outer side, two sidewalls, an inner panel 222, an outer panel 224 and at least one viewing hole 226. The inner sides of the restraining boards 22 respectively face the supporting elements A. The sidewalls of the restraining board 22 are formed with the inner side and the outer side of the restraining board 22 to form the rectangular and hollow restraining board 22. The inner panel 222 is formed on the inner side of the restraining board 22 and abuts on one of the supporting elements 10. The outer panel 224 is formed on the outer side of the restraining board 22 and is opposite to the inner panel 222. The at least one viewing hole 226 is formed through the inner panel 222 and the outer panel 224 of the restraining board 22 and aligns along the loading section 114 of one of the supporting elements 10. Furthermore, each one of the restraining boards 22 has three viewing holes 226 formed through the restraining board 22 at intervals. Then, a user can easily see the loading sections 114 of the supporting elements 10 via the viewing holes 226 of the restraining boards 22 of the restraining element 20.

Figure 8:
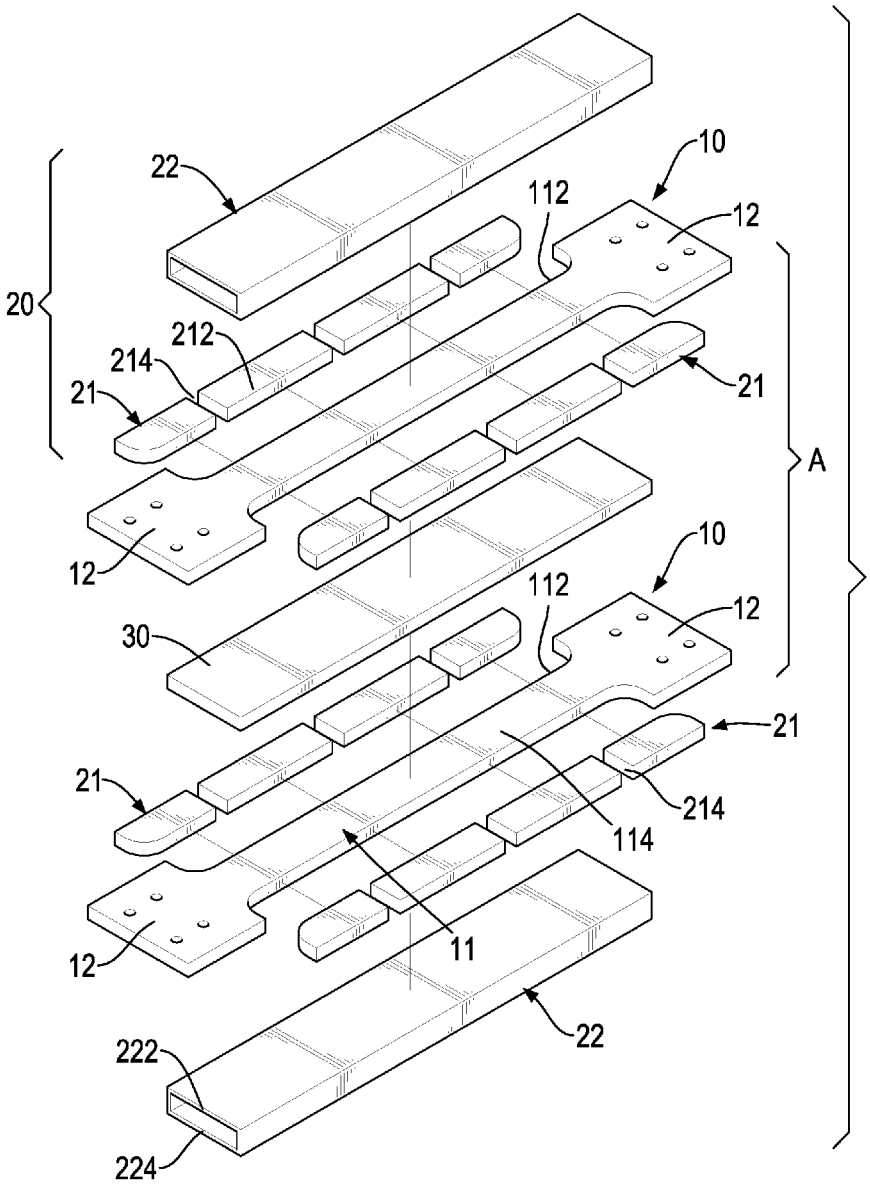
FIG. 8 is an exploded perspective view of an eighth embodiment of a bracing device in accordance with the present invention.

With reference to FIG. 8, an eighth embodiment of a bracing device in accordance with the present invention is substantially the same as the seventh embodiment in FIG. 7 except the following features. Each one of the side boards 21 has three viewing holes 214 formed through the side board 21 aligning along the loading section 114 of a corresponding supporting element 10, and each one of the restraining boards 22 does not have the viewing holes 226. Then, the user can easily see the loading sections 114 of the supporting elements 10 via the viewing holes 214 of the side boards 21 of the restraining element 20.

Figure 9:
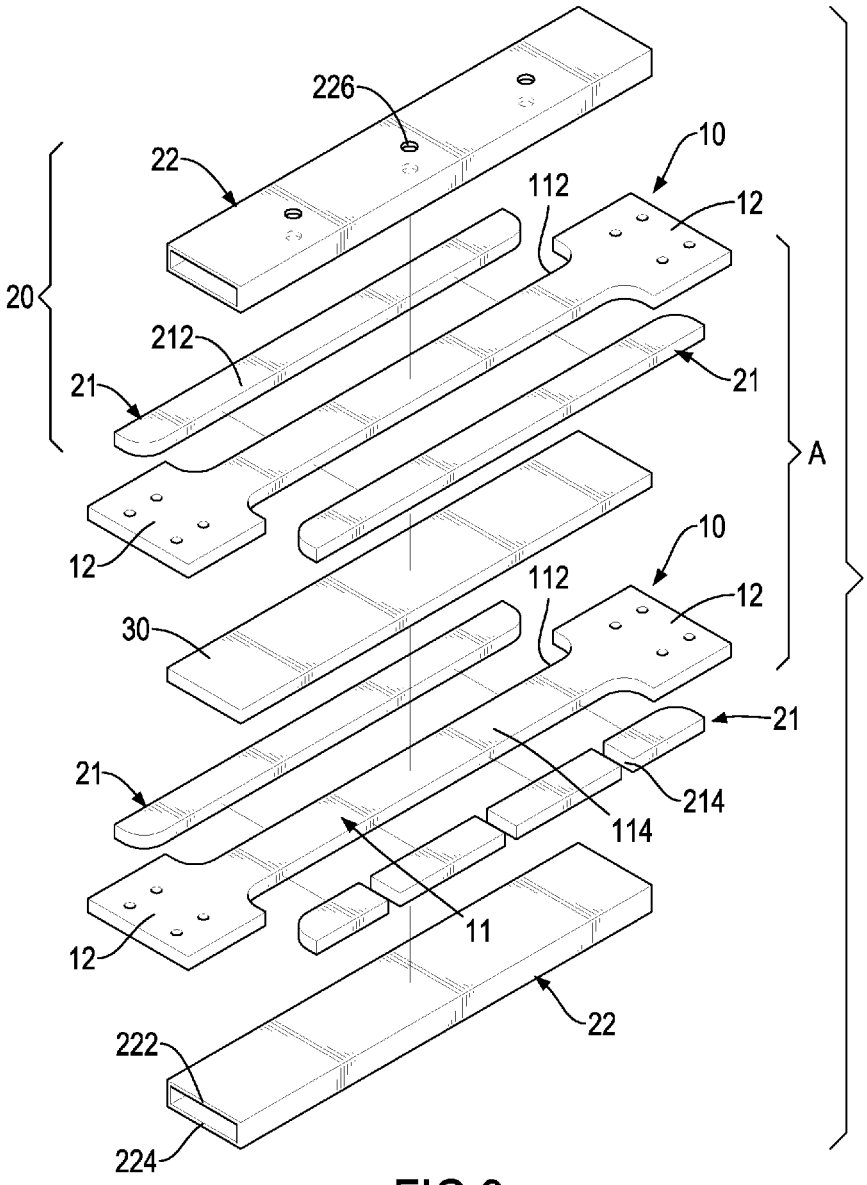
FIG. 9 is an exploded perspective view of a ninth embodiment of a bracing device in accordance with the present invention.

With reference to FIG. 9, a ninth embodiment of a bracing device in accordance with the present invention is substantially the same as the seventh embodiment in FIG. 7 except the following features. One of the side boards 21 that is mounted in one of the supporting elements 10 has three viewing holes 214 formed through the side board 21 at intervals to align along the loading section 114 of the corresponding supporting element 10, and one of the restraining boards 22 that is mounted on the other supporting element 10 has three viewing holes 226 formed through the restraining board 22 to align along the loading section 114 of the corresponding supporting element 10. Then, the user can easily see the loading sections 114 of the supporting elements 10 via the viewing holes 214 of a corresponding side board 21 and the viewing holes 226 of a corresponding restraining board 22 of the restraining element 20.

Figure 10:
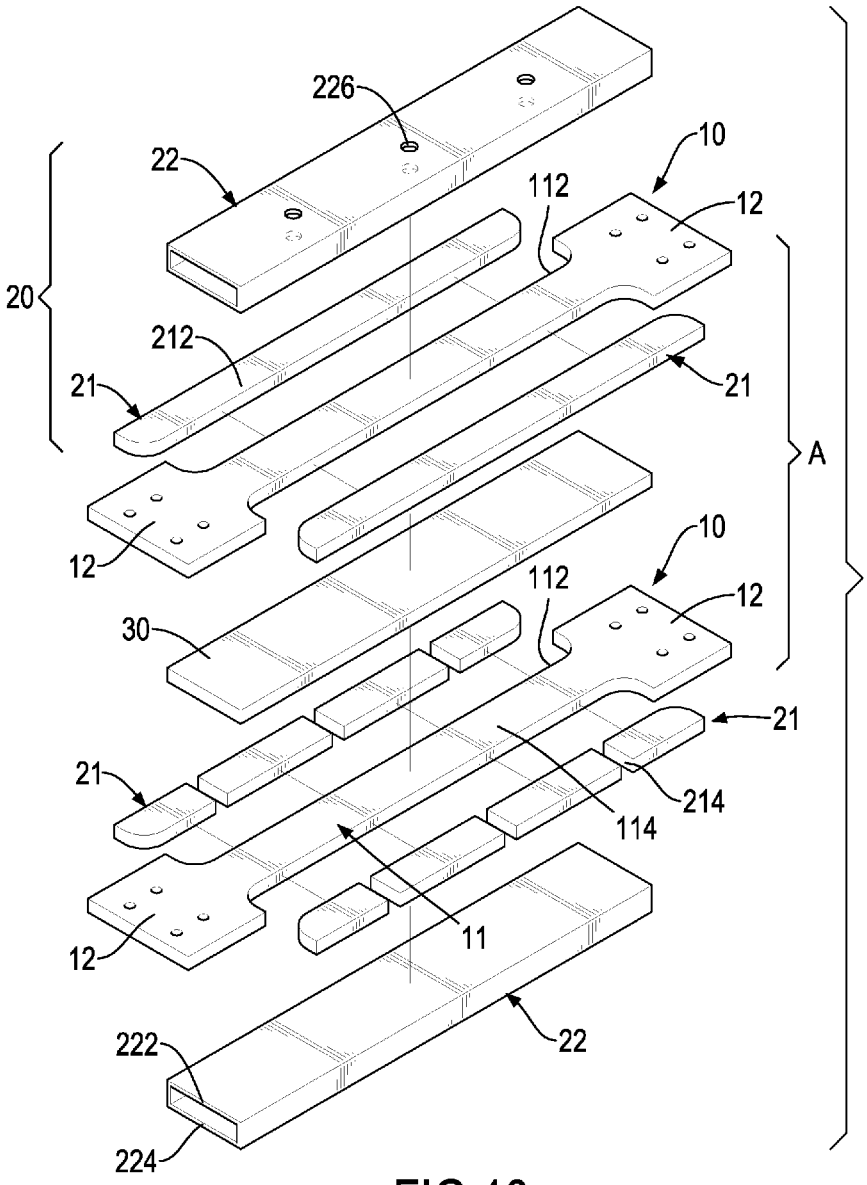
FIG. 10 is an exploded perspective view of a tenth embodiment of a bracing device in accordance with the present invention.

With reference to FIG. 10, a tenth embodiment of a bracing device in accordance with the present invention is substantially the same as the seventh embodiment in FIG. 7 except the following features. Each one of the side boards 21 that are mounted in one of the supporting elements 10 has three viewing holes 214 formed through the side board 21 at intervals to align along the loading section 114 of the corresponding supporting element 10, and one of the restraining boards 22 that is mounted on the other supporting element 10 has three viewing holes 226 formed through the restraining board 22 to align along the loading section 114 of the corresponding supporting element 10. Then, the user can easily see the loading sections 114 of the supporting elements 10 via the viewing holes 214, 226 of the corresponding side boards 21 and the corresponding restraining board 22 of the restraining element 20.

Figure 11:
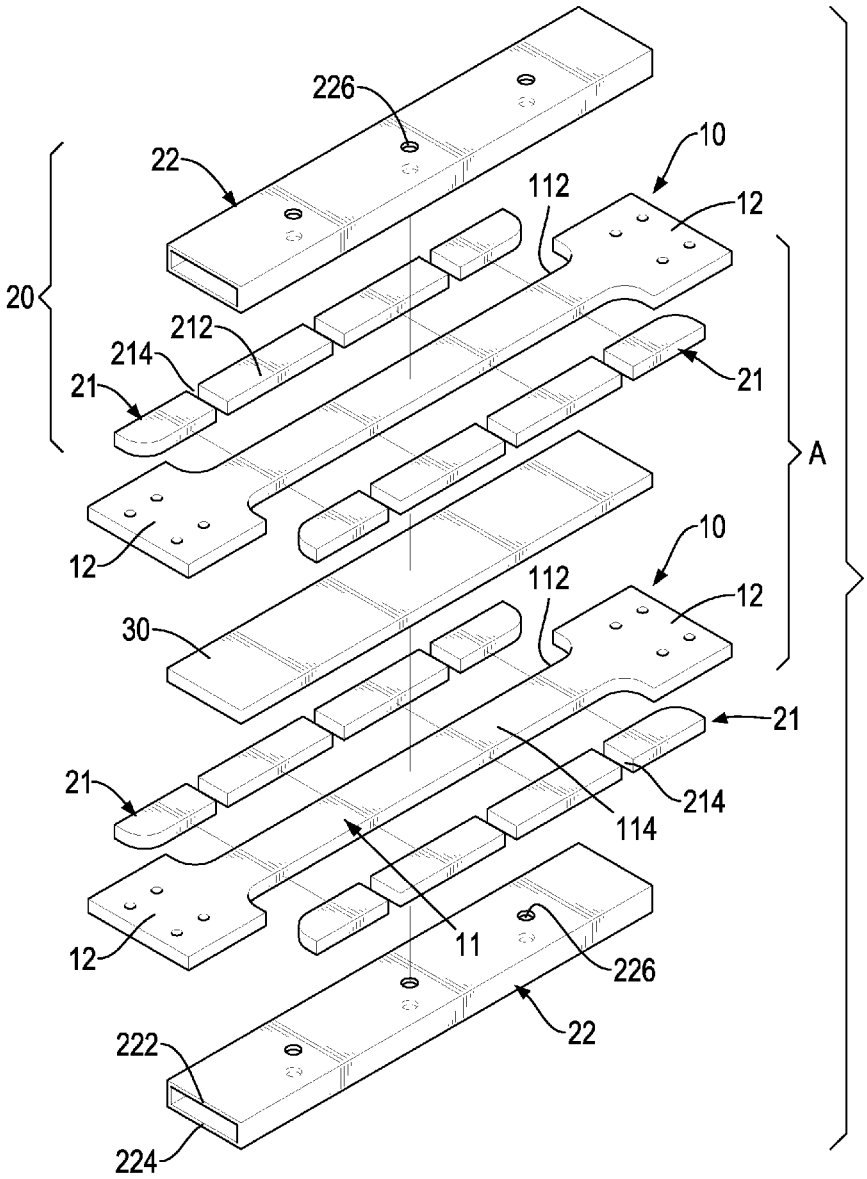
FIG. 11 is an exploded perspective view of an eleventh embodiment of a bracing device in accordance with the present invention.
Figure 12:
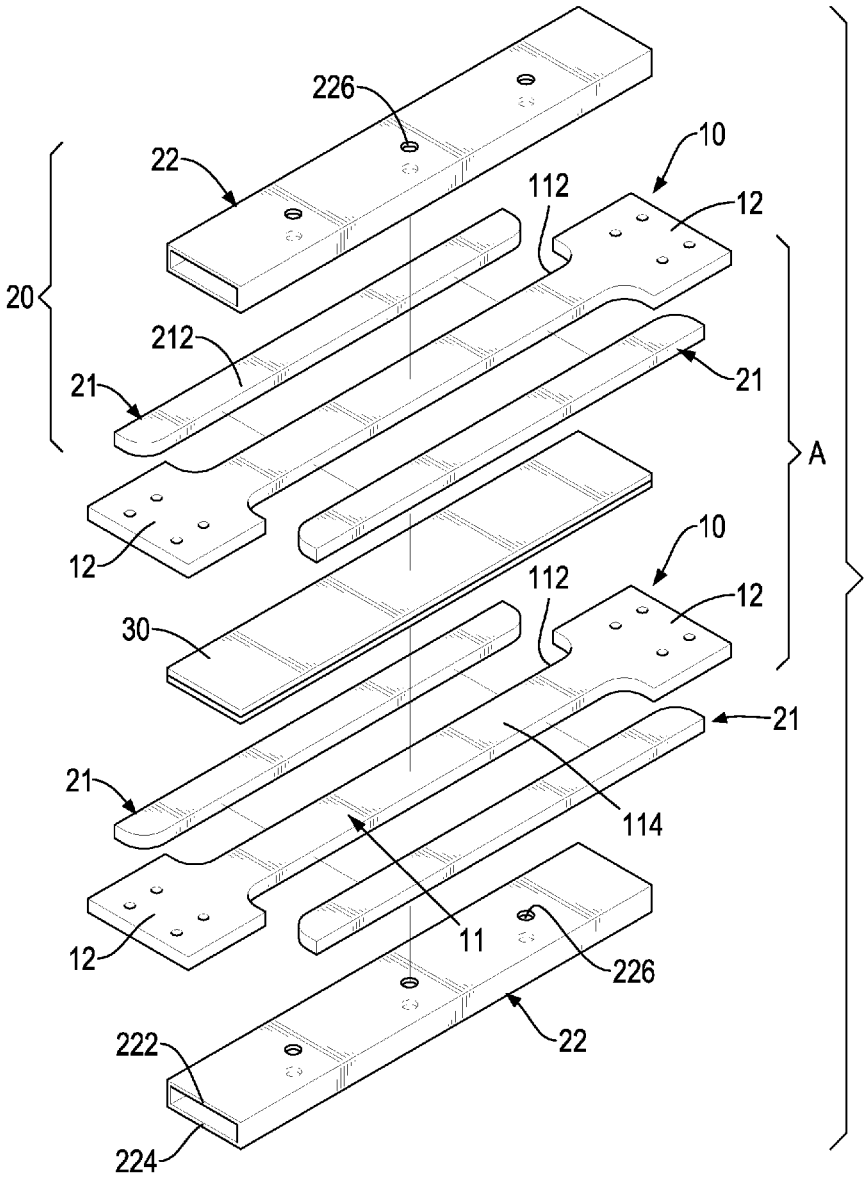
FIG. 12 is an exploded perspective view of a twelfth embodiment of a bracing device in accordance with the present invention.
Figure 13:
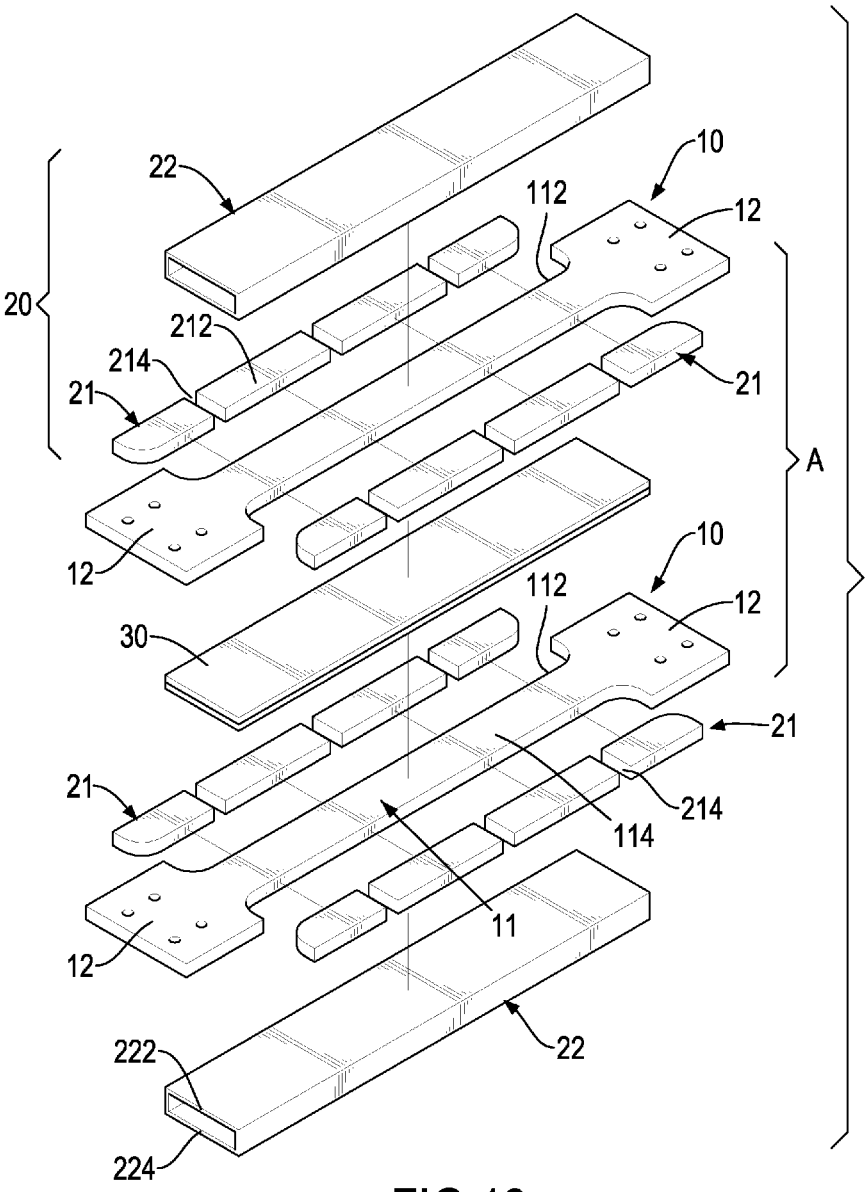
FIG. 13 is an exploded perspective view of a thirteenth embodiment of a bracing device in accordance with the present invention.
Figure 14:
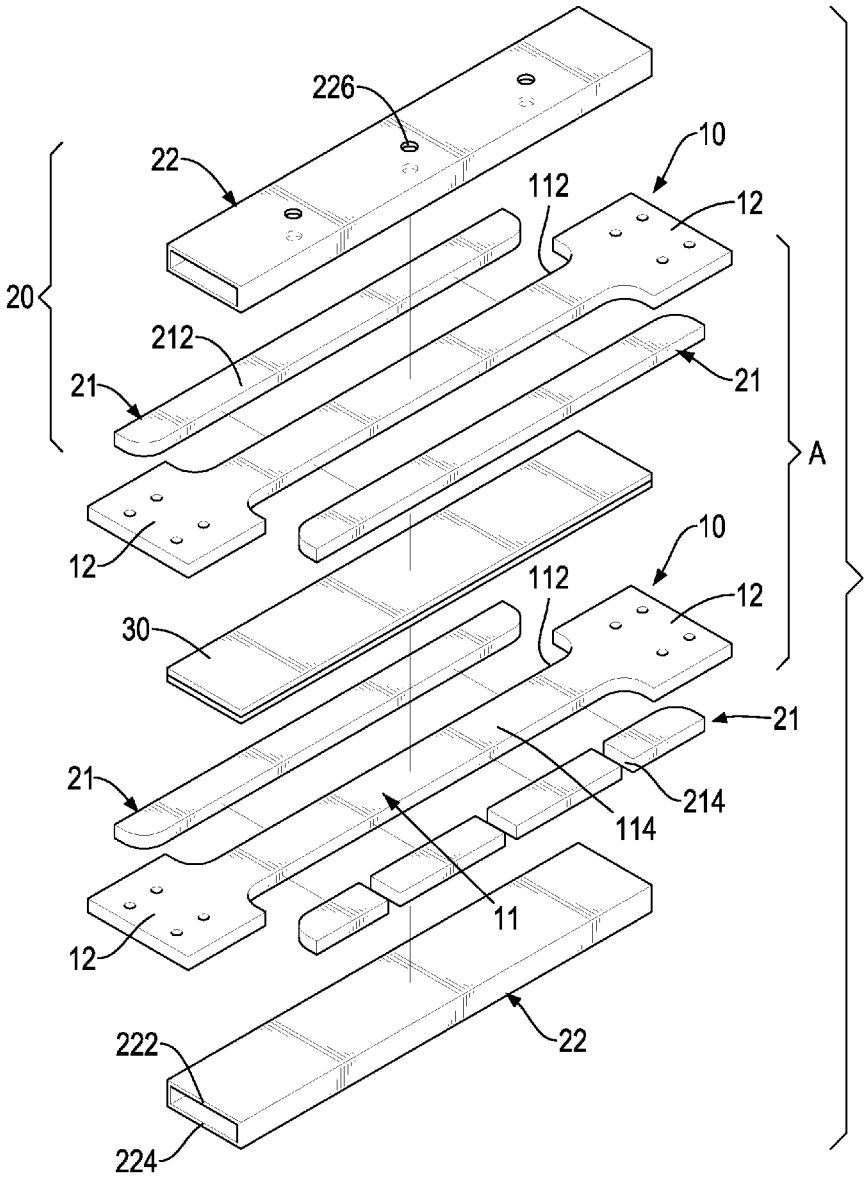
FIG. 14 is an exploded perspective view of a fourteenth embodiment of a bracing device in accordance with the present invention.
Figure 15:
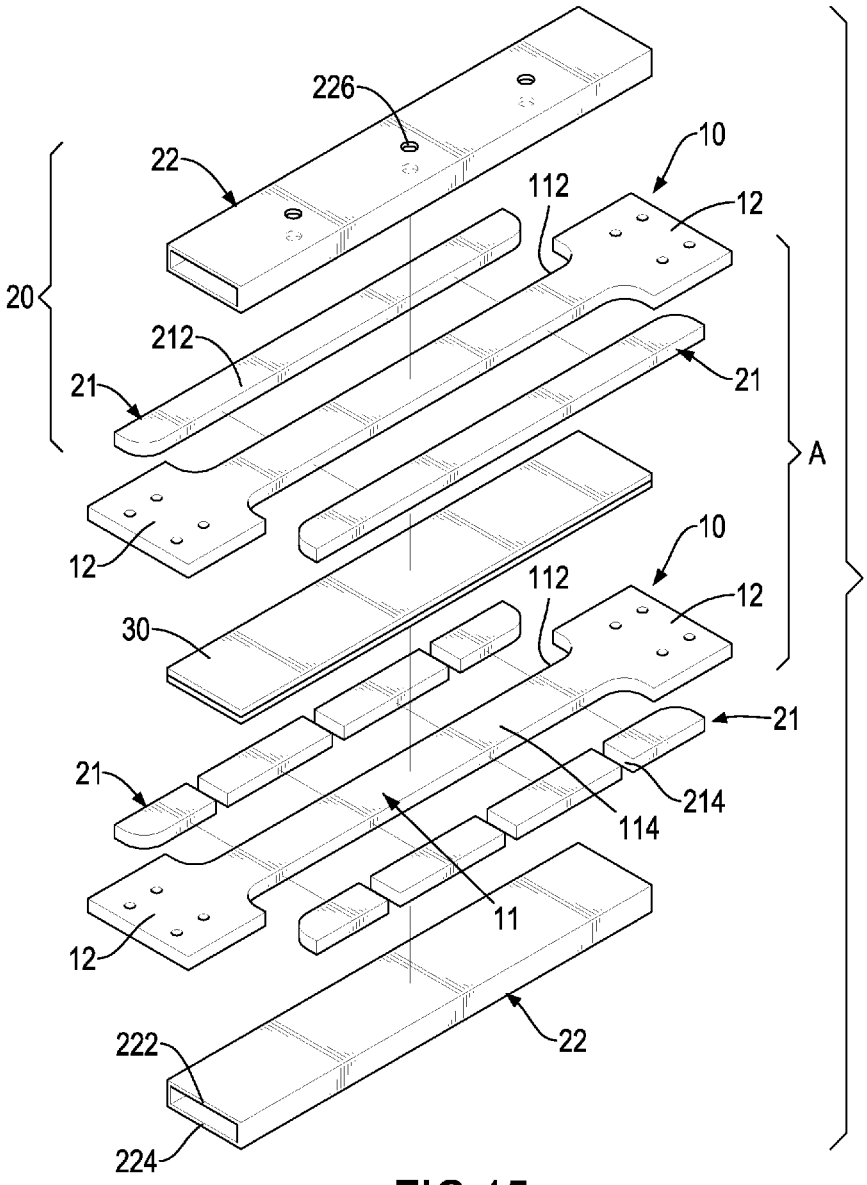
FIG. 15 is an exploded perspective view of a fifteenth embodiment of a bracing device in accordance with the present invention.
Figure 16:
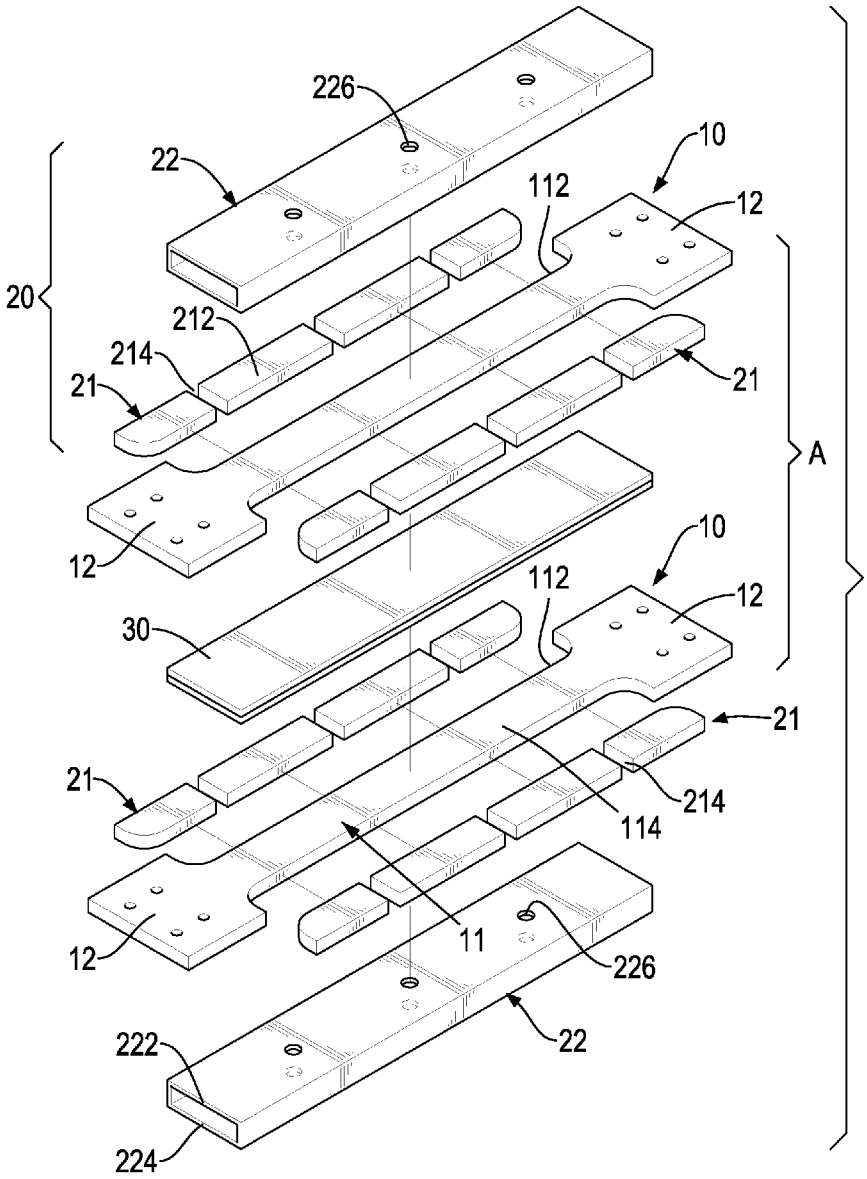
FIG. 16 is an exploded perspective view of a sixteenth embodiment of a bracing device in accordance with the present invention.
Figure 17:
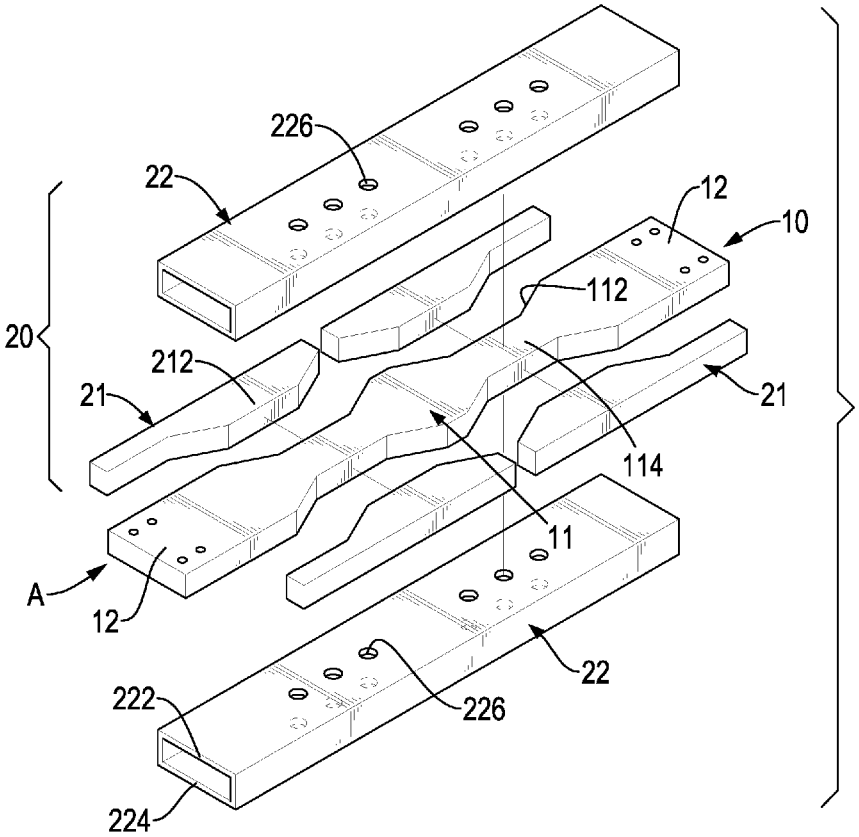
FIG. 17 is an exploded perspective view of a seventeenth embodiment of a bracing device in accordance with the present invention.
Figure 18:
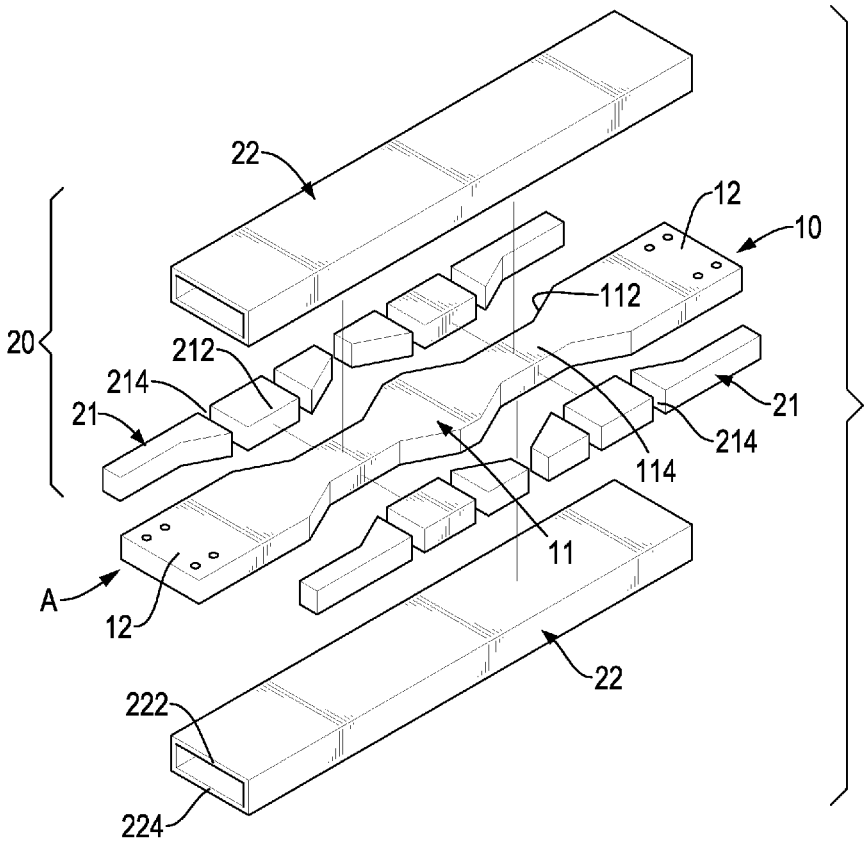
FIG. 18 is an exploded perspective view of an eighteenth embodiment of a bracing device in accordance with the present invention.
Figure 19:
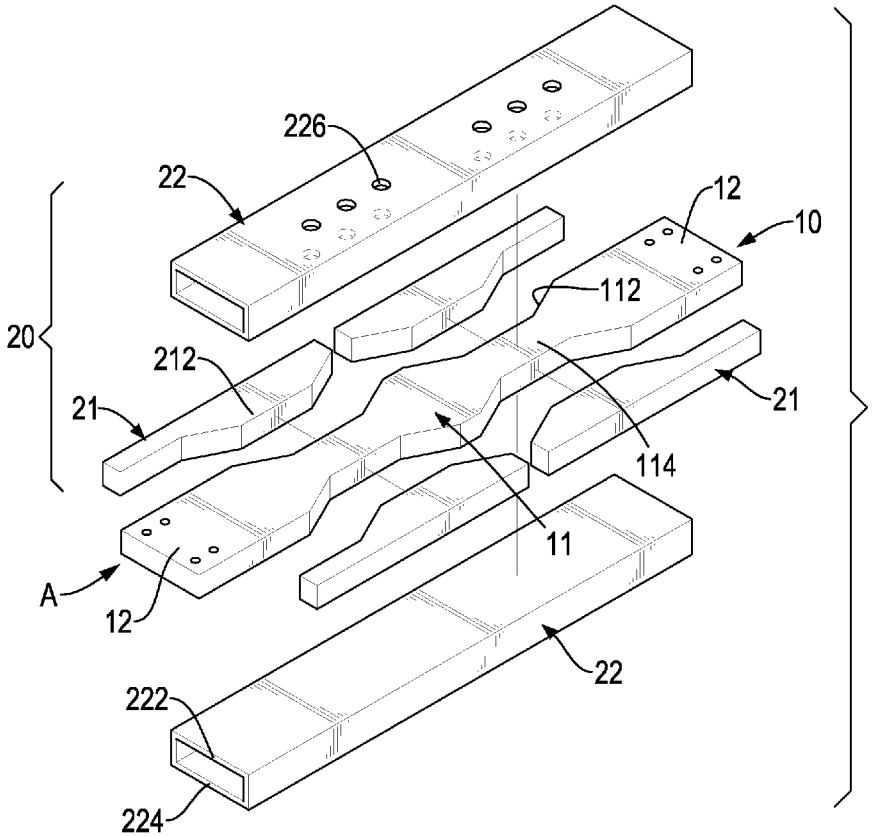
FIG. 19 is an exploded perspective view of a nineteenth embodiment of a bracing device in accordance with the present invention.
Figure 20:
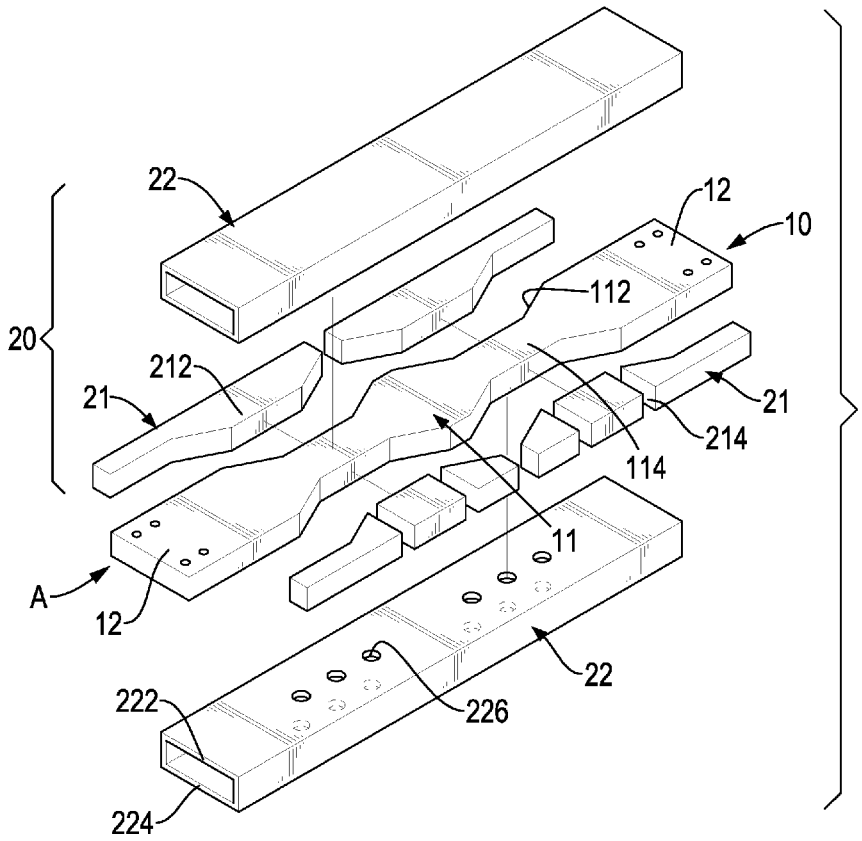
FIG. 20 is an exploded perspective view of a twentieth embodiment of a bracing device in accordance with the present invention.
Figure 21:
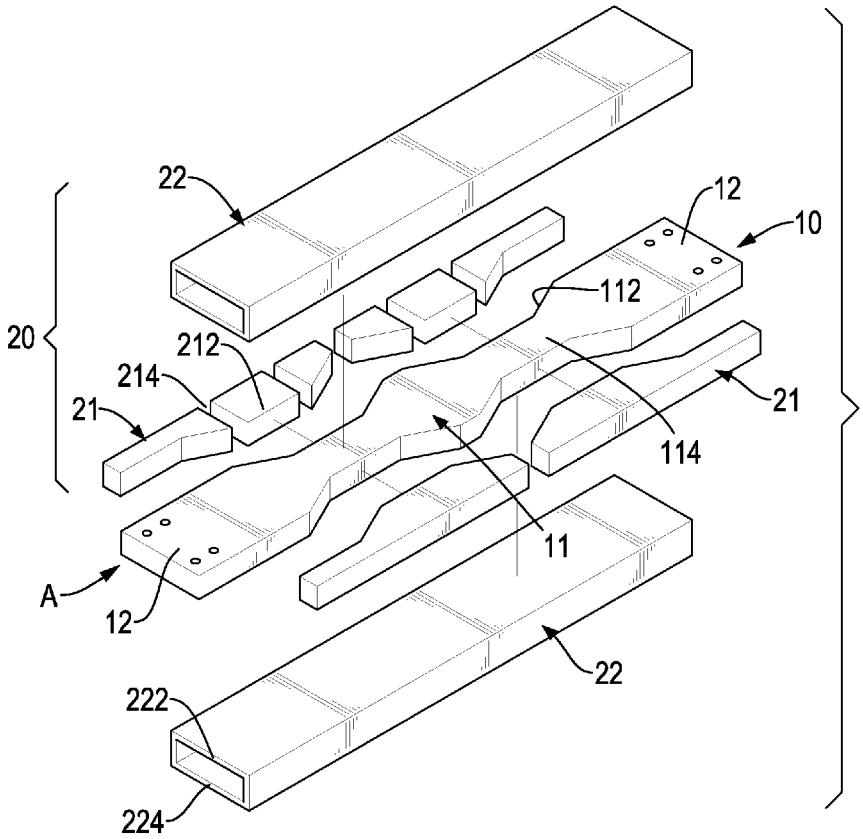
FIG. 21 is an exploded perspective view of a twenty-first embodiment of a bracing device in accordance with the present invention.
Figure 22:
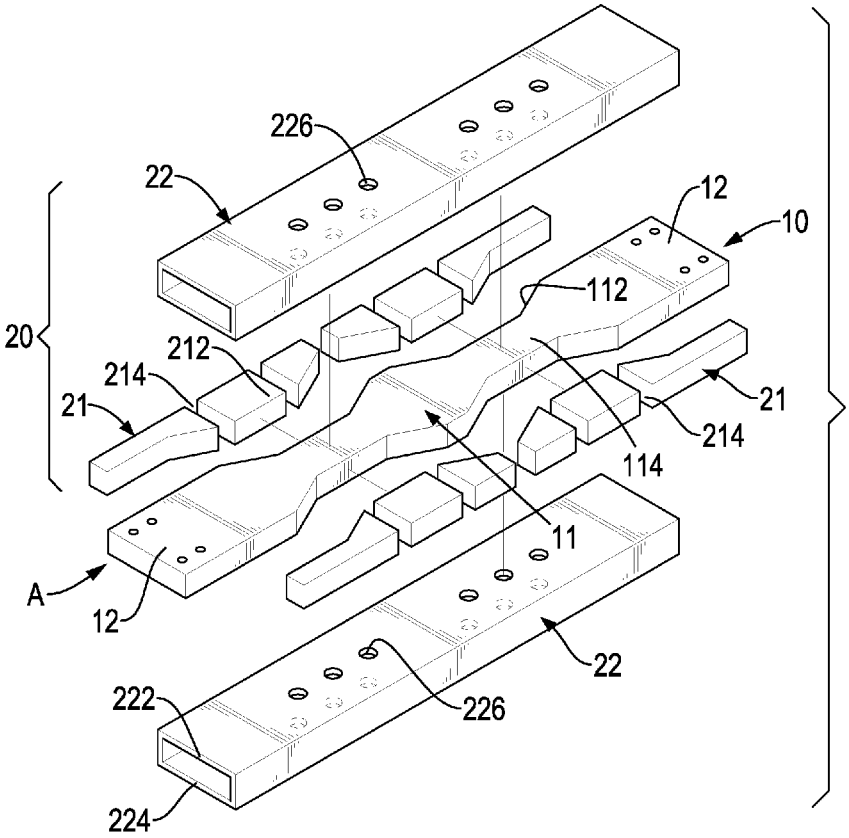
FIG. 22 is an exploded perspective view of a twenty-second embodiment of a bracing device in accordance with the present invention.
Figure 23:
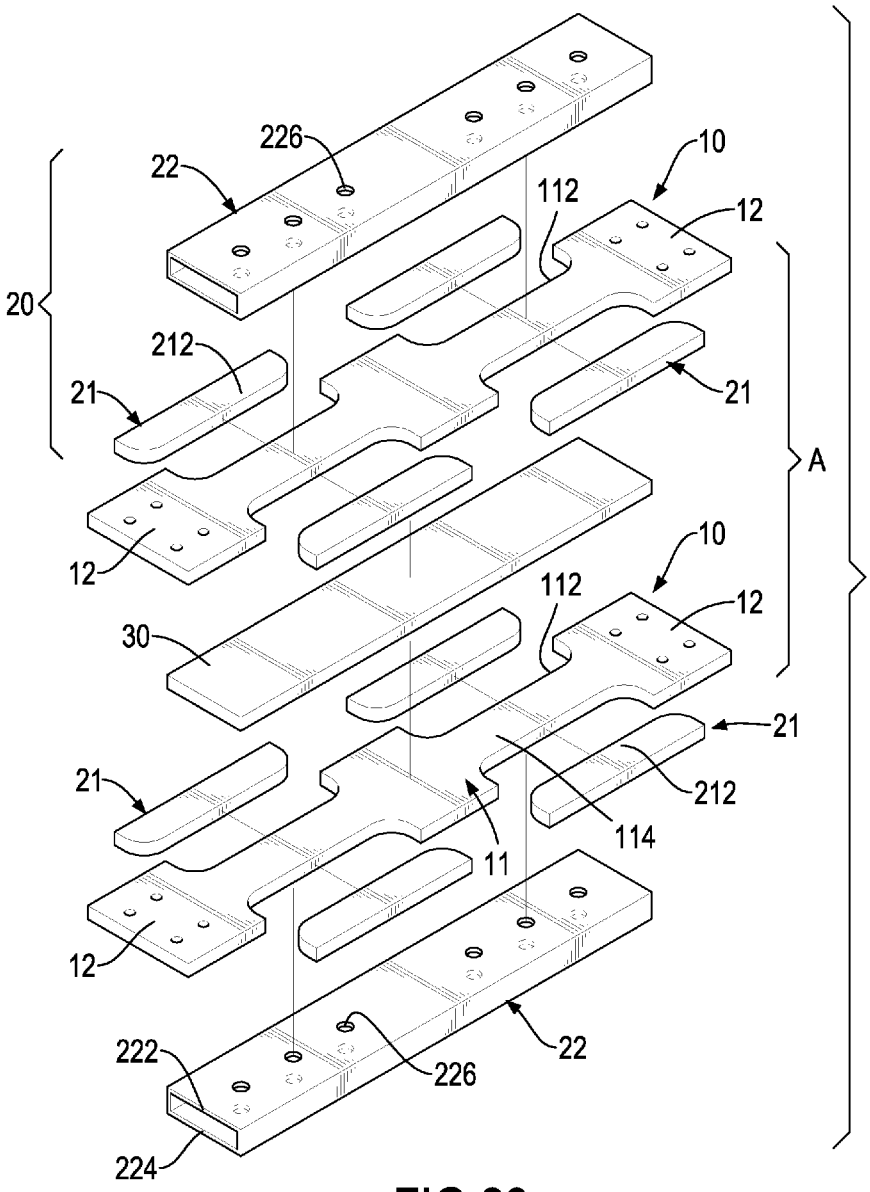
FIG. 23 is an exploded perspective view of a twenty-third embodiment of a bracing device in accordance with the present invention.
Figure 24:
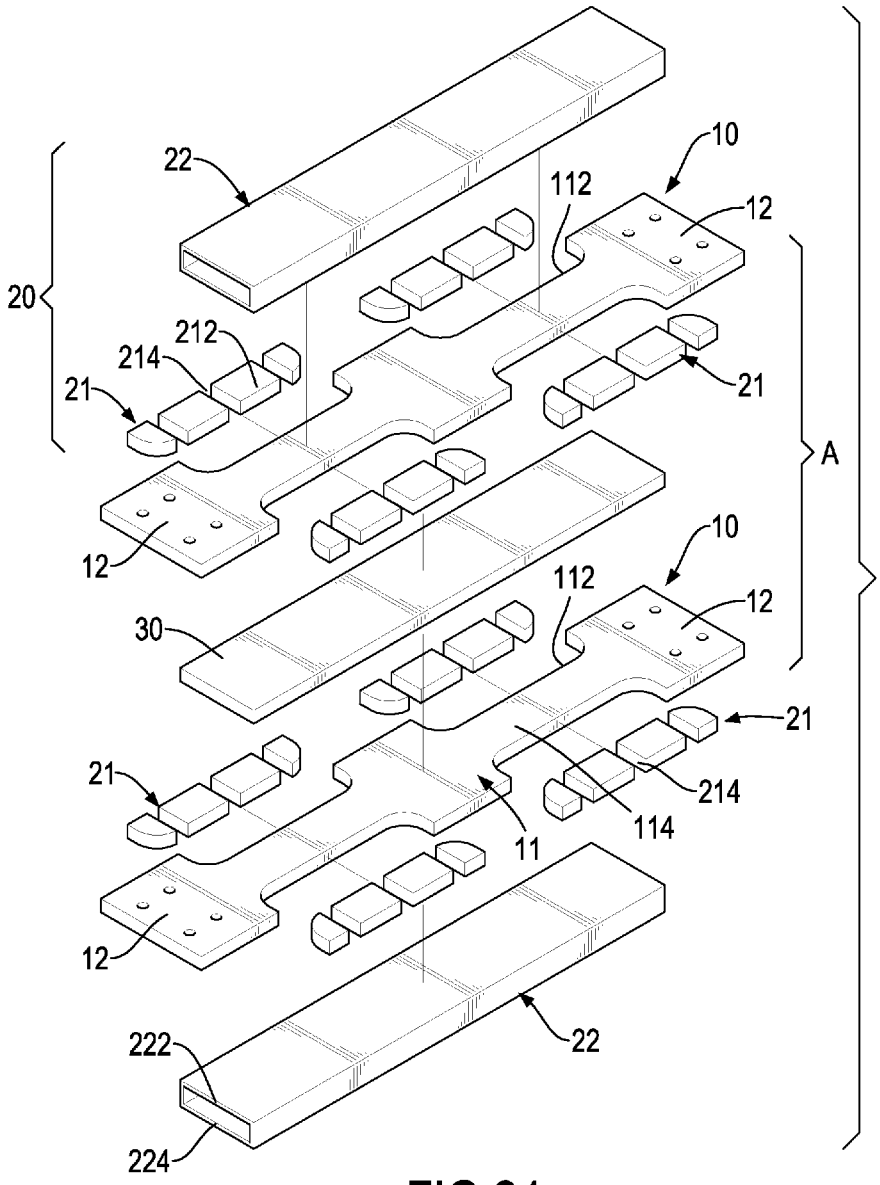
FIG. 24 is an exploded perspective view of a twenty-fourth embodiment of a bracing device in accordance with the present invention.
Figure 25:
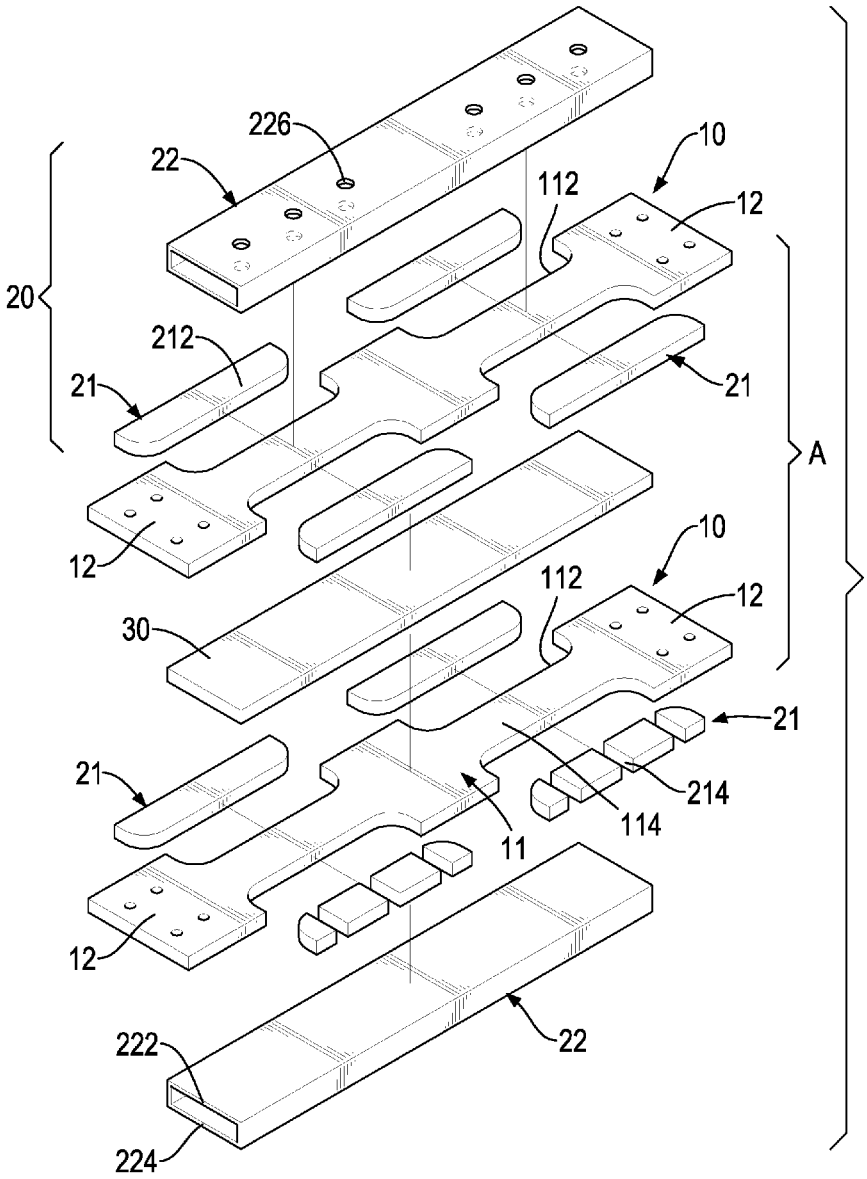
FIG. 25 is an exploded perspective view of a twenty-fifth embodiment of a bracing device in accordance with the present invention.
Figure 26:
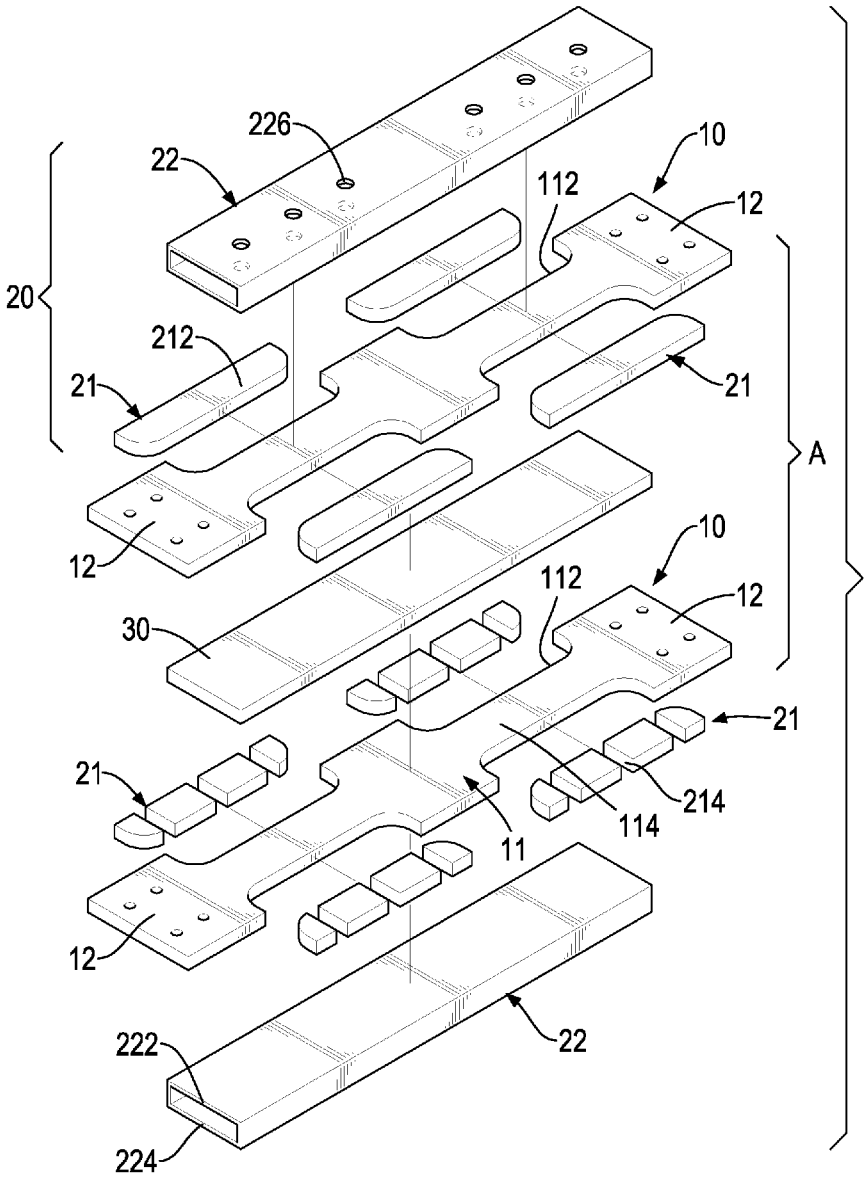
FIG. 26 is an exploded perspective view of a twenty-sixth embodiment of a bracing device in accordance with the present invention.
Figure 27:
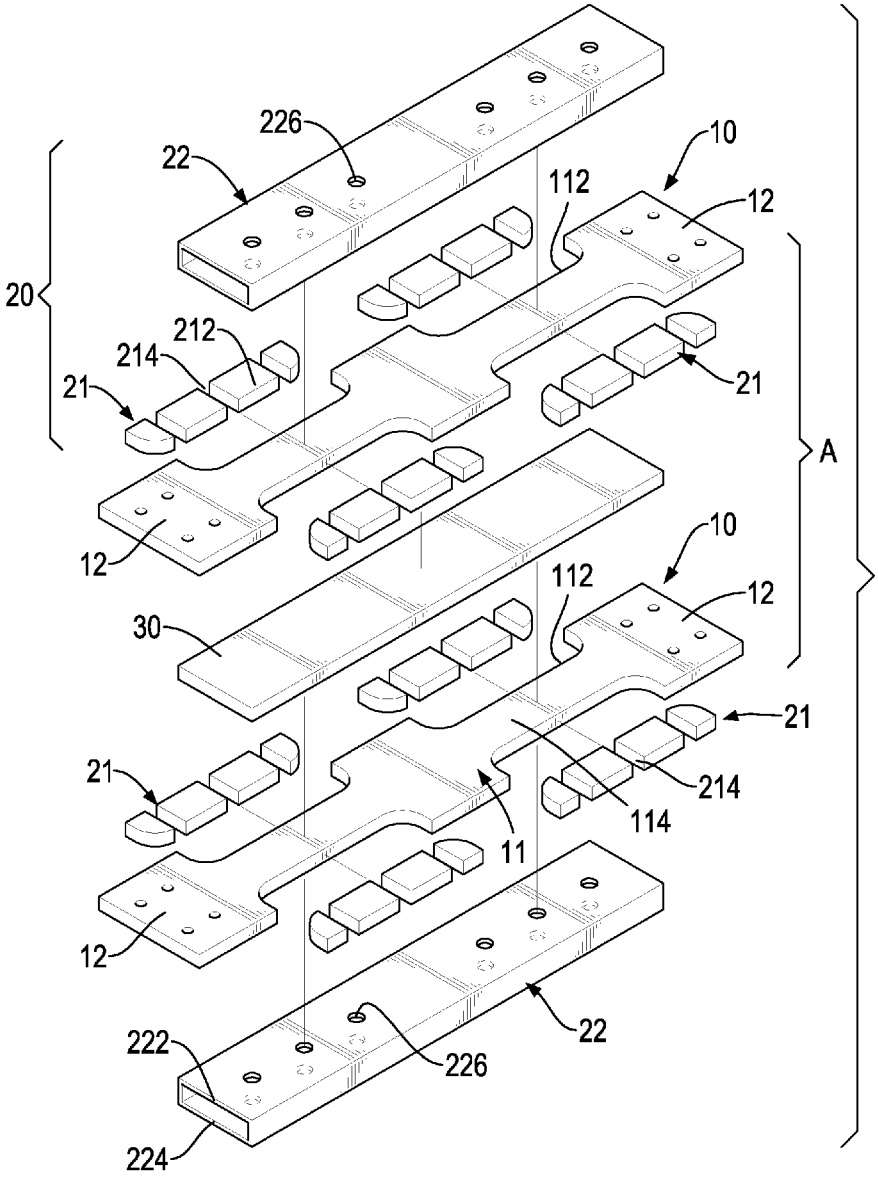
FIG. 27 is an exploded perspective view of a twenty-seventh embodiment of a bracing device in accordance with the present invention.
Figure 28:
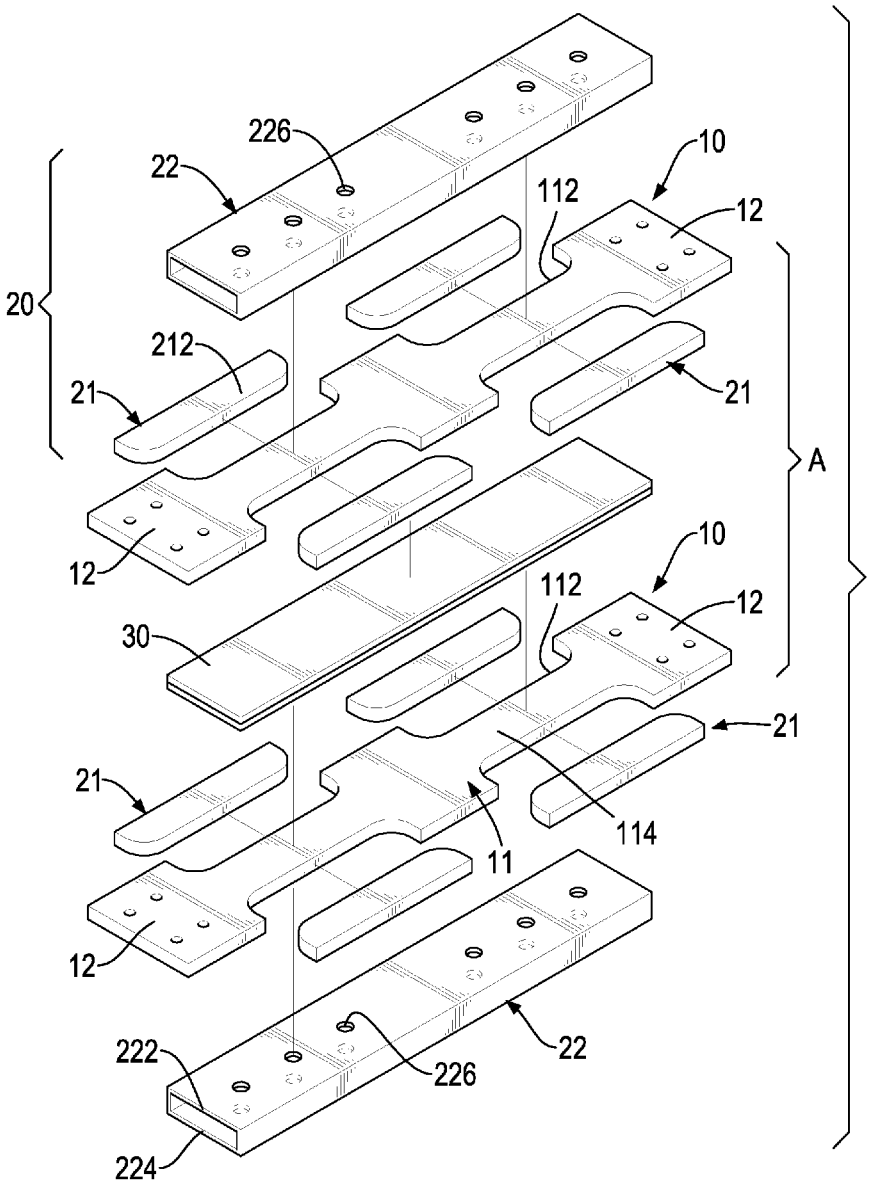
FIG. 28 is an exploded perspective view of a twenty-eighth embodiment of a bracing device in accordance with the present invention.
Figure 29:
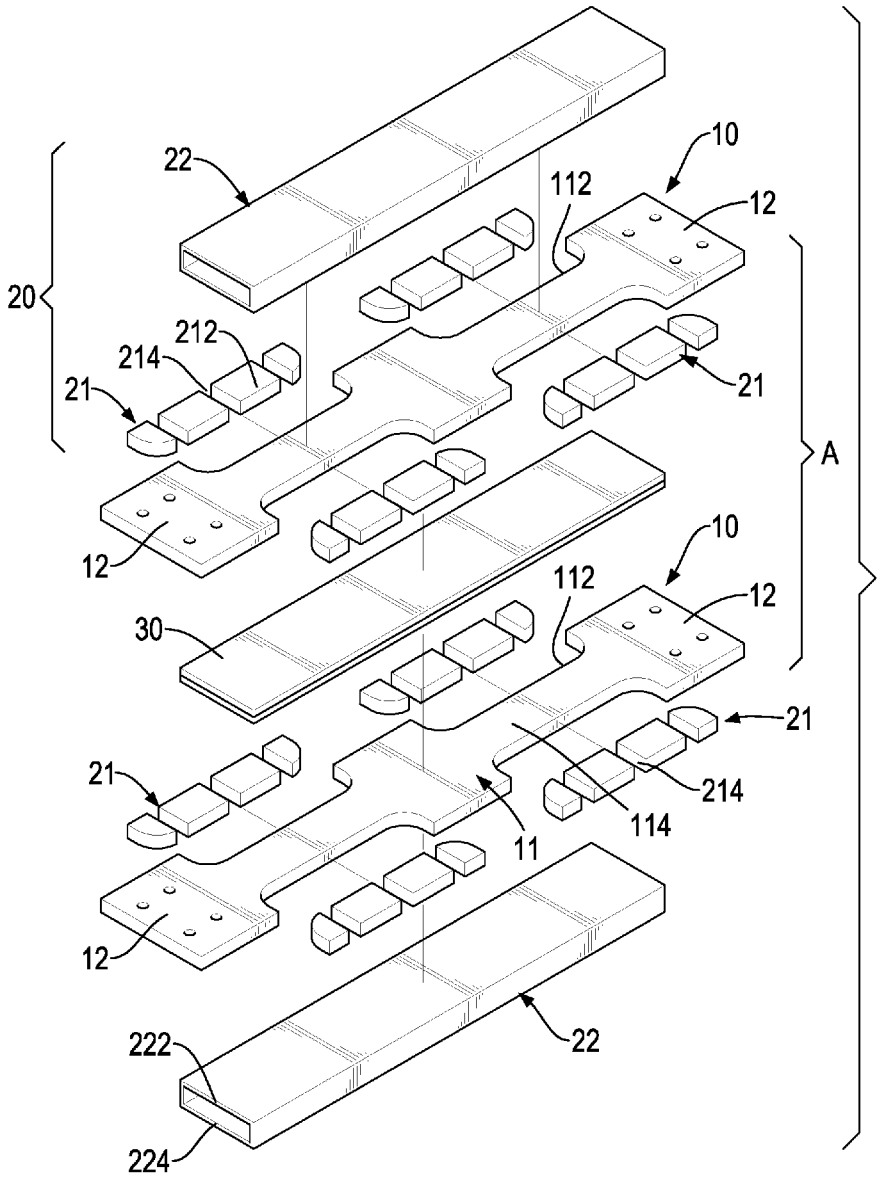
FIG. 29 is an exploded perspective view of a twenty-ninth embodiment of a bracing device in accordance with the present invention.
Figure 30:
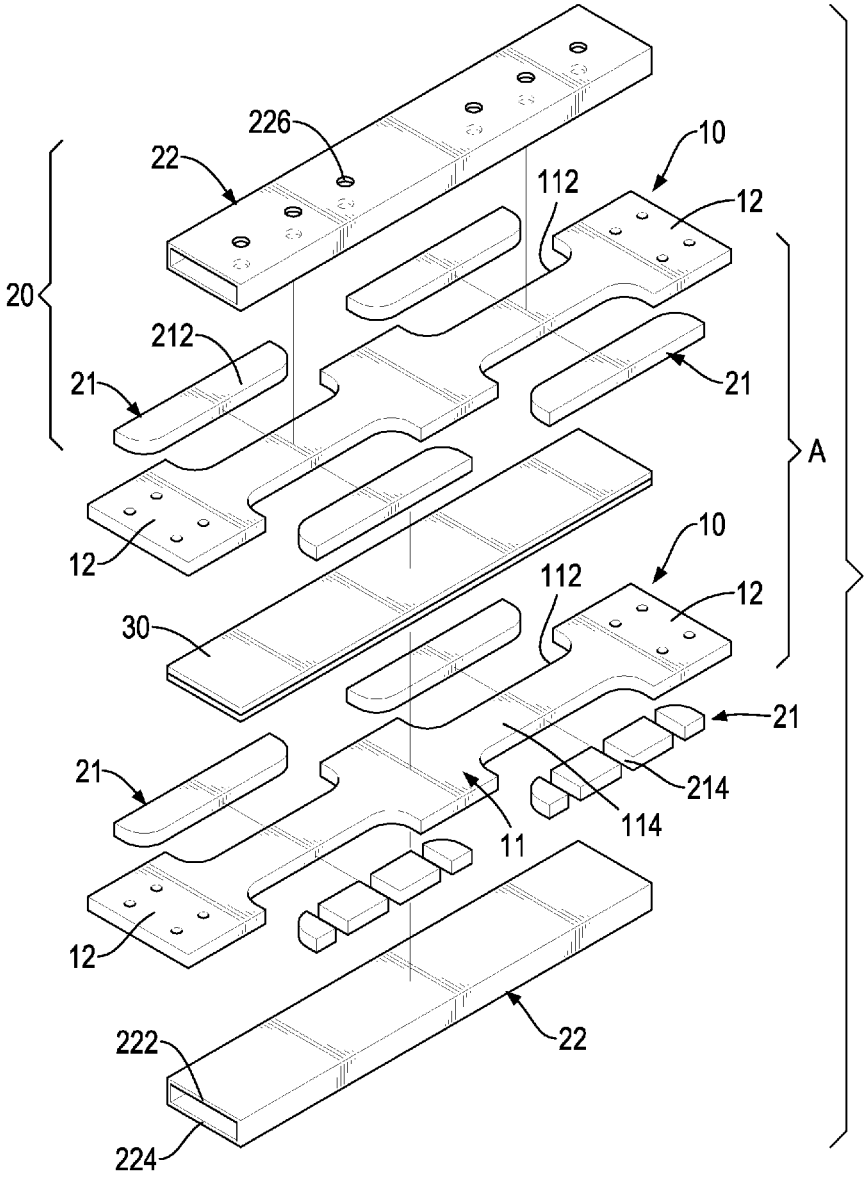
FIG. 30 is an exploded perspective view of a thirtieth embodiment of a bracing device in accordance with the present invention.
Figure 31:
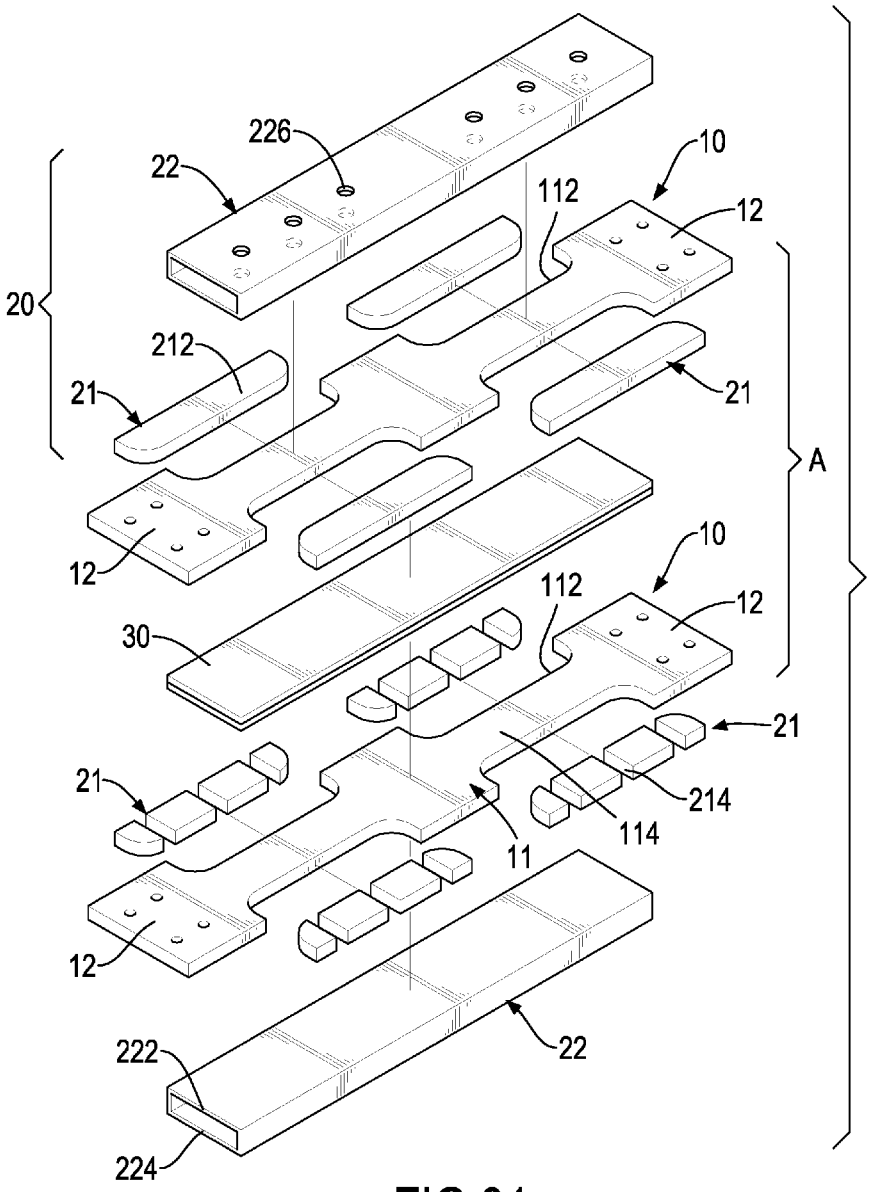
FIG. 31 is an exploded perspective view of a thirty-first embodiment of a bracing device in accordance with the present invention.
Figure 32:
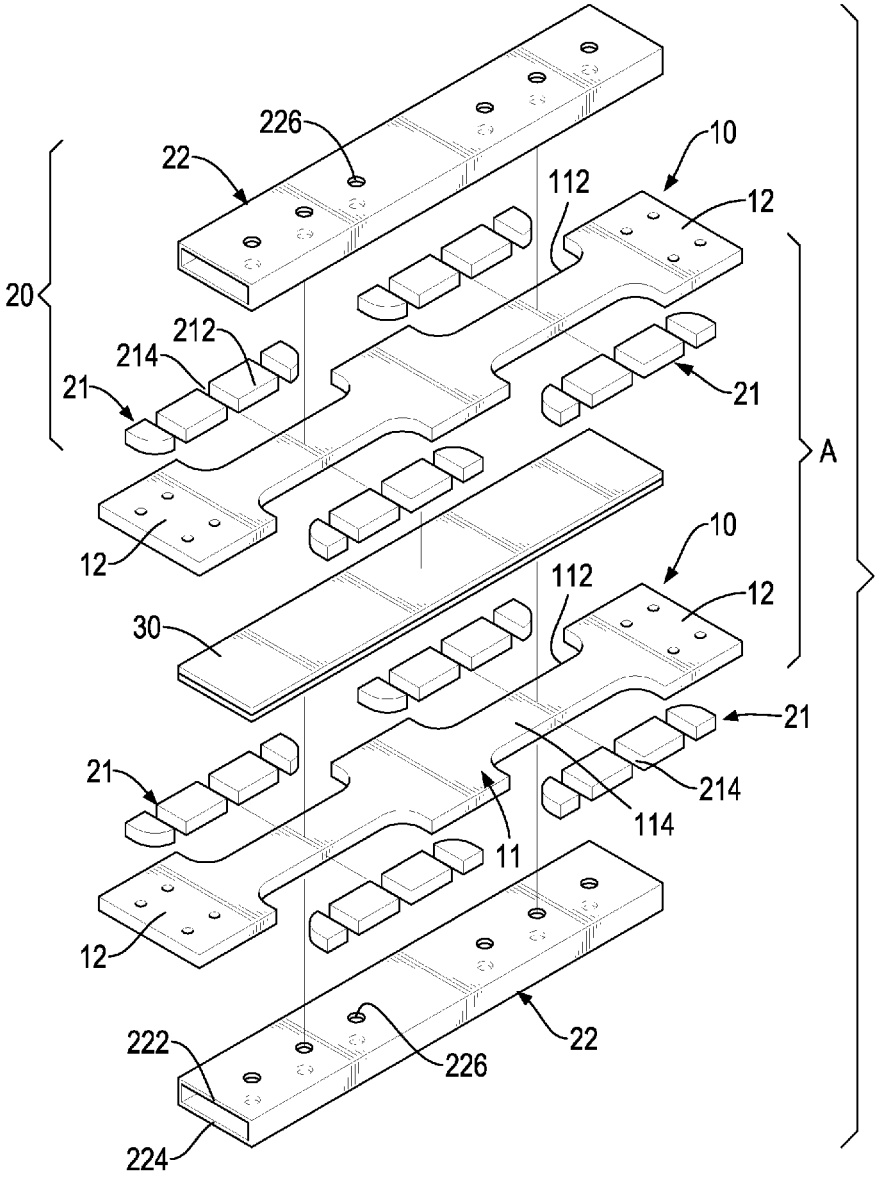
FIG. 32 is an exploded perspective view of a thirty-second embodiment of a bracing device in accordance with the present invention.
Figure 33:
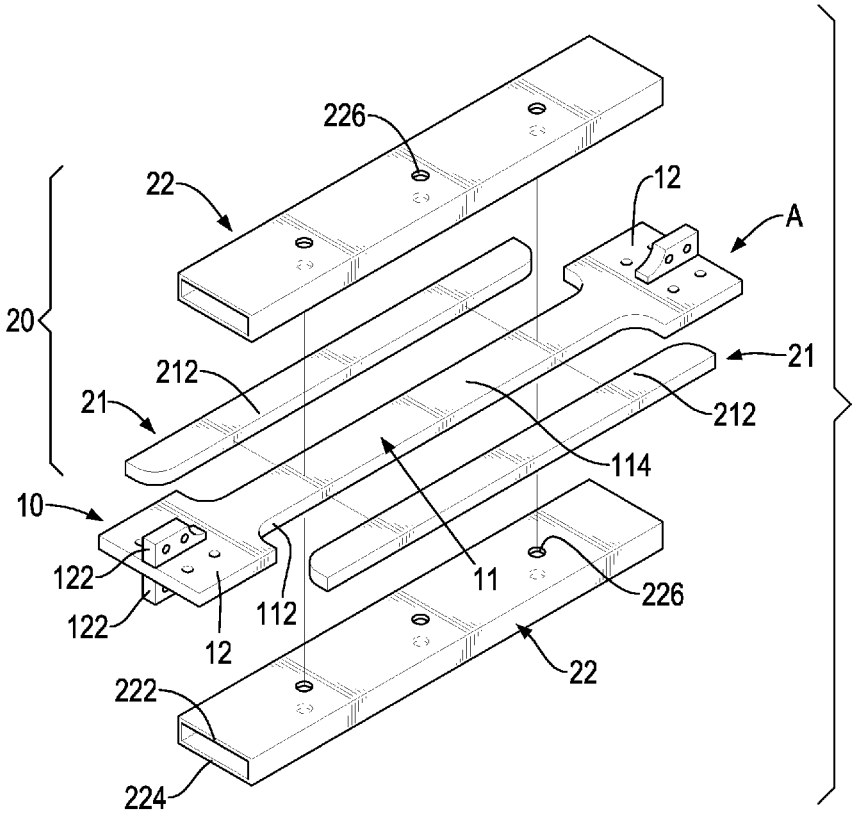
FIG. 33 is an exploded perspective view of a thirty-third embodiment of a bracing device in accordance with the present invention.
Figure 34:
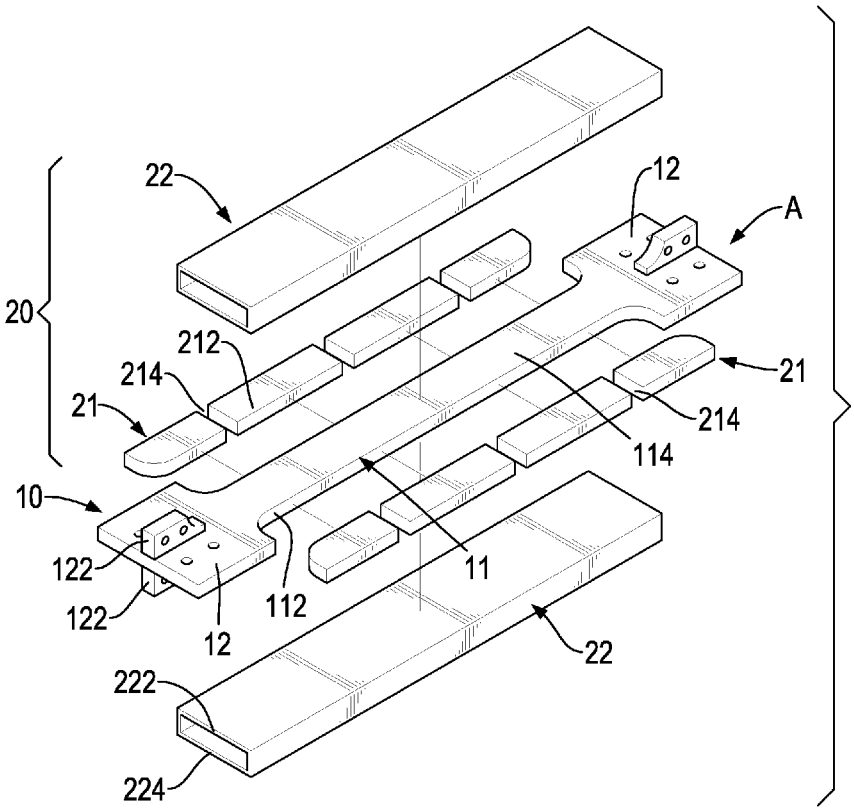
FIG. 34 is an exploded perspective view of a thirty-fourth embodiment of a bracing device in accordance with the present invention.
Figure 35:
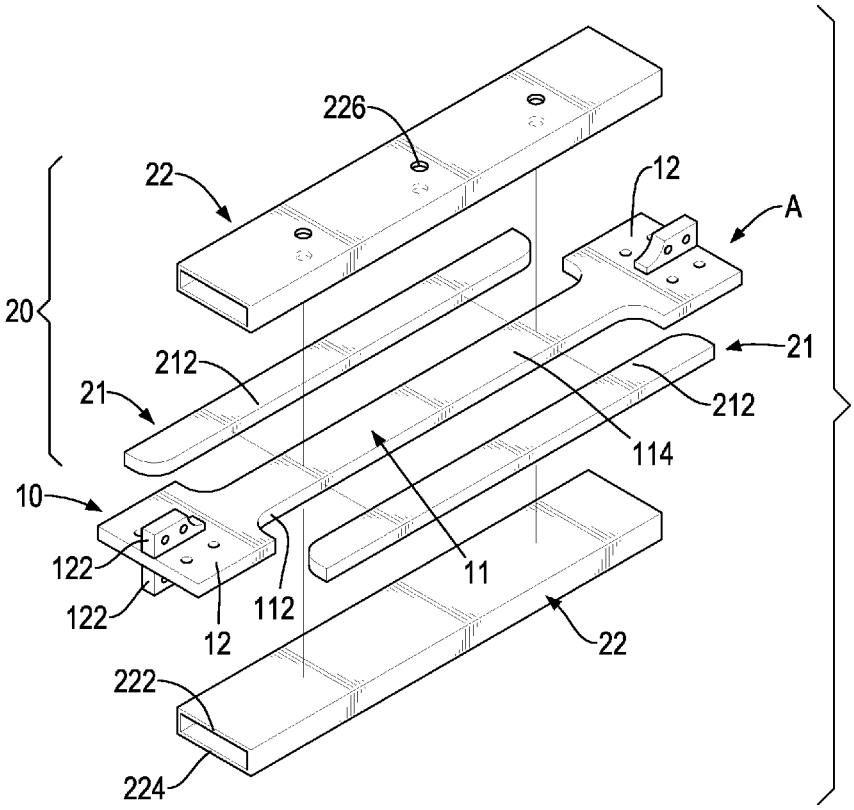
FIG. 35 is an exploded perspective view of a thirty-fifth embodiment of a bracing device in accordance with the present invention.
Figure 36:
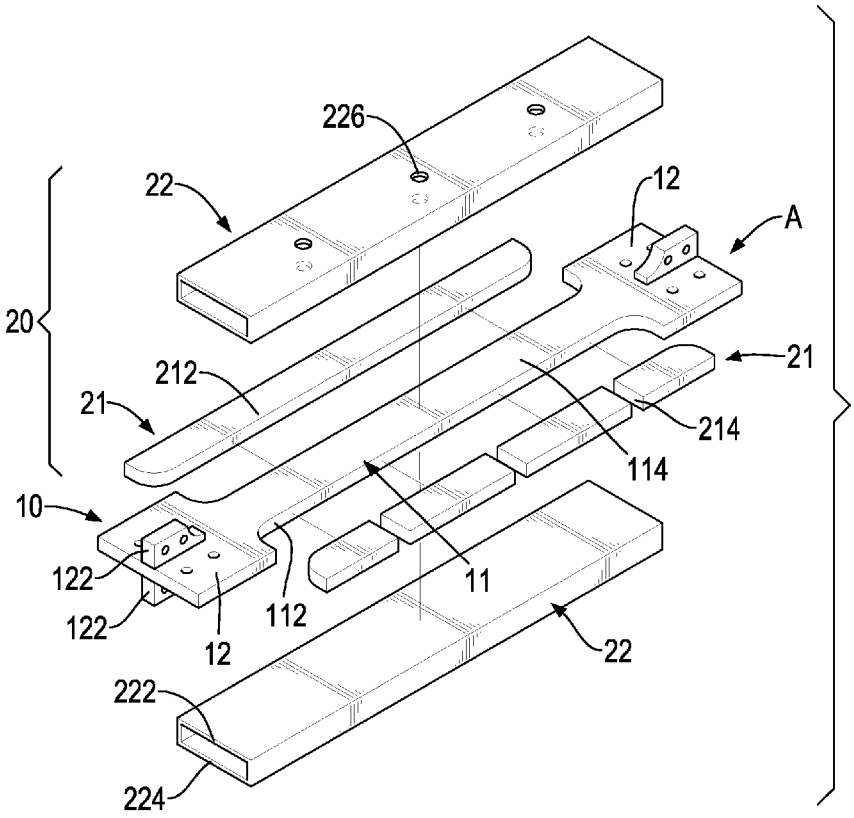
FIG. 36 is an exploded perspective view of a thirty-sixth embodiment of a bracing device in accordance with the present invention.
Figure 37:
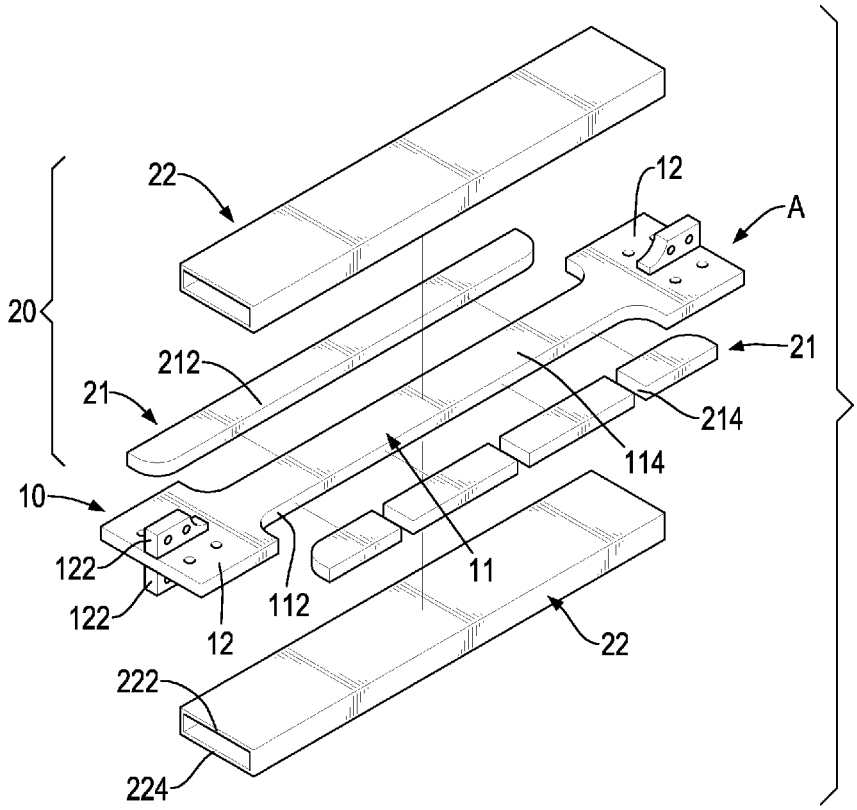
FIG. 37 is an exploded perspective view of a thirty-seventh embodiment of a bracing device in accordance with the present invention.
Figure 38:
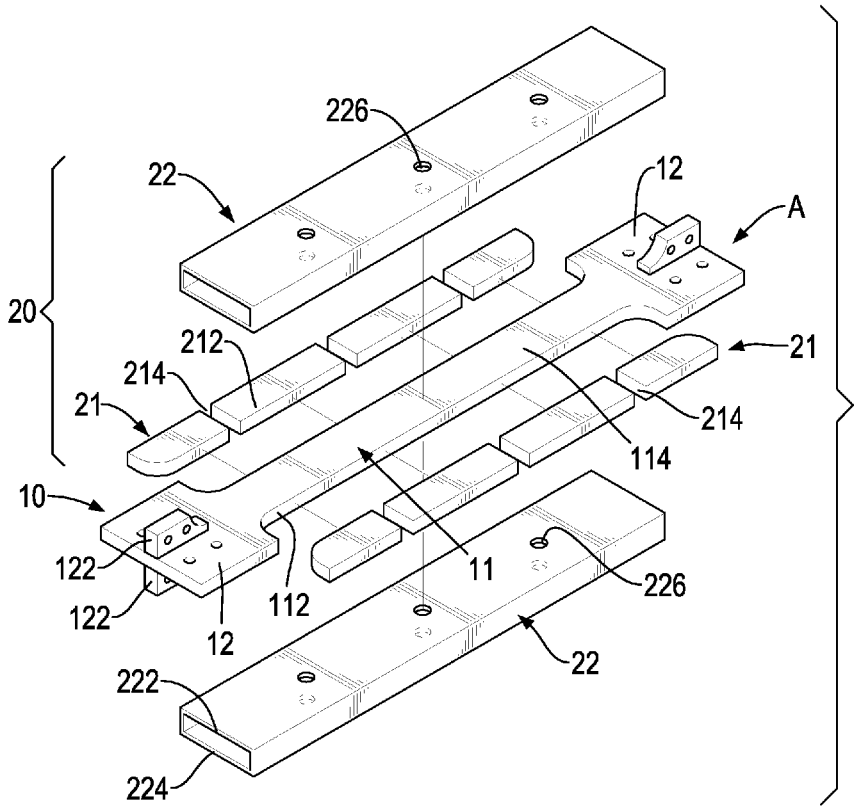
FIG. 38 is an exploded perspective view of a thirty-eighth embodiment of a bracing device in accordance with the present invention.
Figure 39:
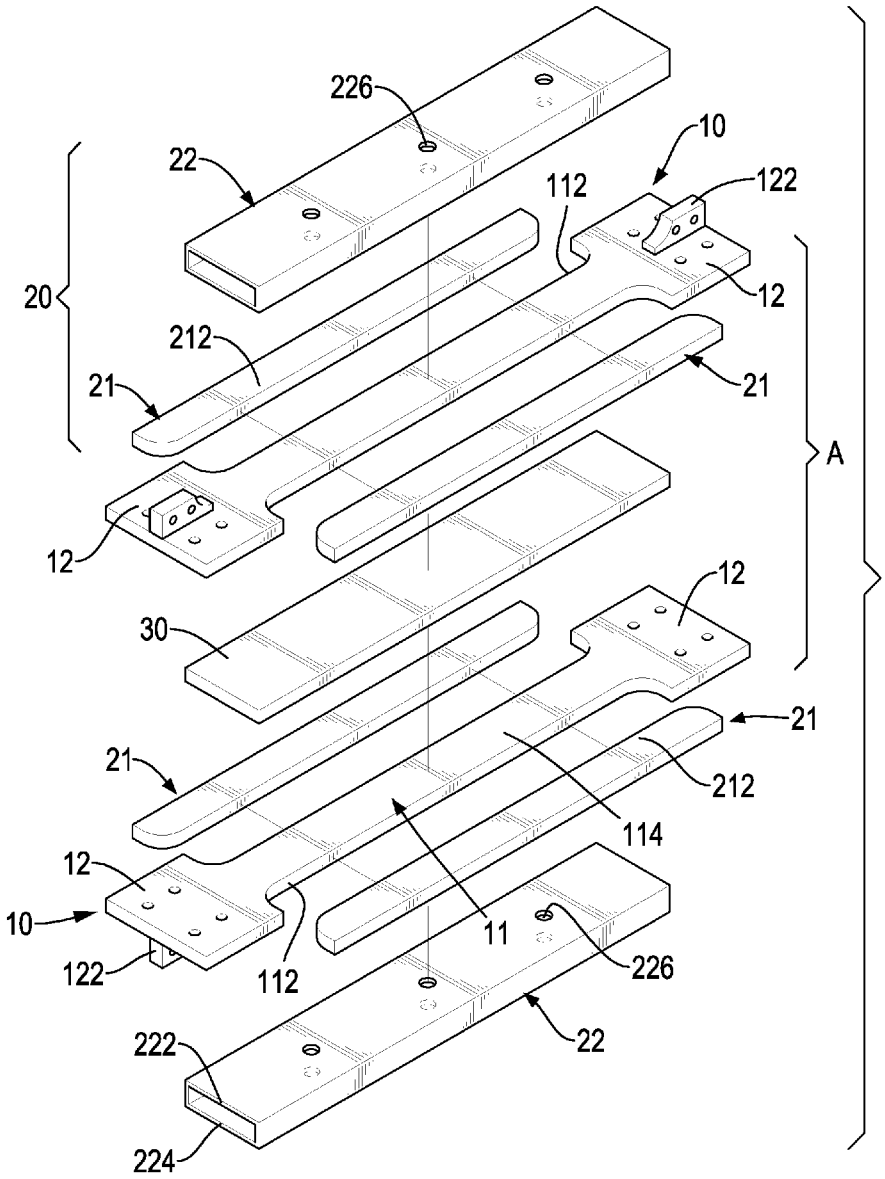
FIG. 39 is an exploded perspective view of a thirty-ninth embodiment of a bracing device in accordance with the present invention.
Figure 40:
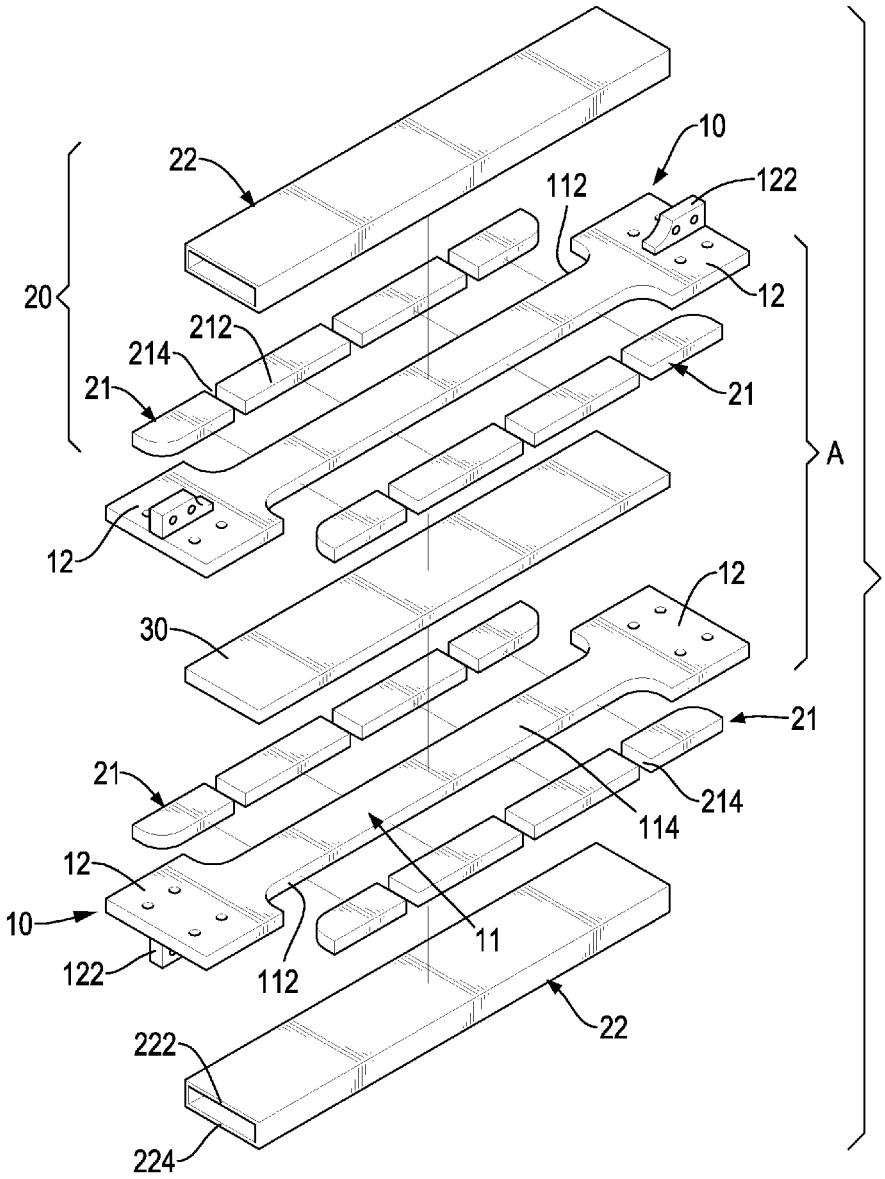
FIG. 40 is an exploded perspective view of a fortieth embodiment of a bracing device in accordance with the present invention.
Figure 41:
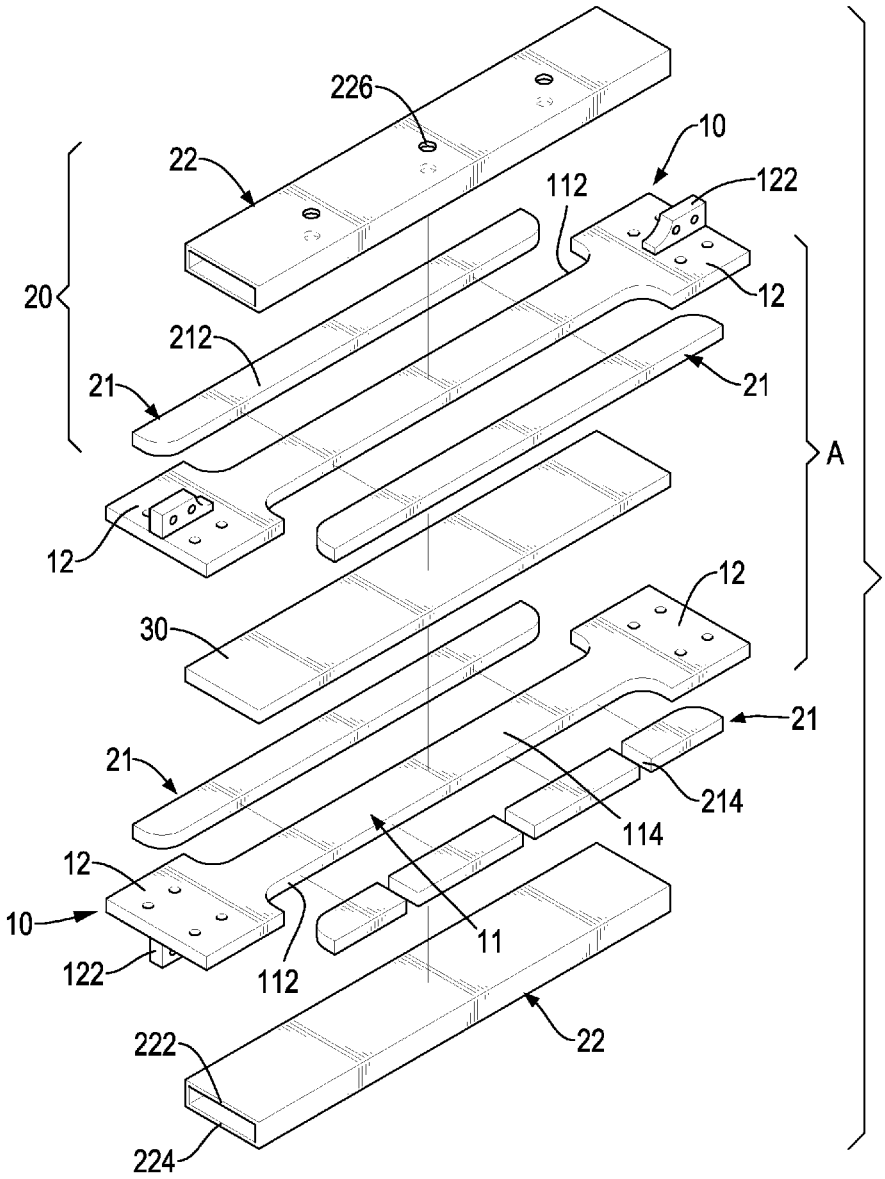
FIG. 41 is an exploded perspective view of a forty-first embodiment of a bracing device in accordance with the present invention.
Figure 42:
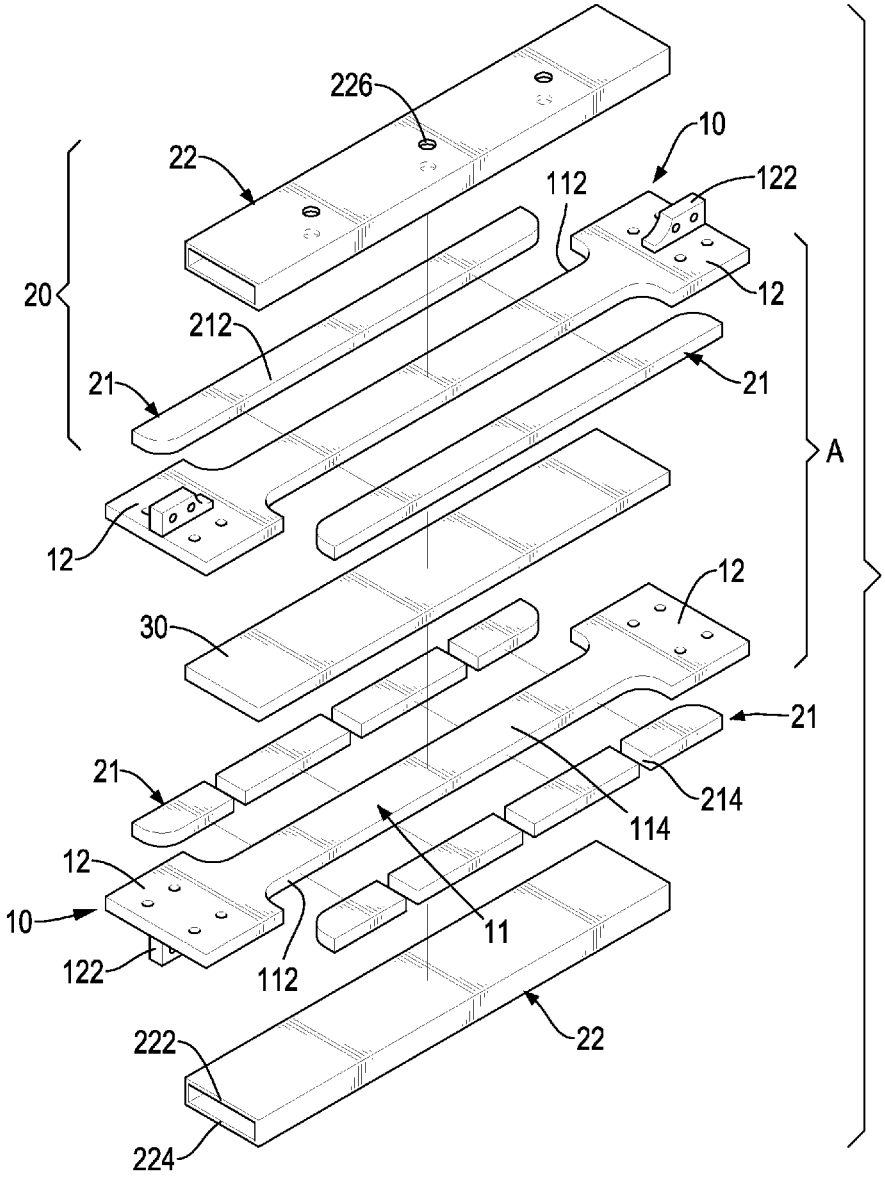
FIG. 42 is an exploded perspective view of a forty-second embodiment of a bracing device in accordance with the present invention.
Figure 43:
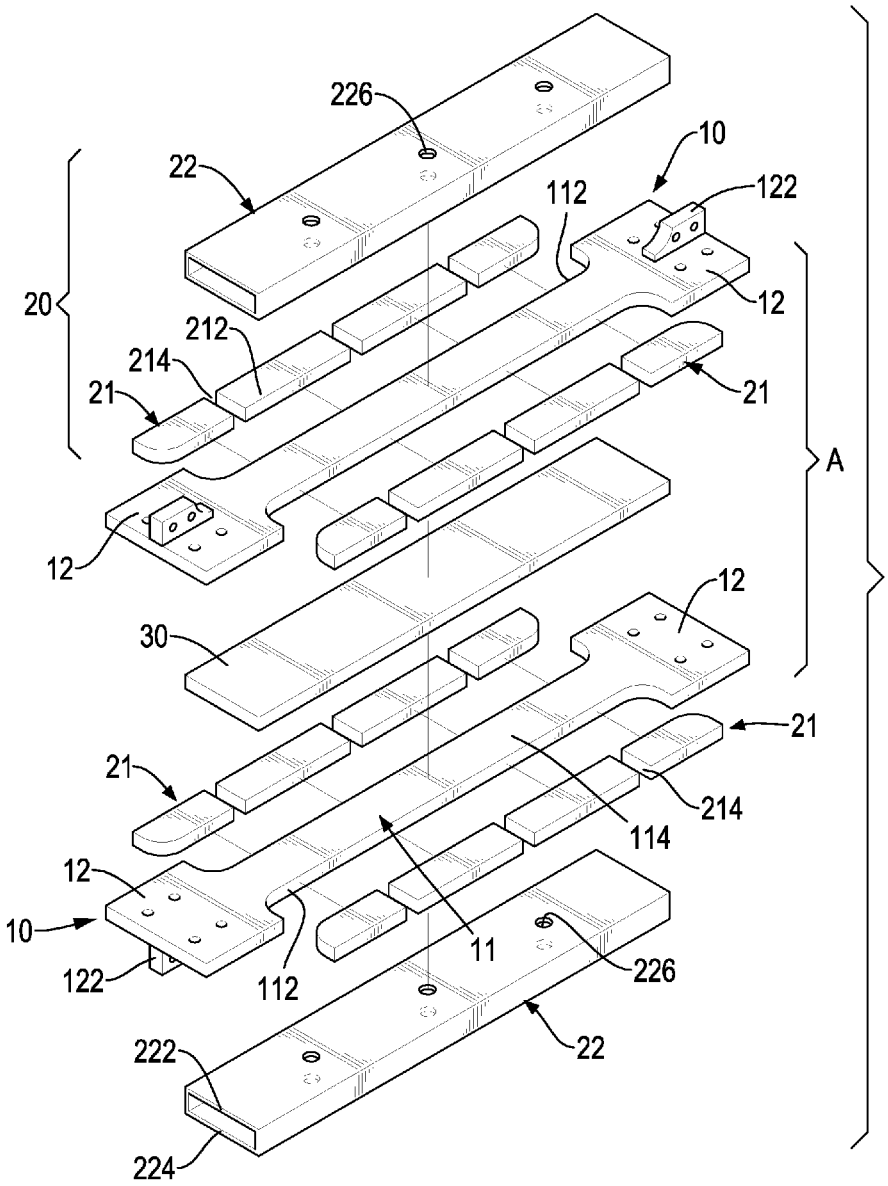
FIG. 43 is an exploded perspective view of a forty-third embodiment of a bracing device in accordance with the present invention.
Figure 44:
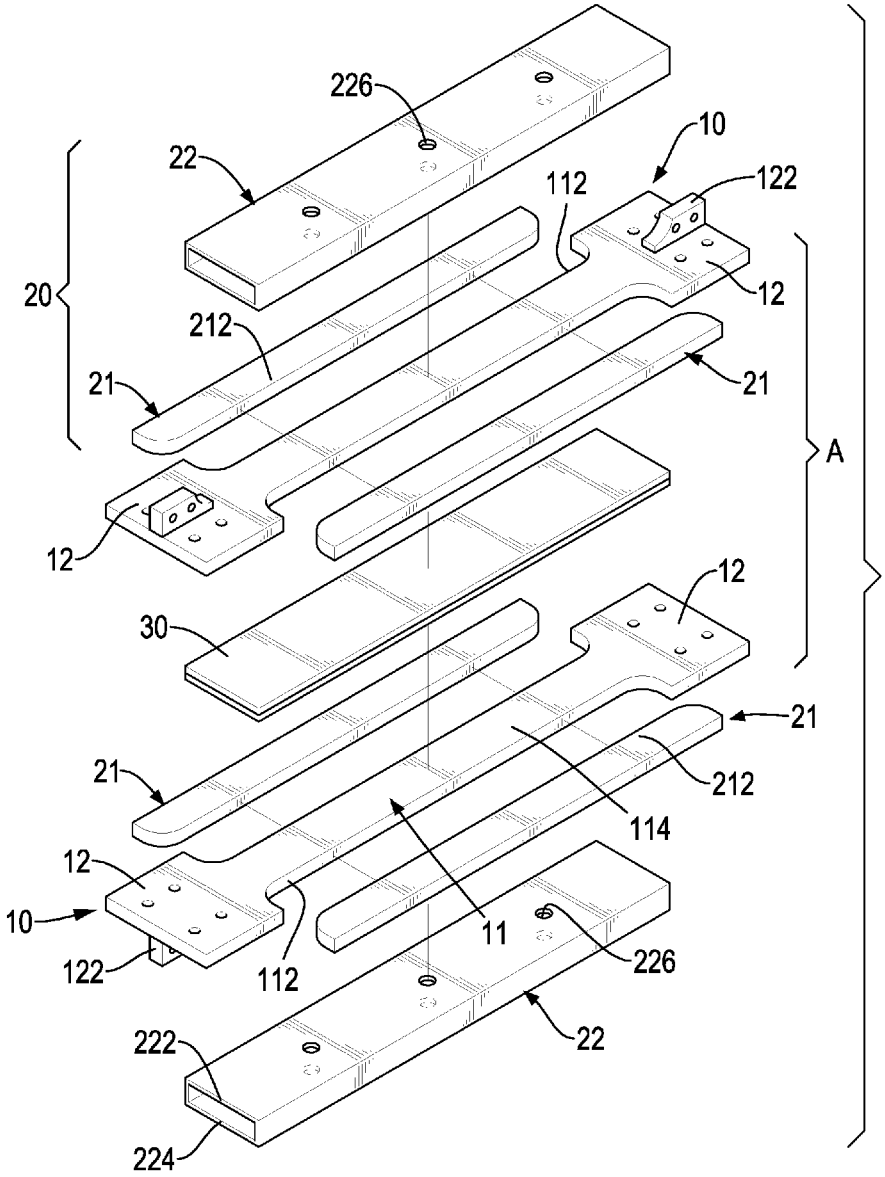
FIG. 44 is an exploded perspective view of a forty-fourth embodiment of a bracing device in accordance with the present invention.
Figure 45:
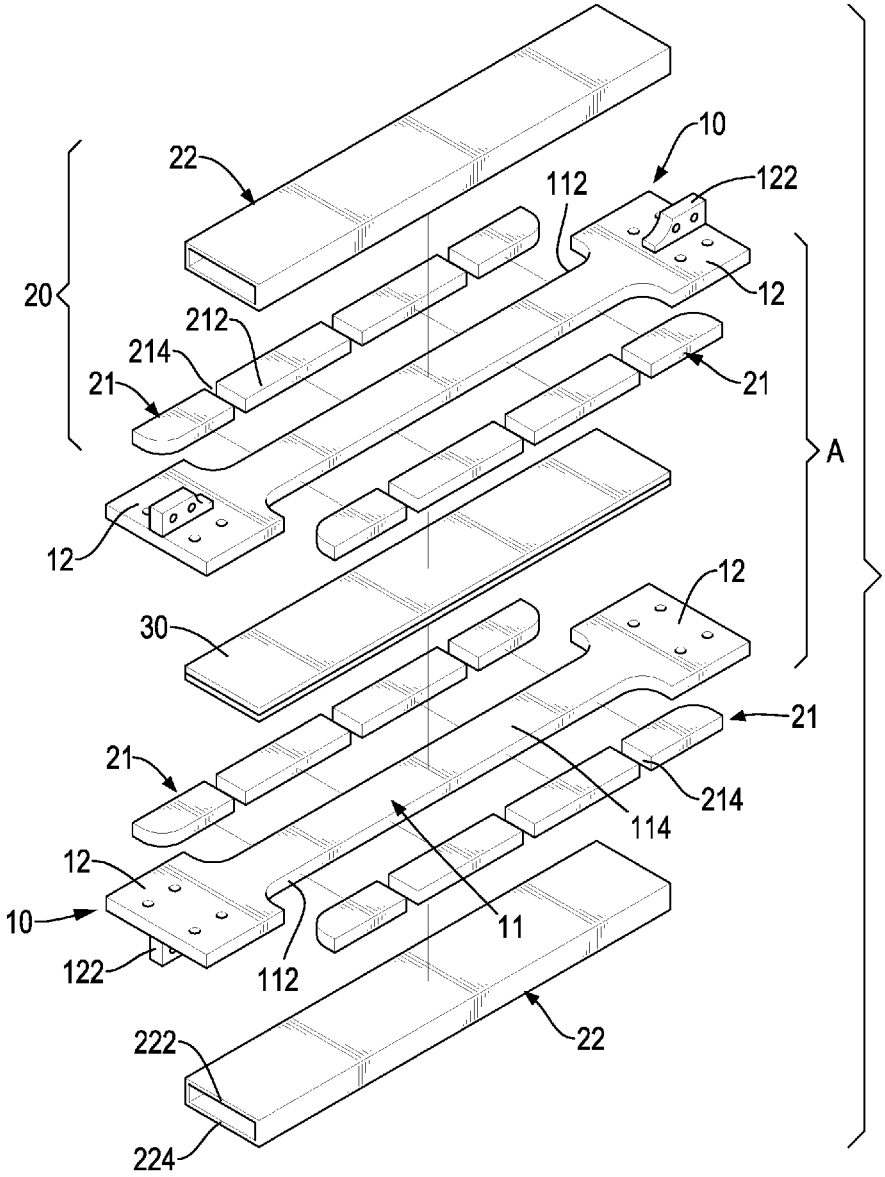
FIG. 45 is an exploded perspective view of a forty-fifth embodiment of a bracing device in accordance with the present invention.
Figure 46:
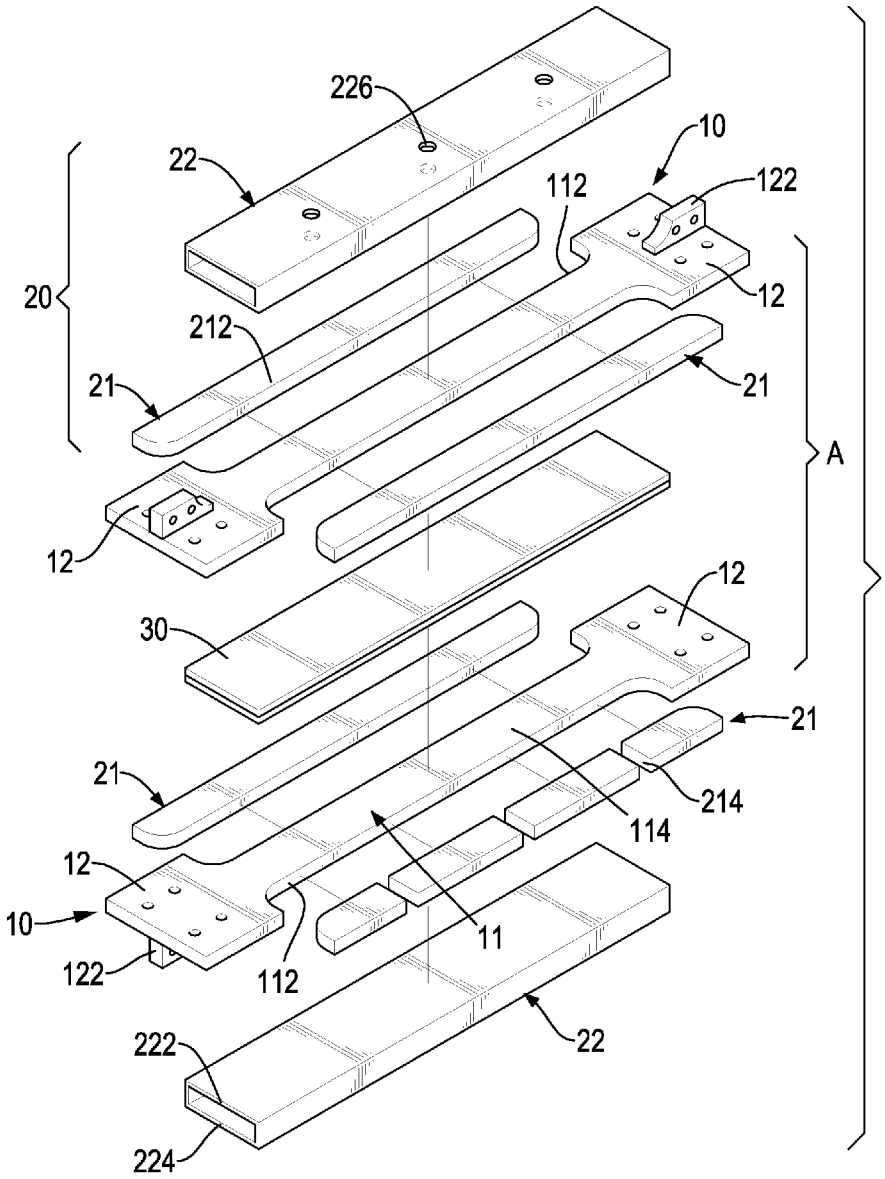
FIG. 46 is an exploded perspective view of a forty-sixth embodiment of a bracing device in accordance with the present invention.
Figure 47:
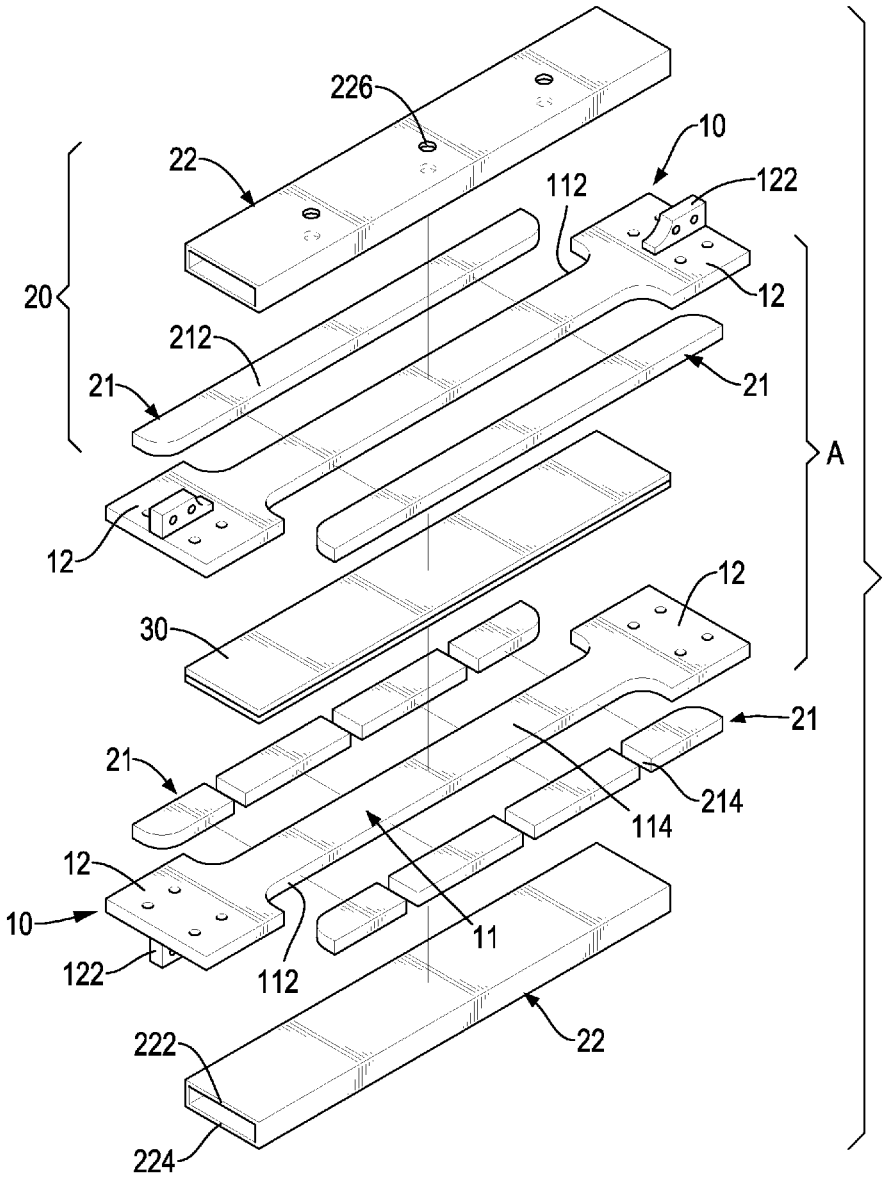
FIG. 47 is an exploded perspective view of a forty-seventh embodiment of a bracing device in accordance with the present invention.
Figure 48:
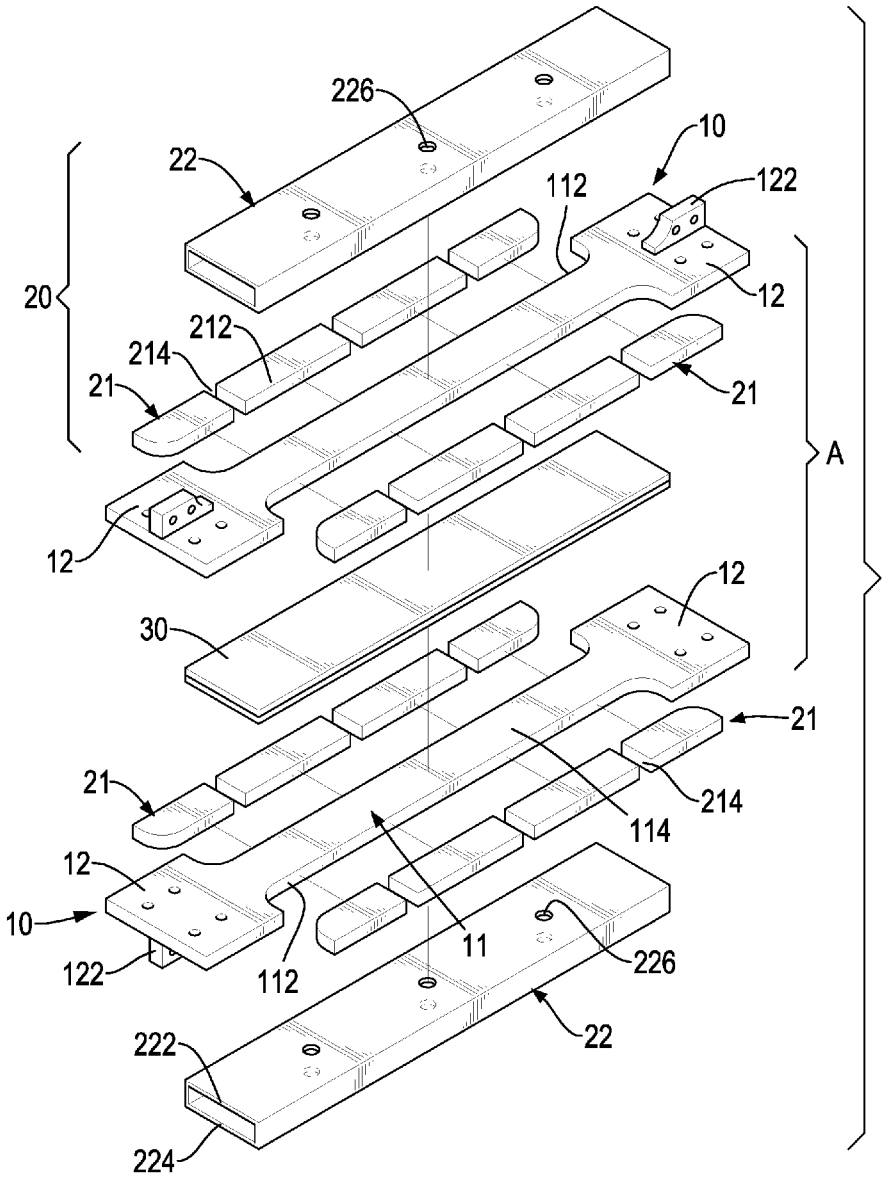
FIG. 48 is an exploded perspective view of a forty-eighth embodiment of a bracing device in accordance with the present invention.
Figure 49:
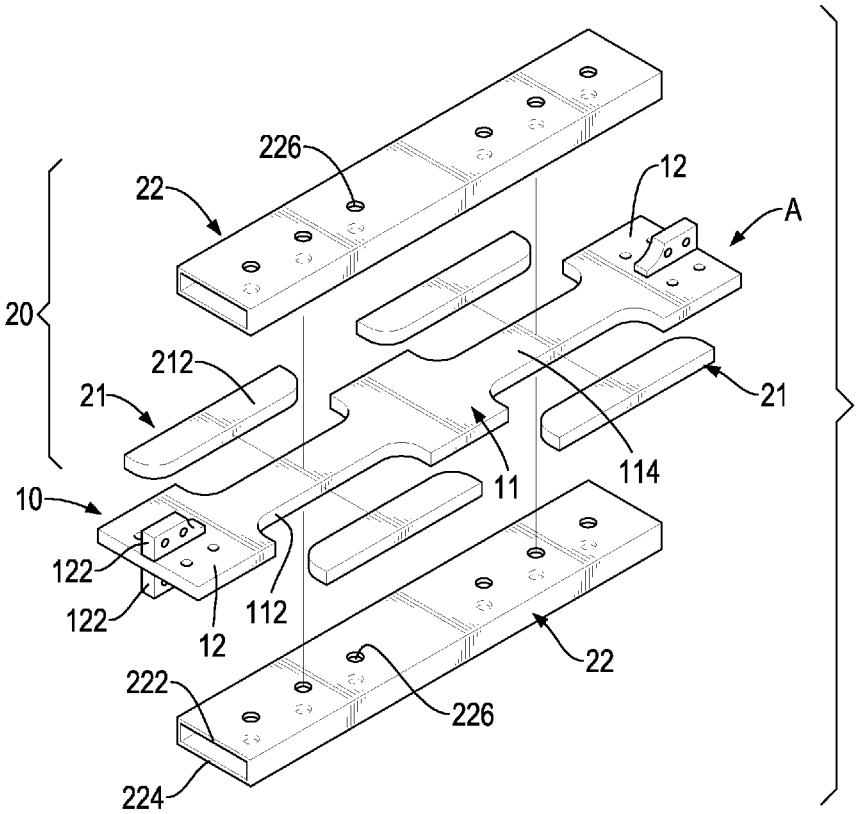
FIG. 49 is an exploded perspective view of a forty-ninth embodiment of a bracing device in accordance with the present invention.
Figure 50:
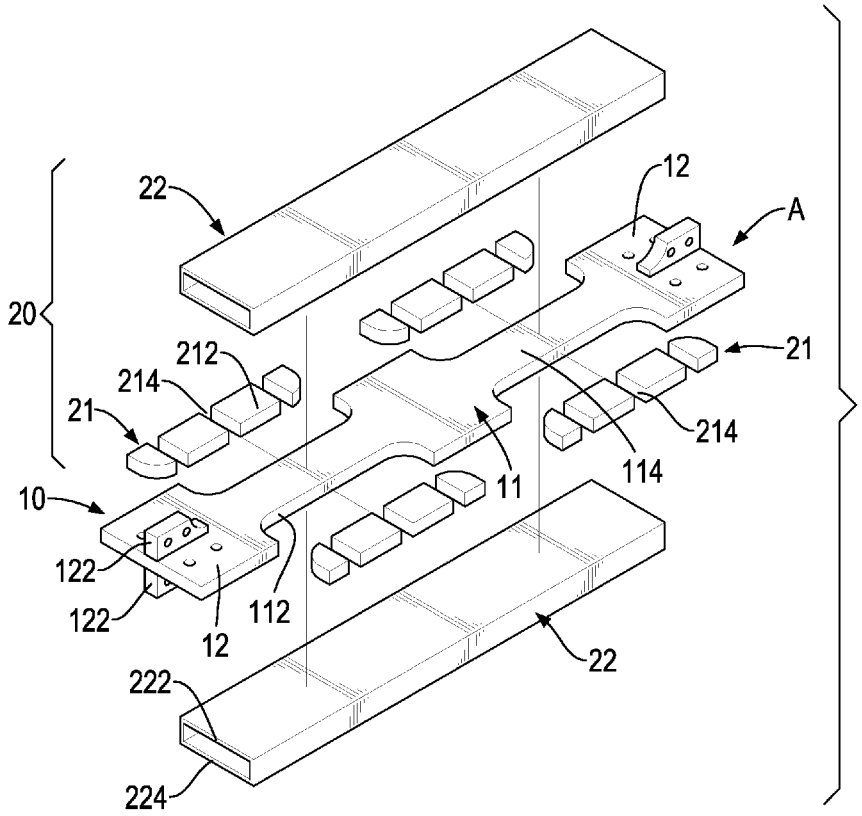
FIG. 50 is an exploded perspective view of a fiftieth embodiment of a bracing device in accordance with the present invention.
Figure 51:
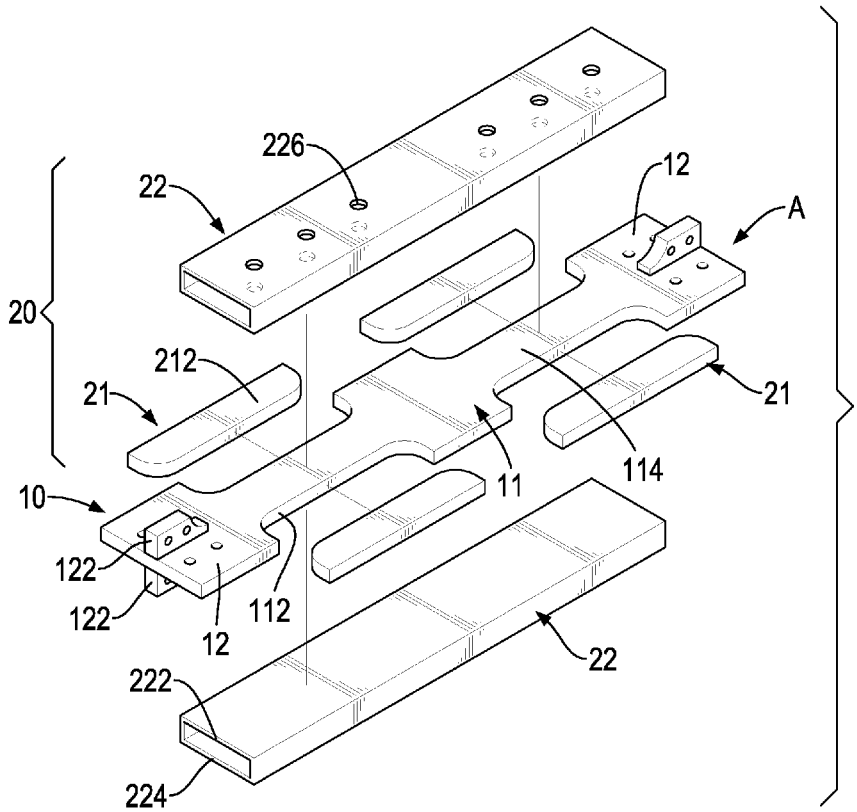
FIG. 51 is an exploded perspective view of a fifty-first embodiment of a bracing device in accordance with the present invention.
Figure 52:
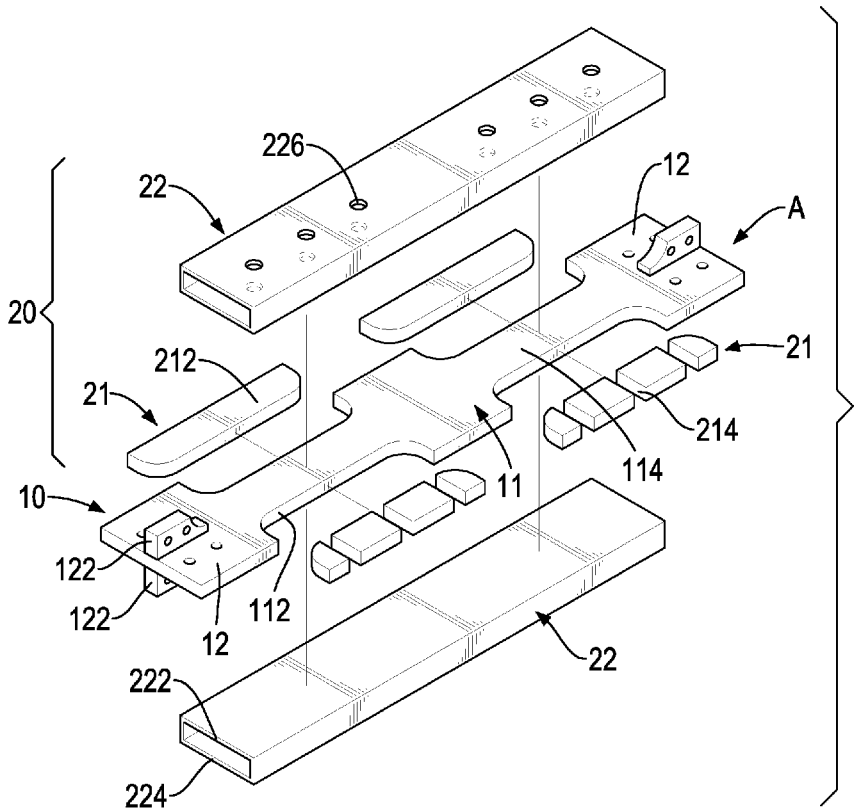
FIG. 52 is an exploded perspective view of a fifty-second embodiment of a bracing device in accordance with the present invention.
Figure 53:
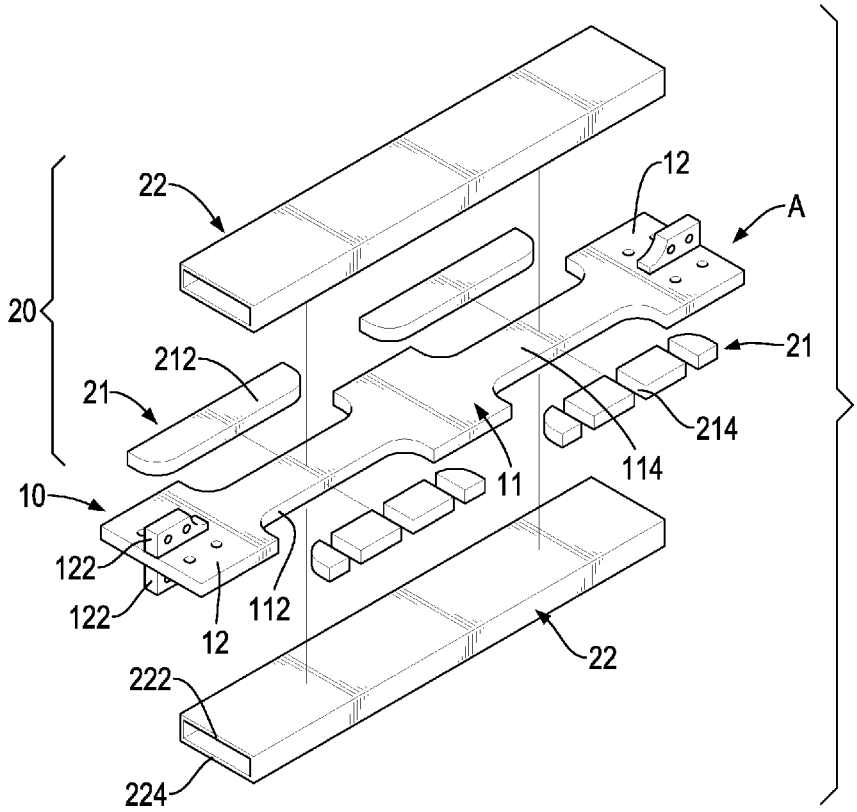
FIG. 53 is an exploded perspective view of a fifty-third embodiment of a bracing device in accordance with the present invention.
Figure 54:
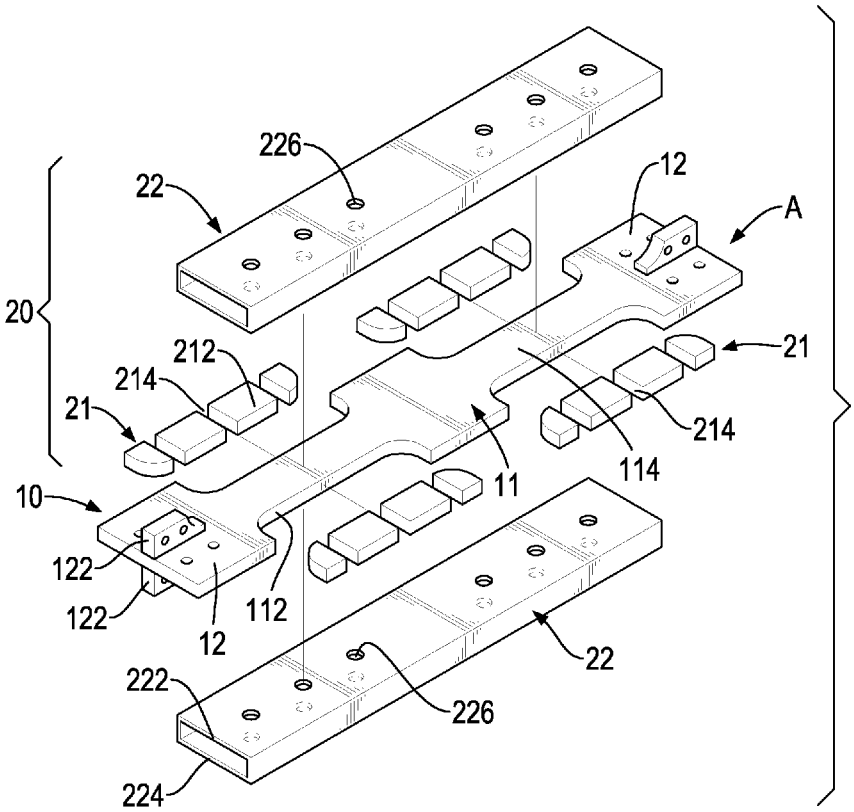
FIG. 54 is an exploded perspective view of a fifty-fourth embodiment of a bracing device in accordance with the present invention.
Figure 55:
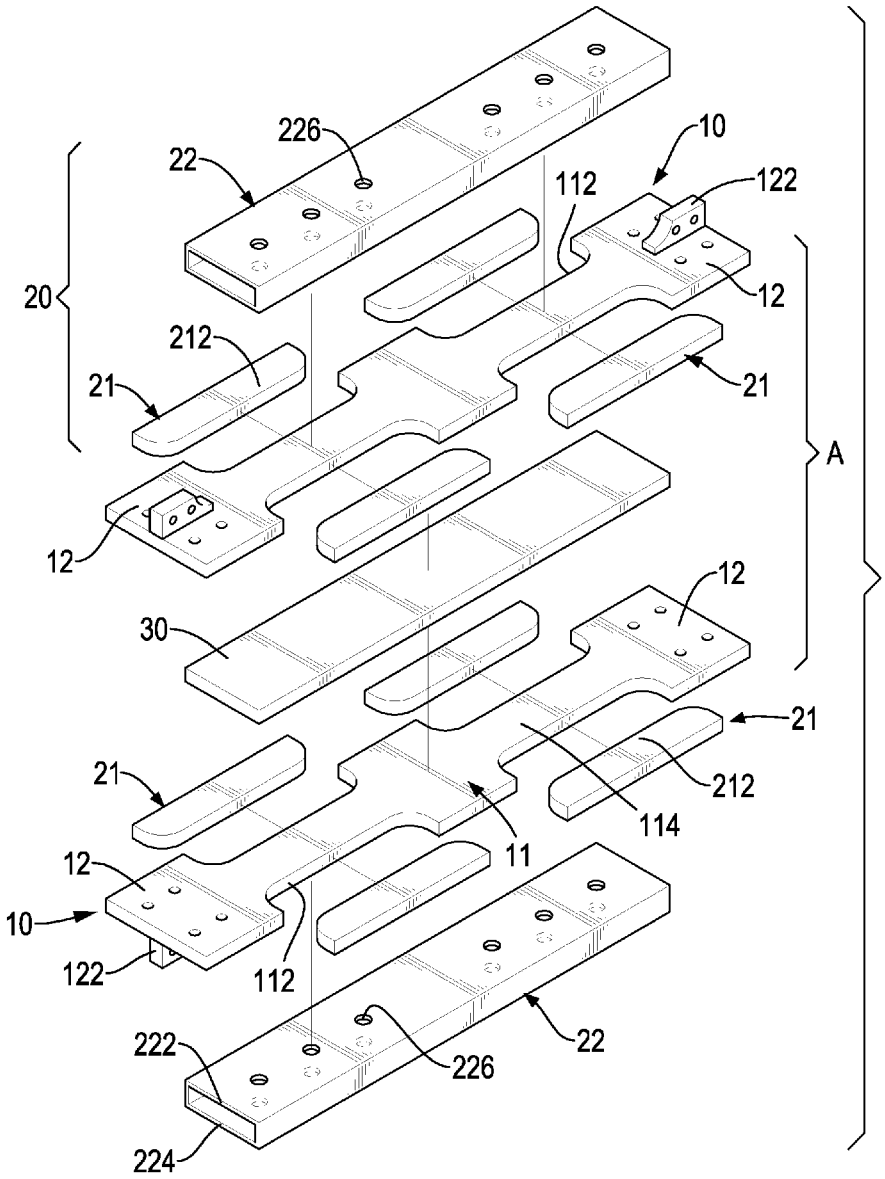
FIG. 55 is an exploded perspective view of a fifty-fifth embodiment of a bracing device in accordance with the present invention.
Figure 56:
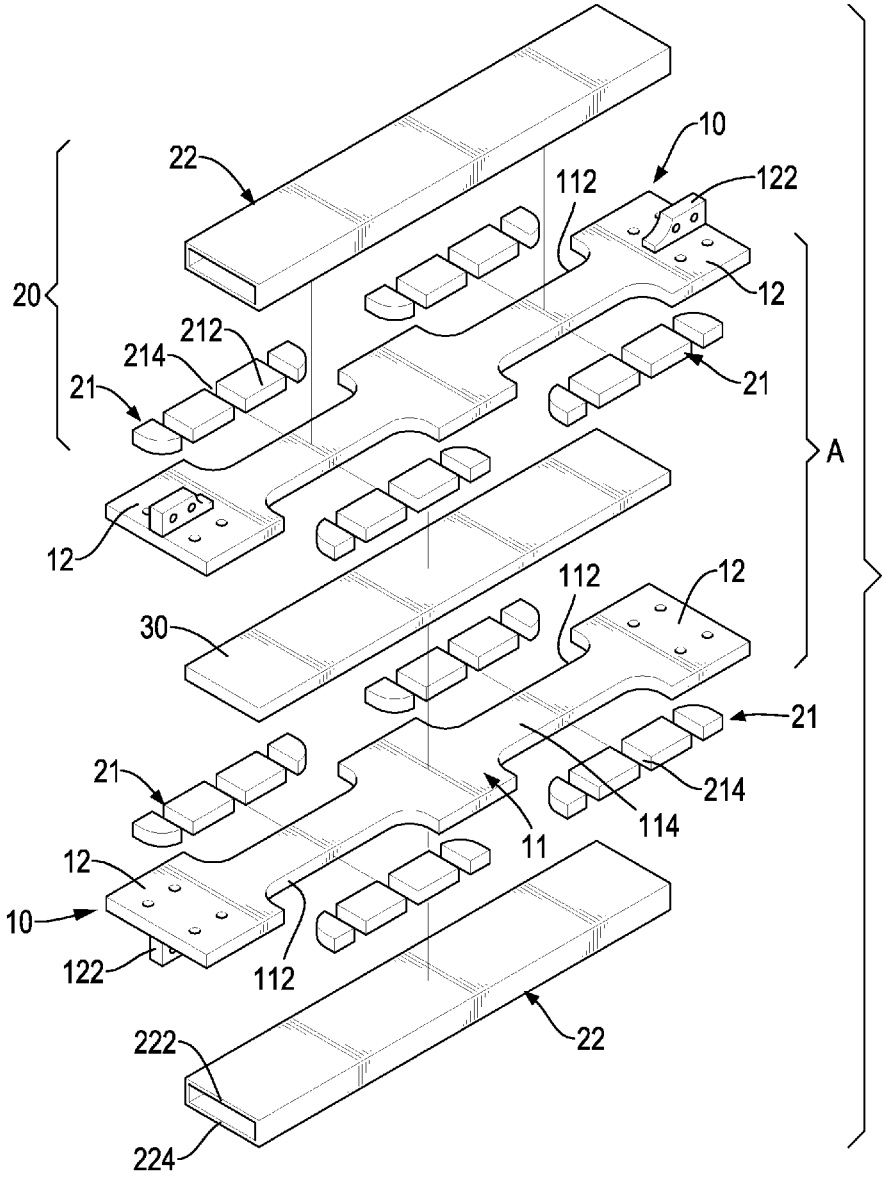
FIG. 56 is an exploded perspective view of a fifty-sixth embodiment of a bracing device in accordance with the present invention.
Figure 57:
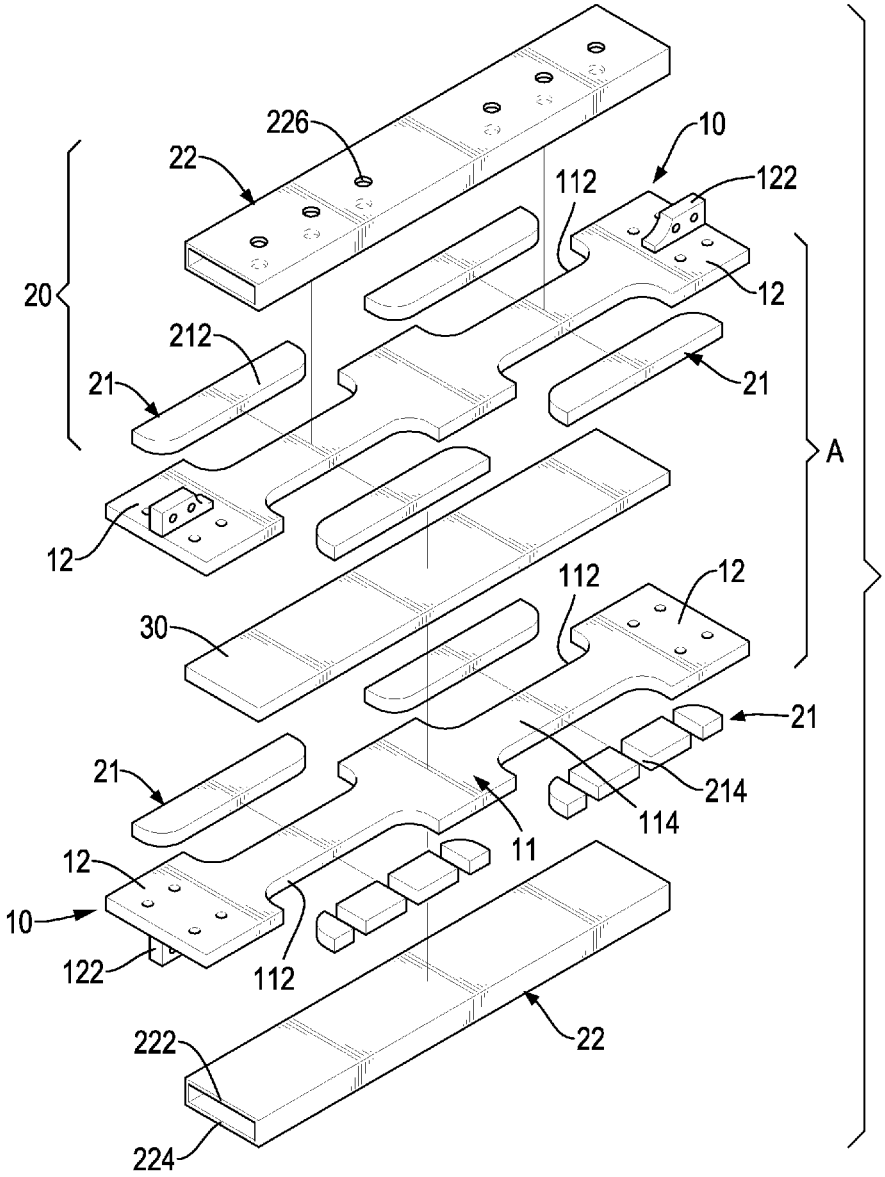
FIG. 57 is an exploded perspective view of a fifty-seventh embodiment of a bracing device in accordance with the present invention.
Figure 58:
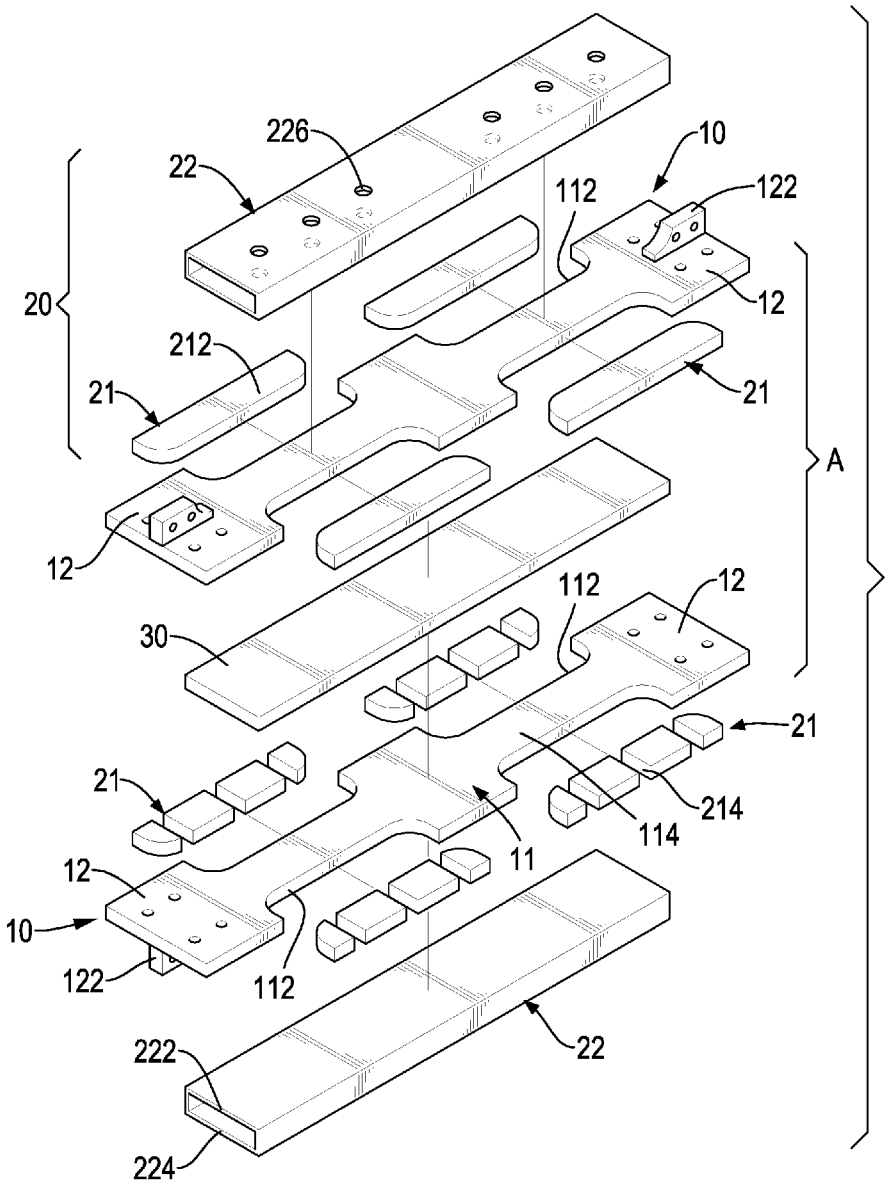
FIG. 58 is an exploded perspective view of a fifty-eighth embodiment of a bracing device in accordance with the present invention.
Figure 59:
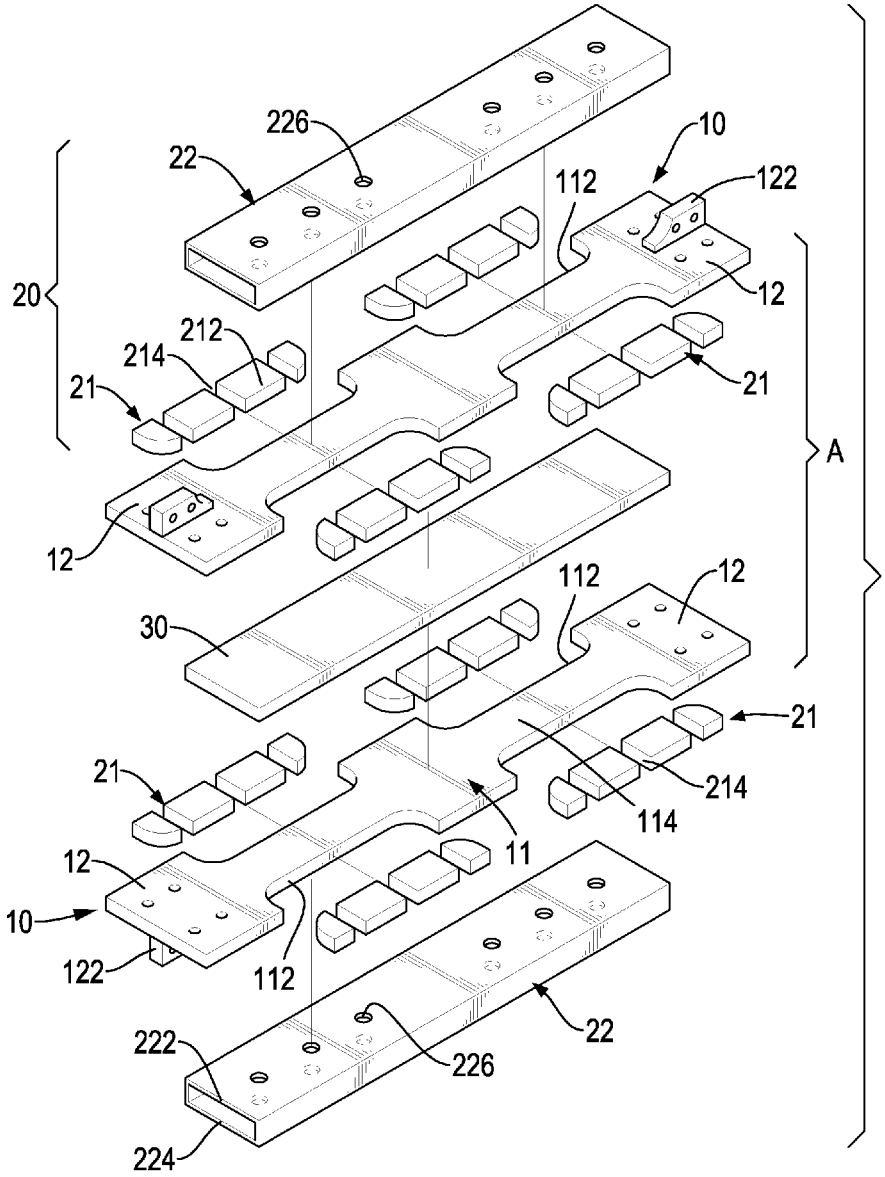
FIG. 59 is an exploded perspective view of a fifty-ninth embodiment of a bracing device in accordance with the present invention.
Figure 60:
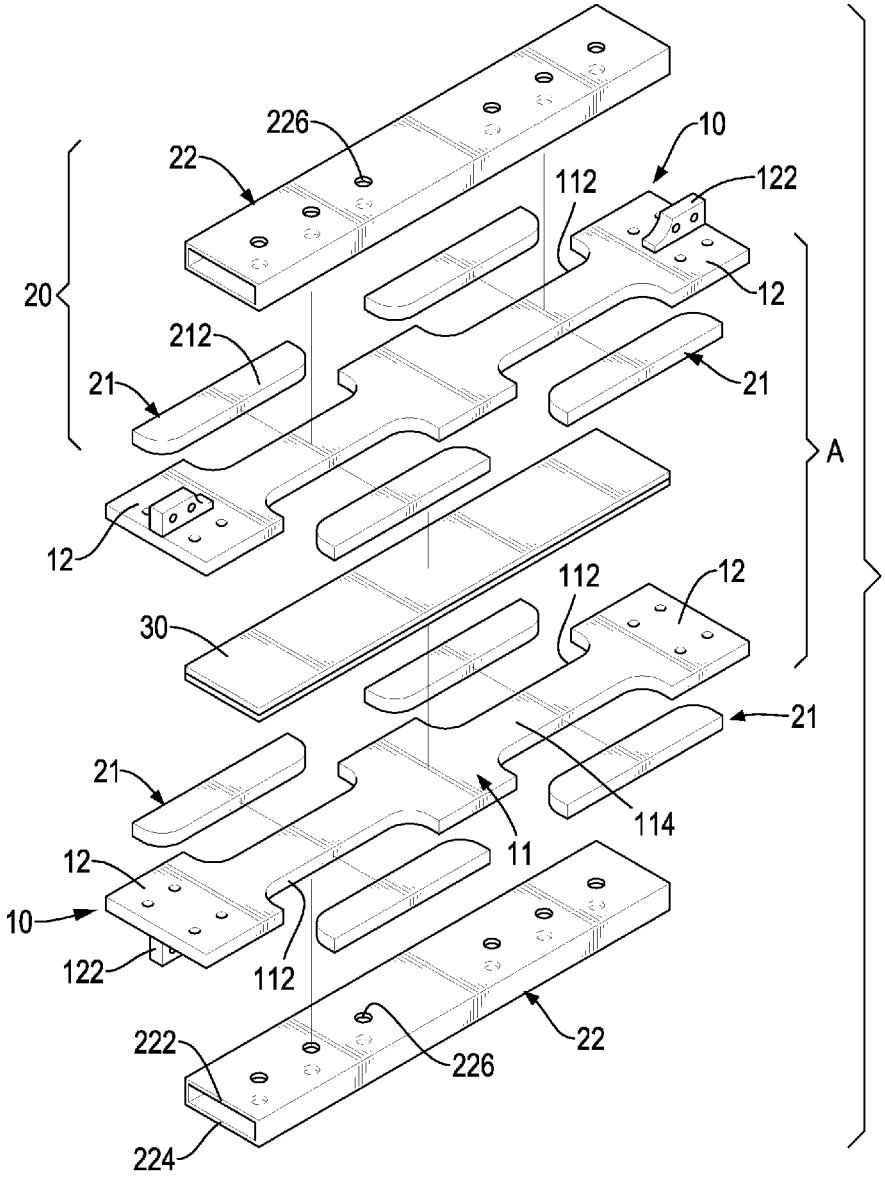
FIG. 60 is an exploded perspective view of a sixtieth embodiment of a bracing device in accordance with the present invention.
Figure 61:
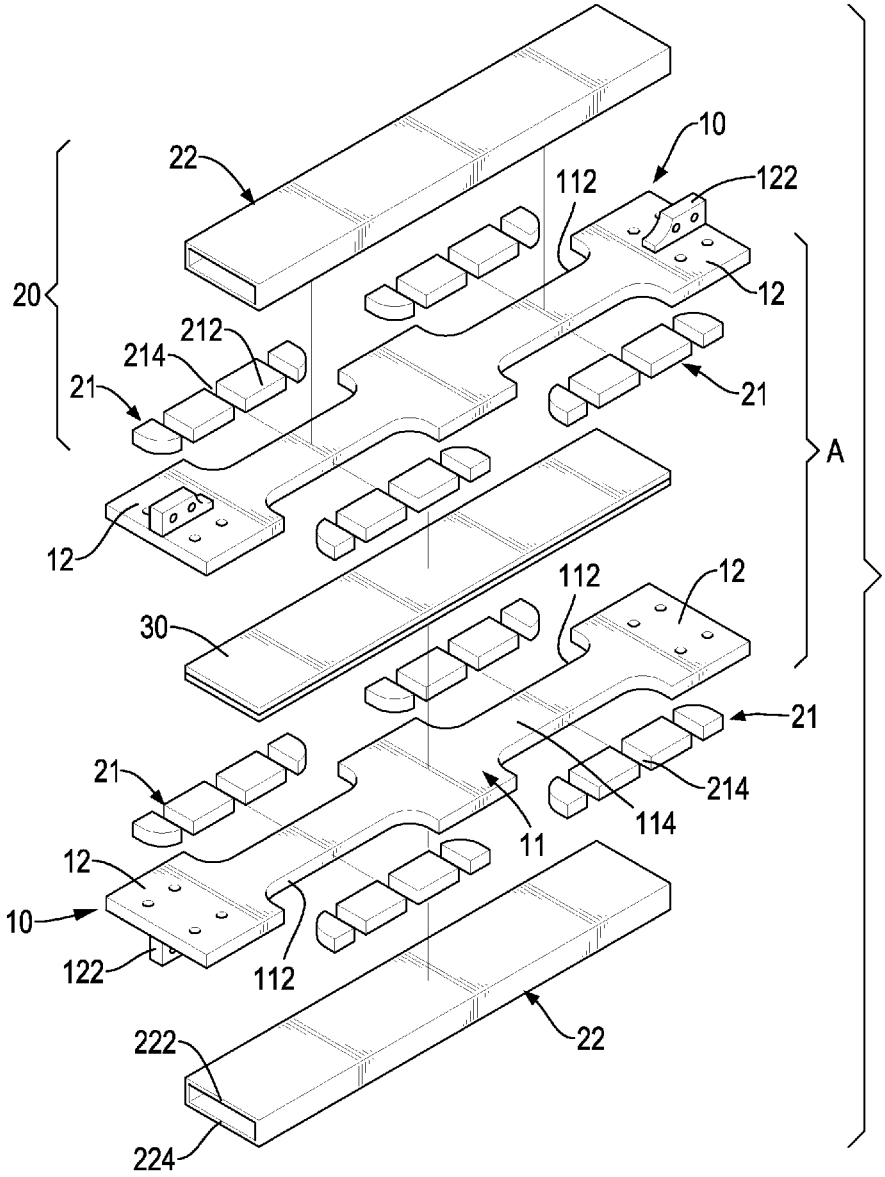
FIG. 61 is an exploded perspective view of a sixty-first embodiment of a bracing device in accordance with the present invention.
Figure 62:
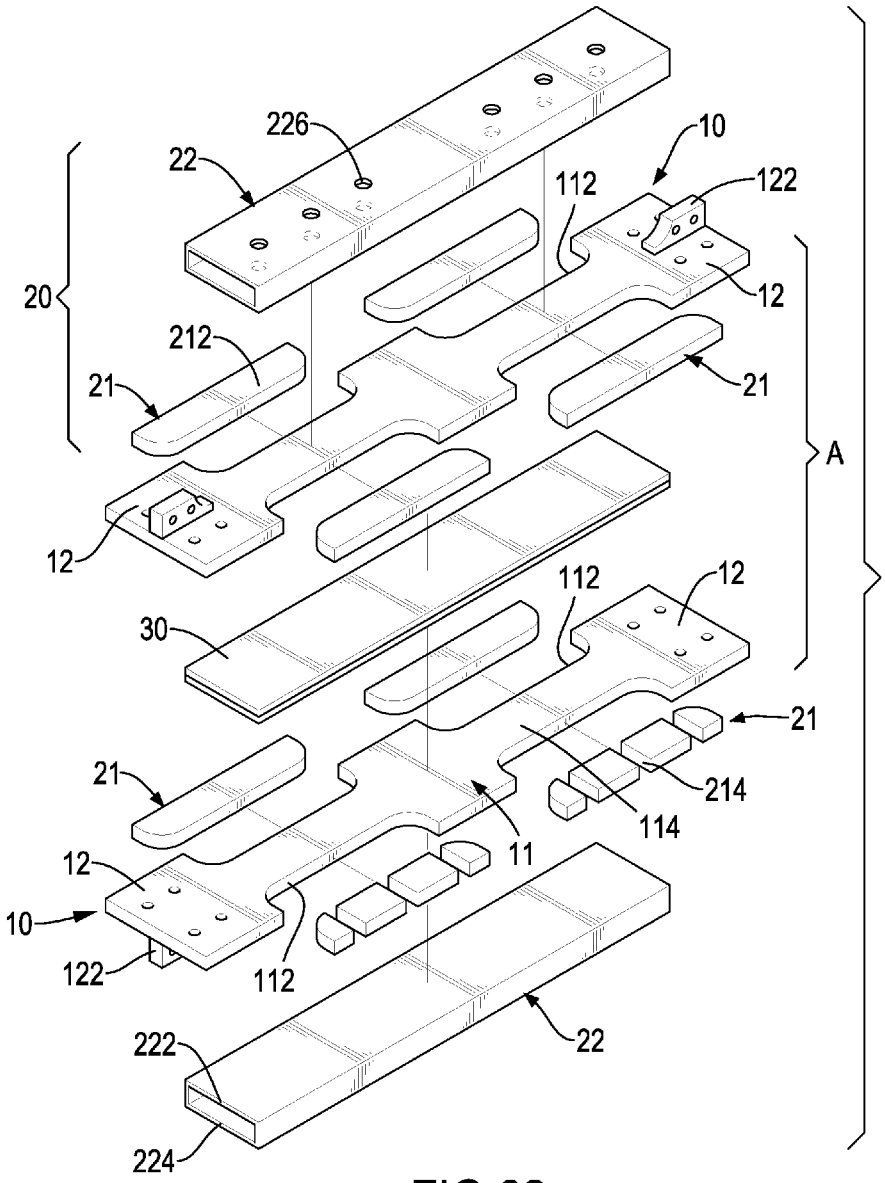
FIG. 62 is an exploded perspective view of a sixty-second embodiment of a bracing device in accordance with the present invention.
Figure 63:
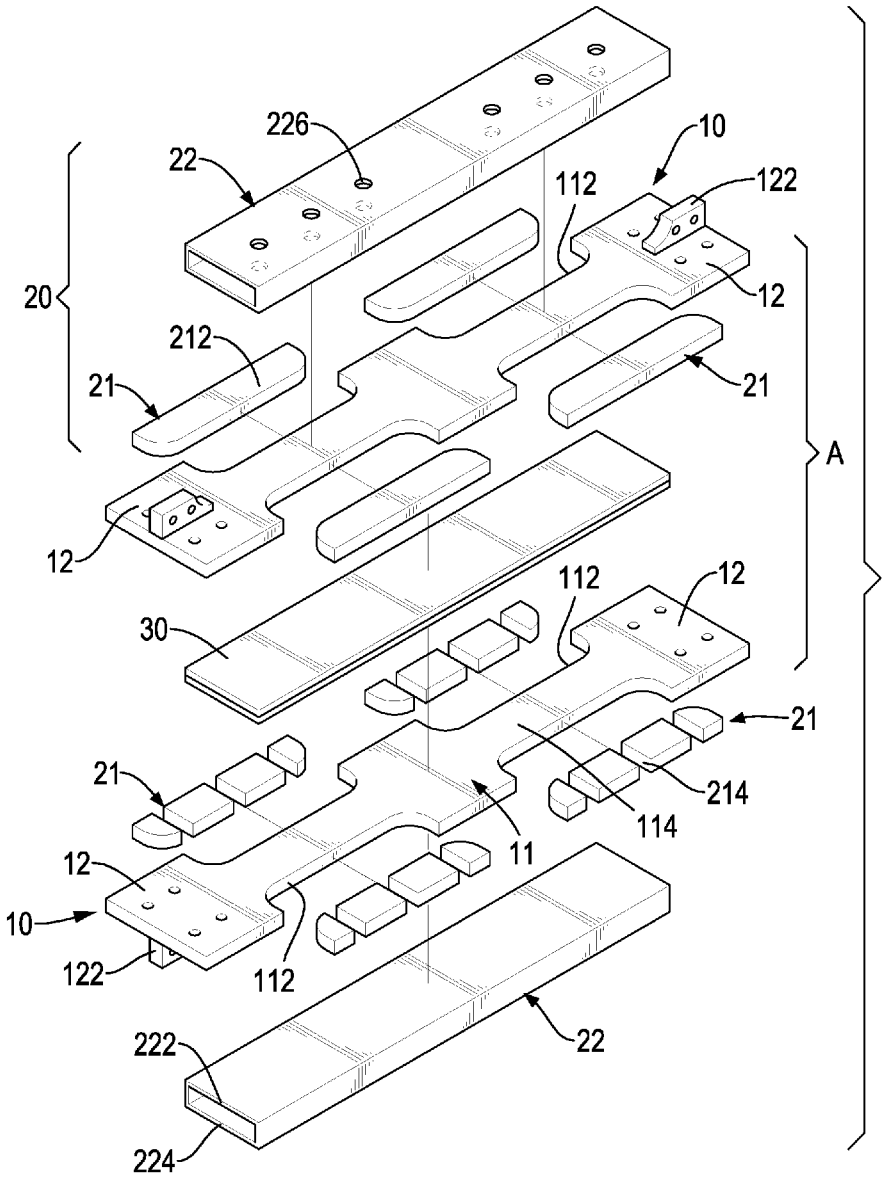
FIG. 63 is an exploded perspective view of a sixty-third embodiment of a bracing device in accordance with the present invention.
Figure 64:
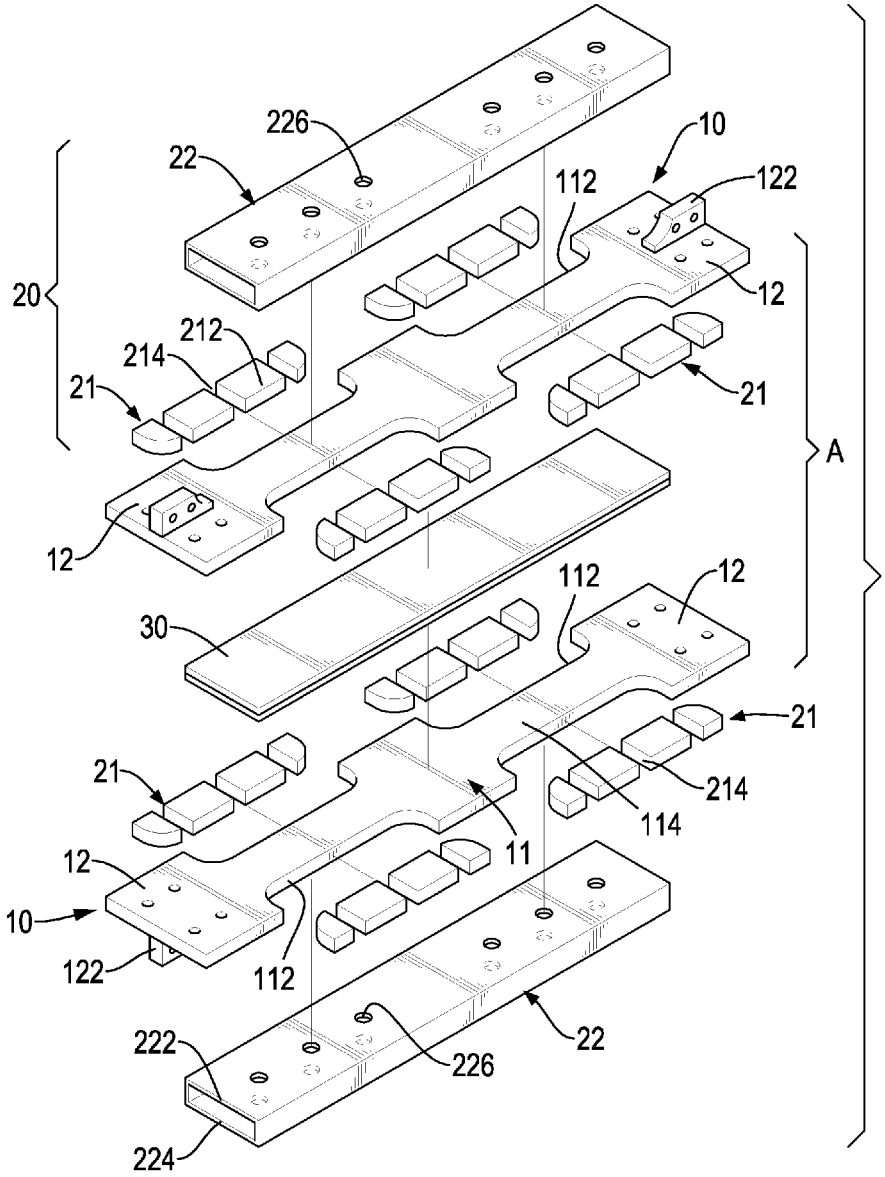
FIG. 64 is an exploded perspective view of a sixty-fourth embodiment of a bracing device in accordance with the present invention.
Figure 65:
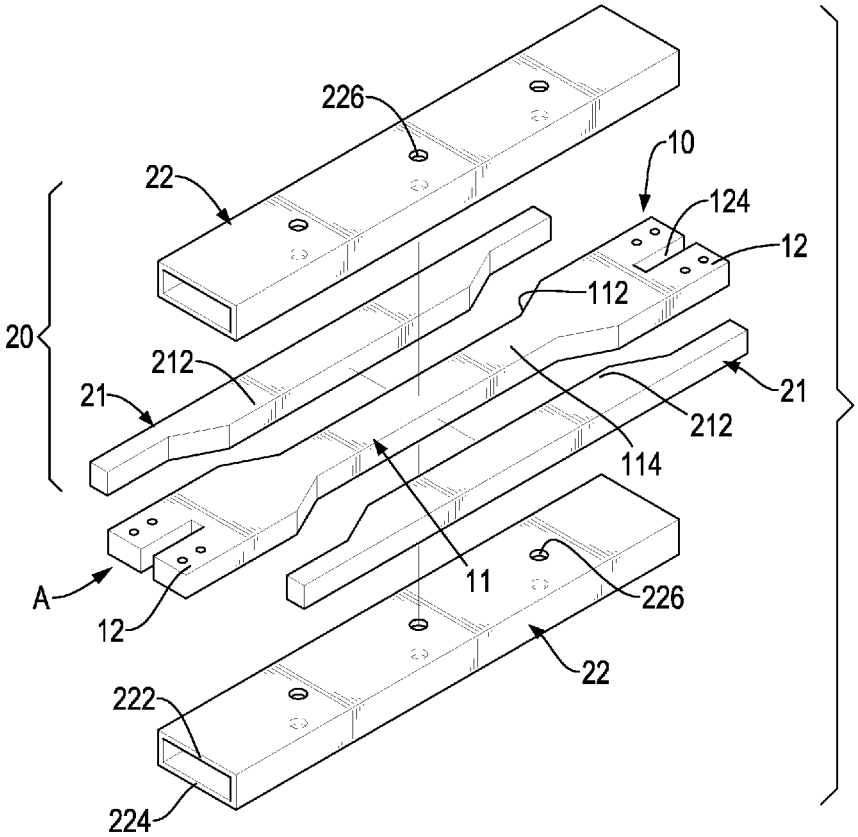
FIG. 65 is an exploded perspective view of a sixty-fifth embodiment of a bracing device in accordance with the present invention.
Figure 66:
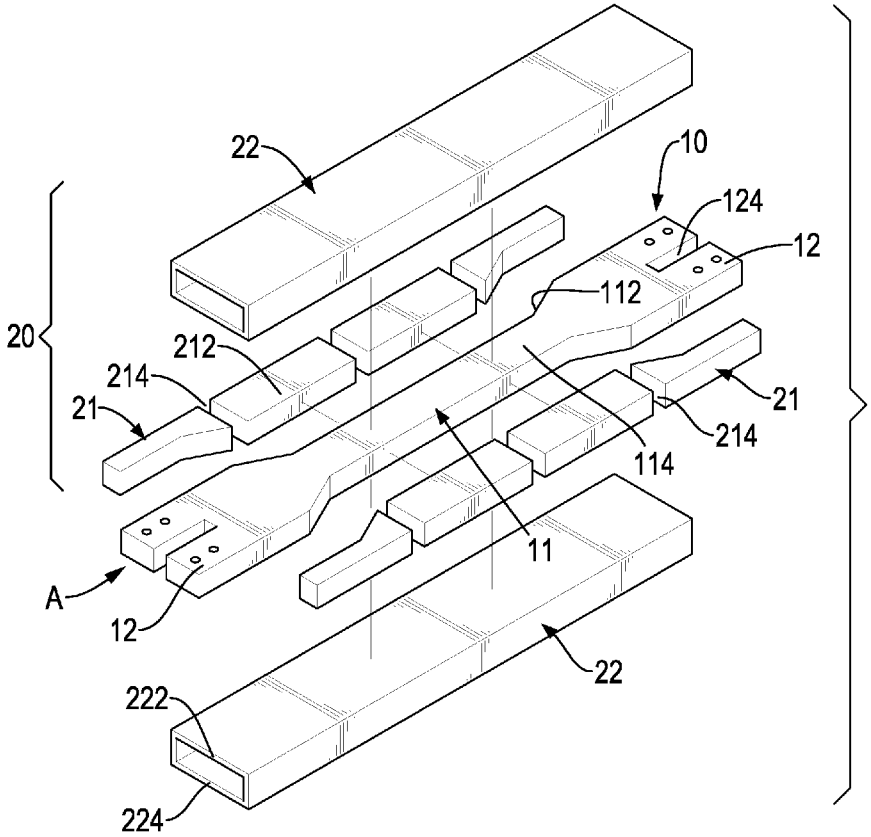
FIG. 66 is an exploded perspective view of a sixty-sixth embodiment of a bracing device in accordance with the present invention.
Figure 67:
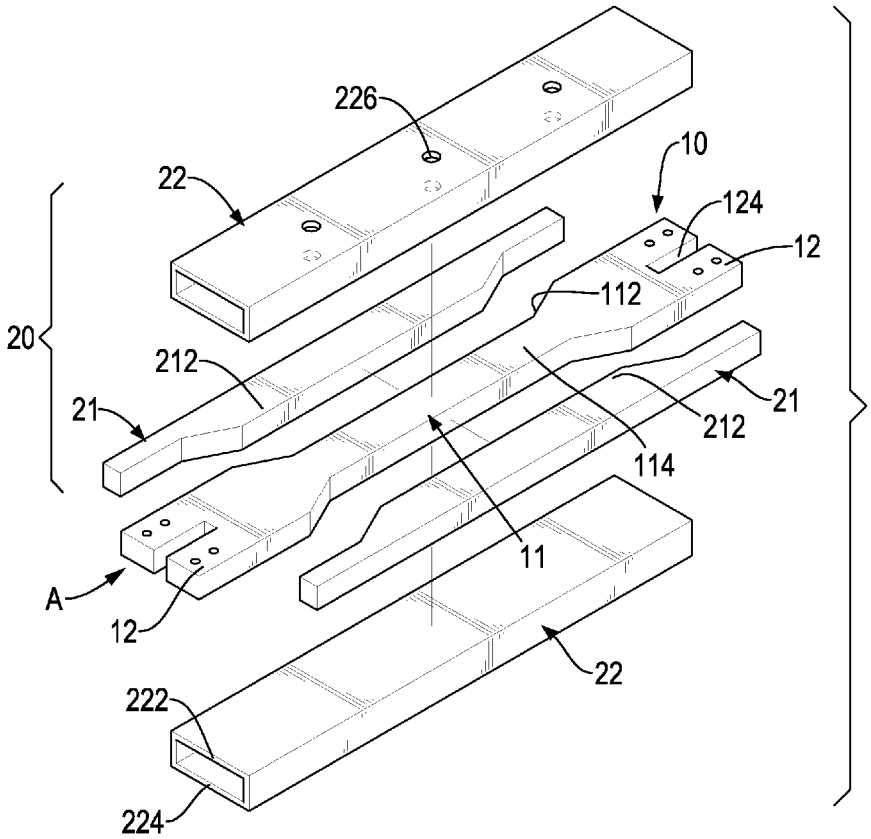
FIG. 67 is an exploded perspective view of a sixty-seventh embodiment of a bracing device in accordance with the present invention.
Figure 68:
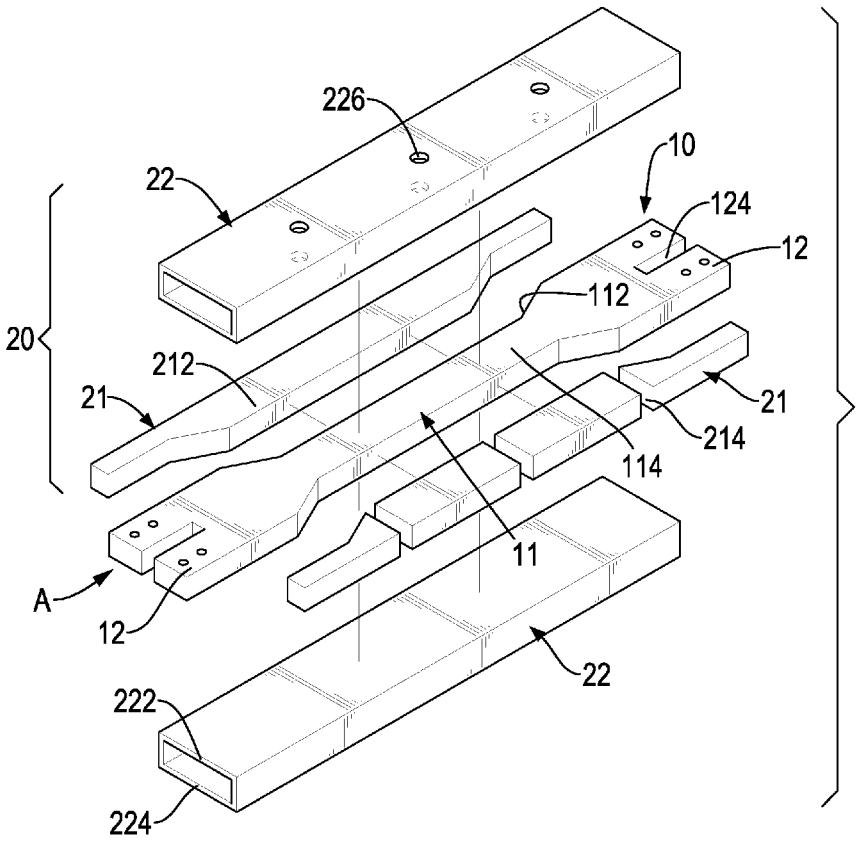
FIG. 68 is an exploded perspective view of a sixty-eighth embodiment of a bracing device in accordance with the present invention.
Figure 69:
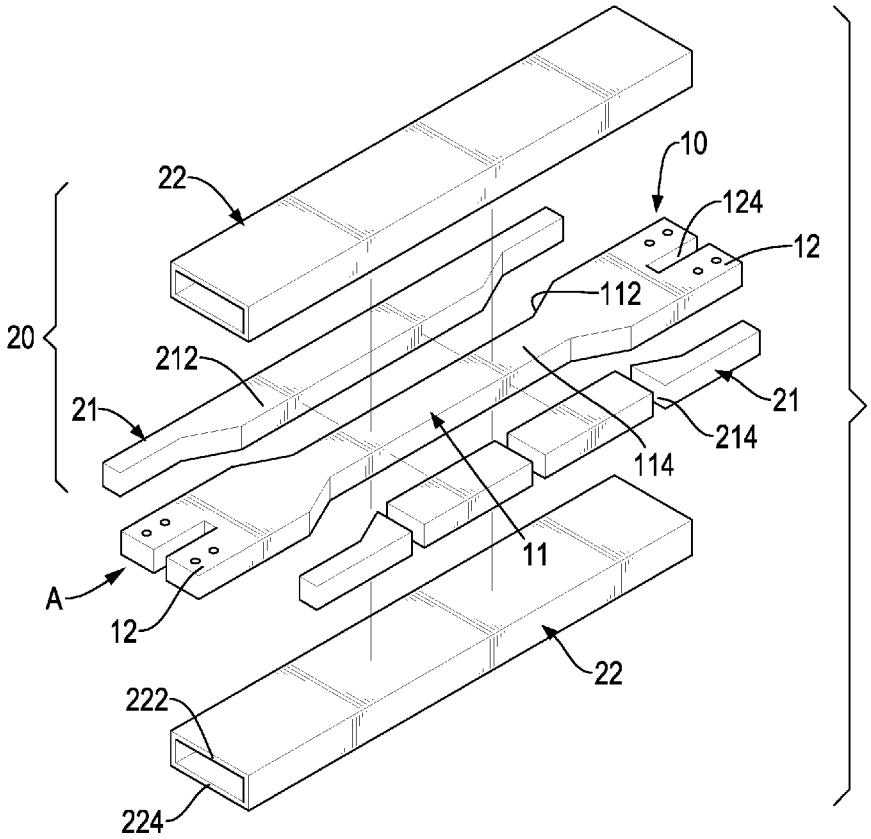
FIG. 69 is an exploded perspective view of a sixty-ninth embodiment of a bracing device in accordance with the present invention.
Figure 70:
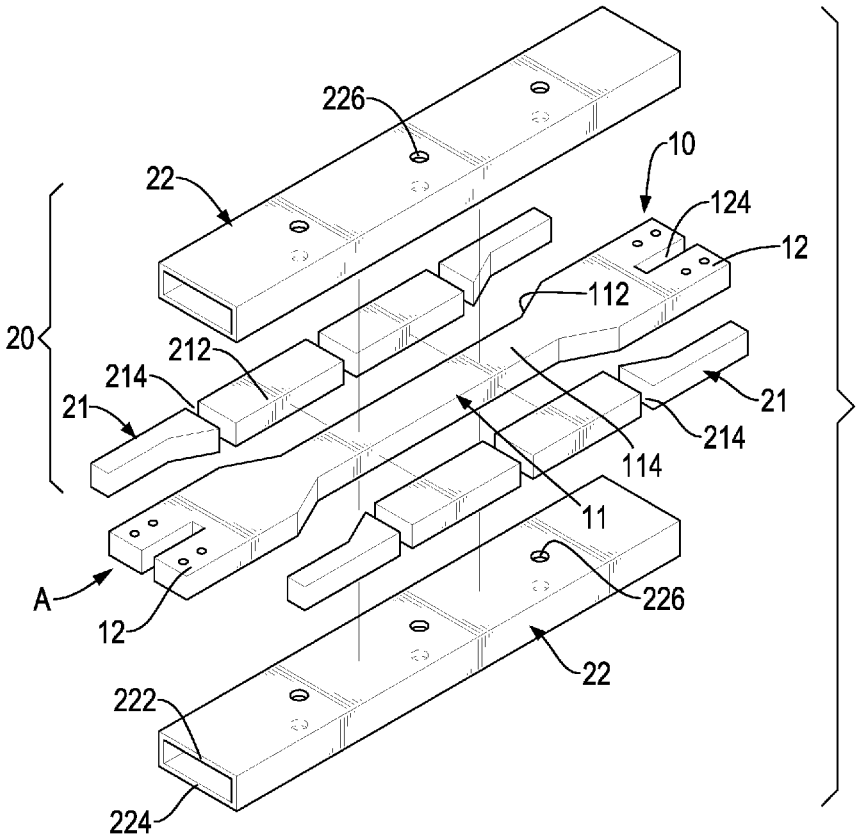
FIG. 70 is an exploded perspective view of a seventieth embodiment of a bracing device in accordance with the present invention.
Figure 71:
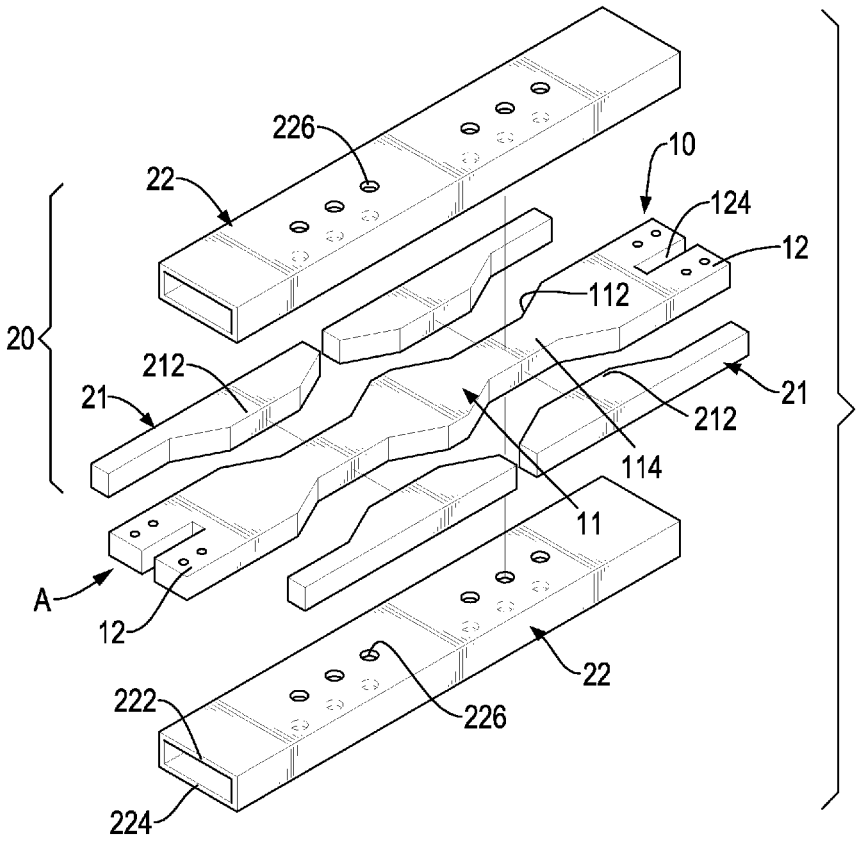
FIG. 71 is an exploded perspective view of a seventy-first embodiment of a bracing device in accordance with the present invention.
Figure 72:
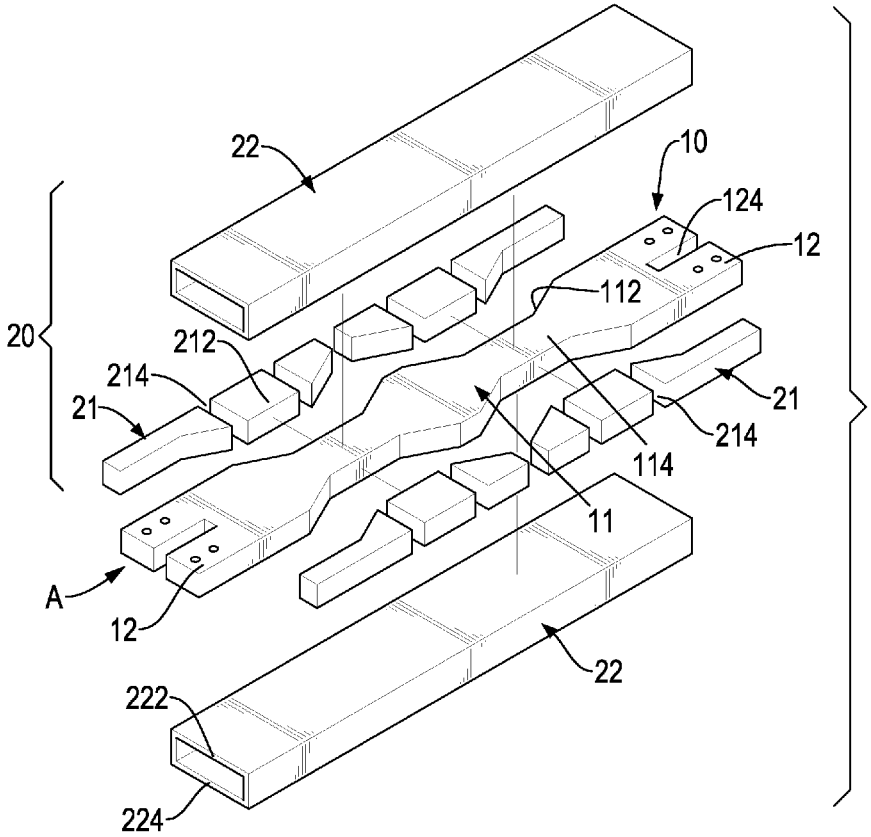
FIG. 72 is an exploded perspective view of a seventy-second embodiment of a bracing device in accordance with the present invention.
Figure 73:
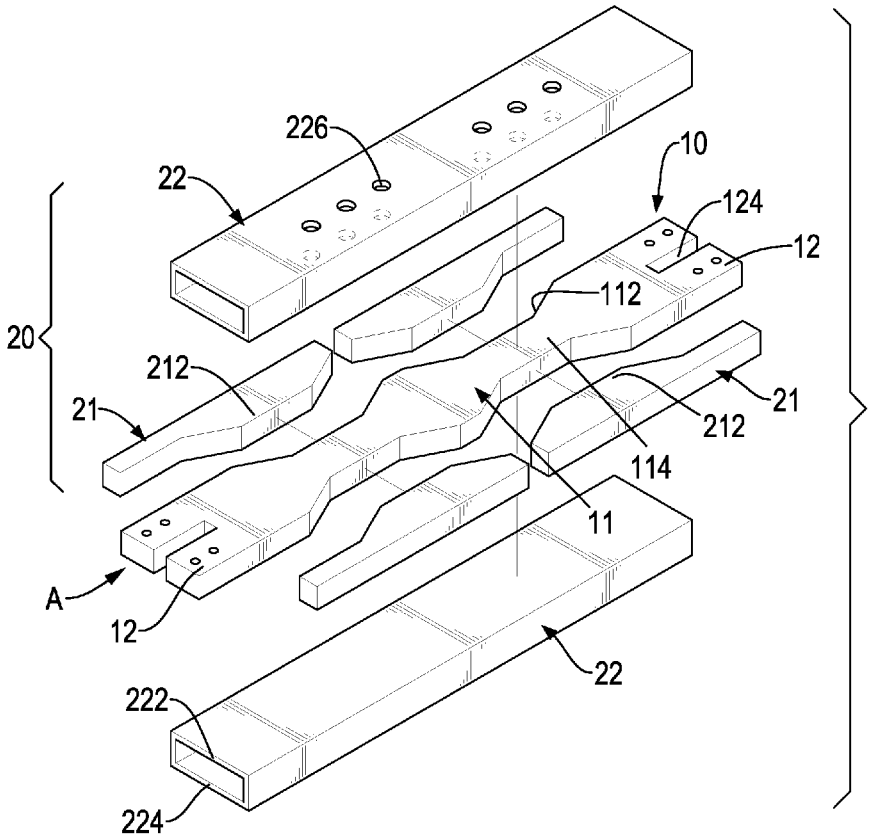
FIG. 73 is an exploded perspective view of a seventy-third embodiment of a bracing device in accordance with the present invention.
Figure 74:
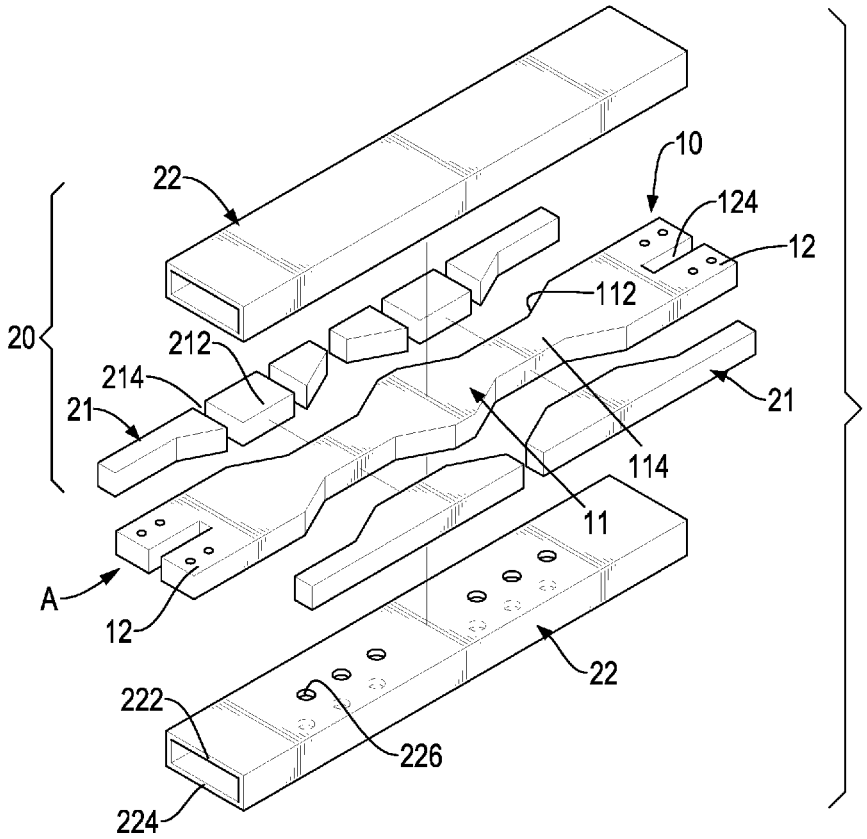
FIG. 74 is an exploded perspective view of a seventy-fourth embodiment of a bracing device in accordance with the present invention.
Figure 75:
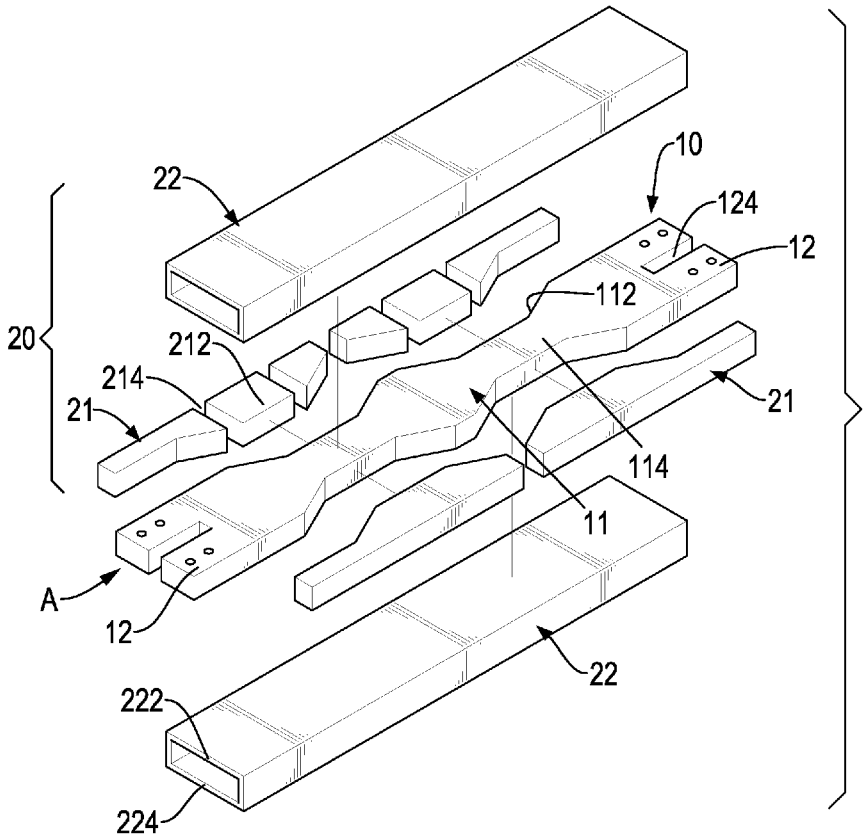
FIG. 75 is an exploded perspective view of a seventy-fifth embodiment of a bracing device in accordance with the present invention.
Figure 76:
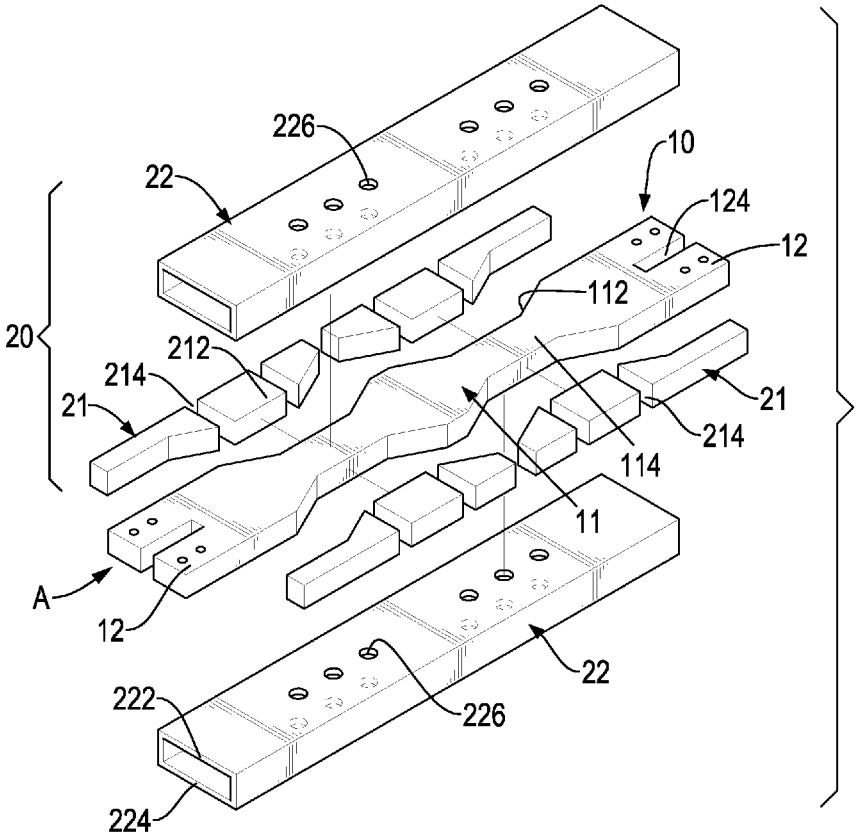
FIG. 76 is an exploded perspective view of a seventy-sixth embodiment of a bracing device in accordance with the present invention.
Figure 77:
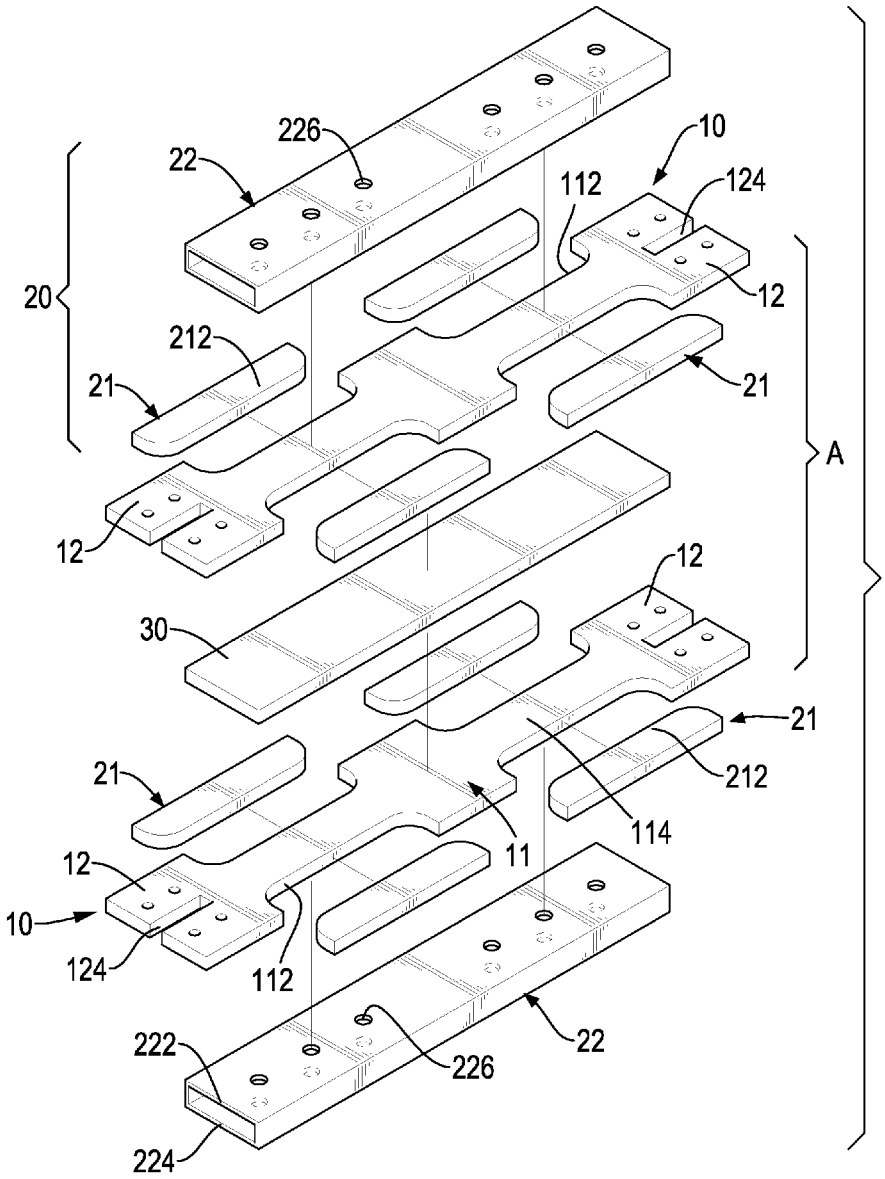
FIG. 77 is an exploded perspective view of a seventy-seventh embodiment of a bracing device in accordance with the present invention.
Figure 78:
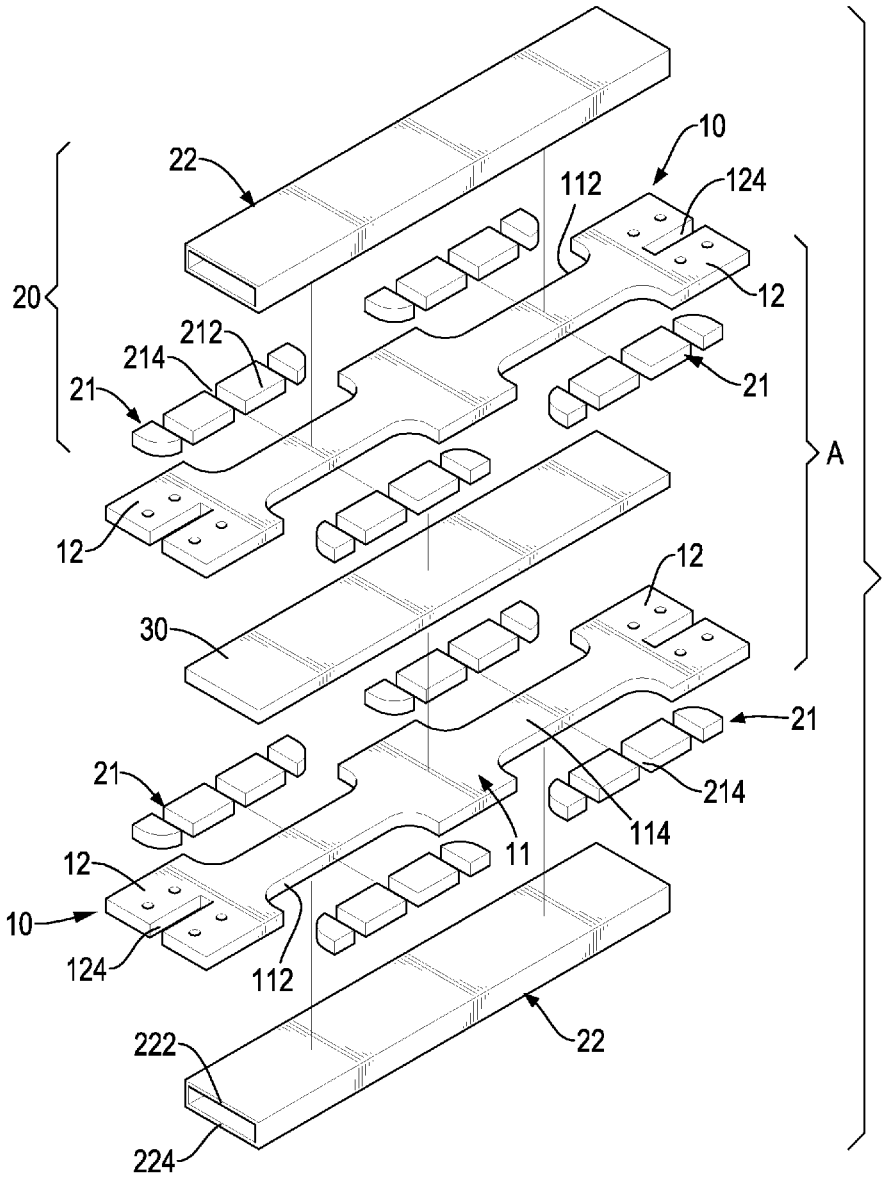
FIG. 78 is an exploded perspective view of a seventy-eighth embodiment of a bracing device in accordance with the present invention.
Figure 79:
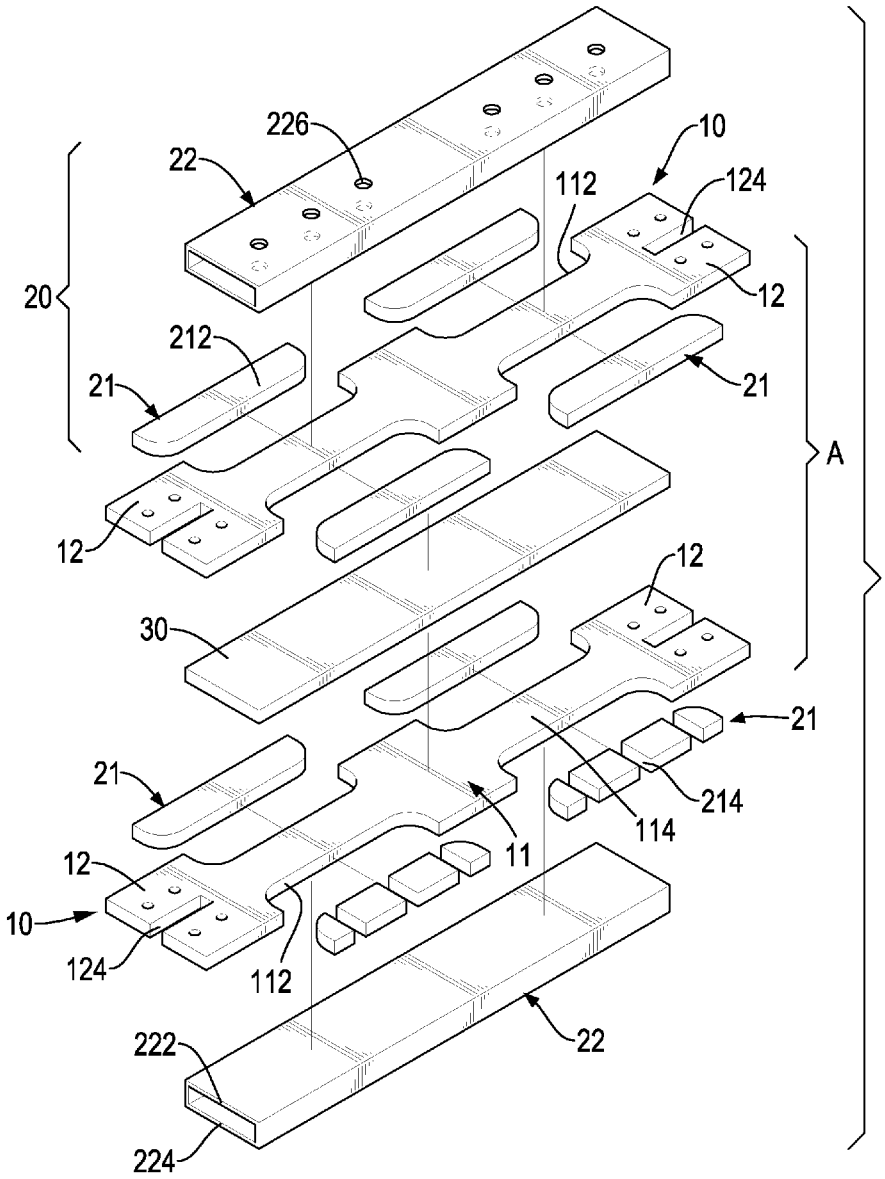
FIG. 79 is an exploded perspective view of a seventy-ninth embodiment of a bracing device in accordance with the present invention.
Figure 80:
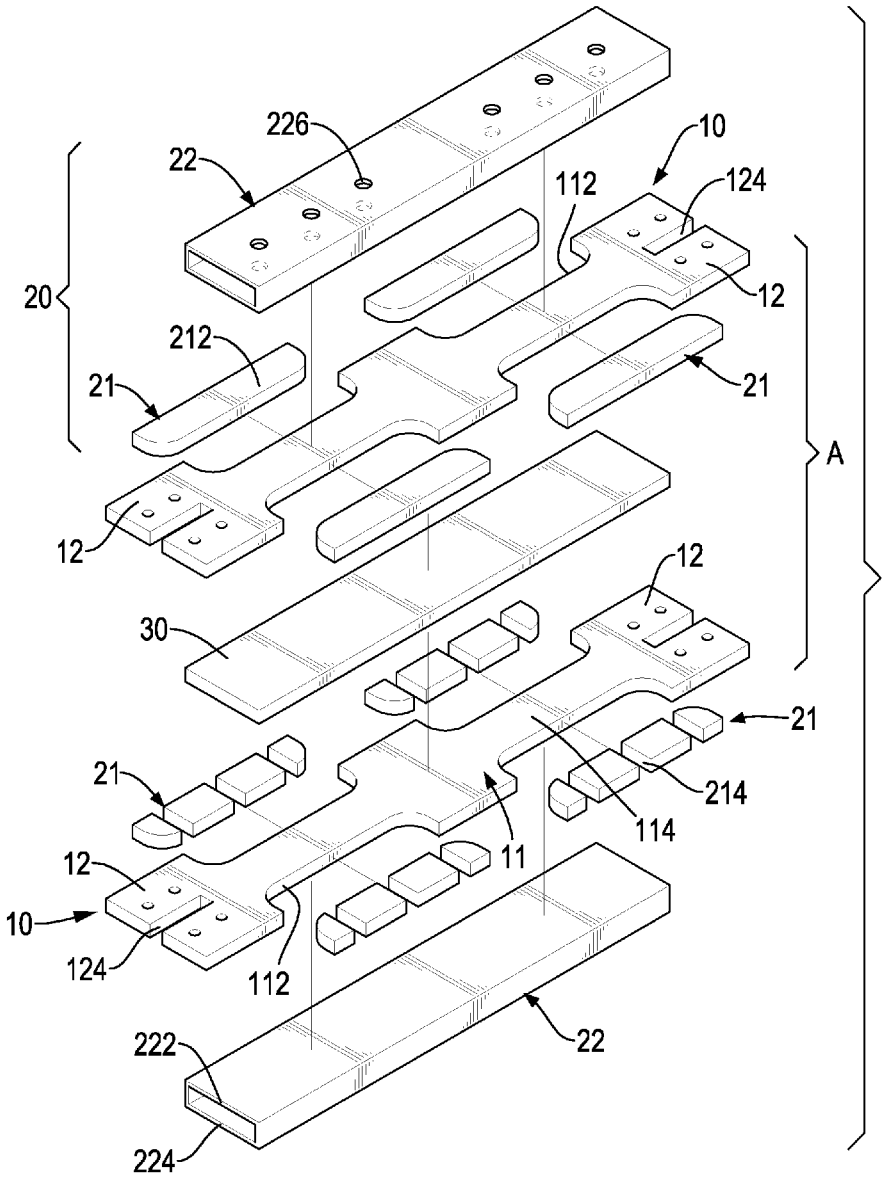
FIG. 80 is an exploded perspective view of an eightieth embodiment of a bracing device in accordance with the present invention.
Figure 81:
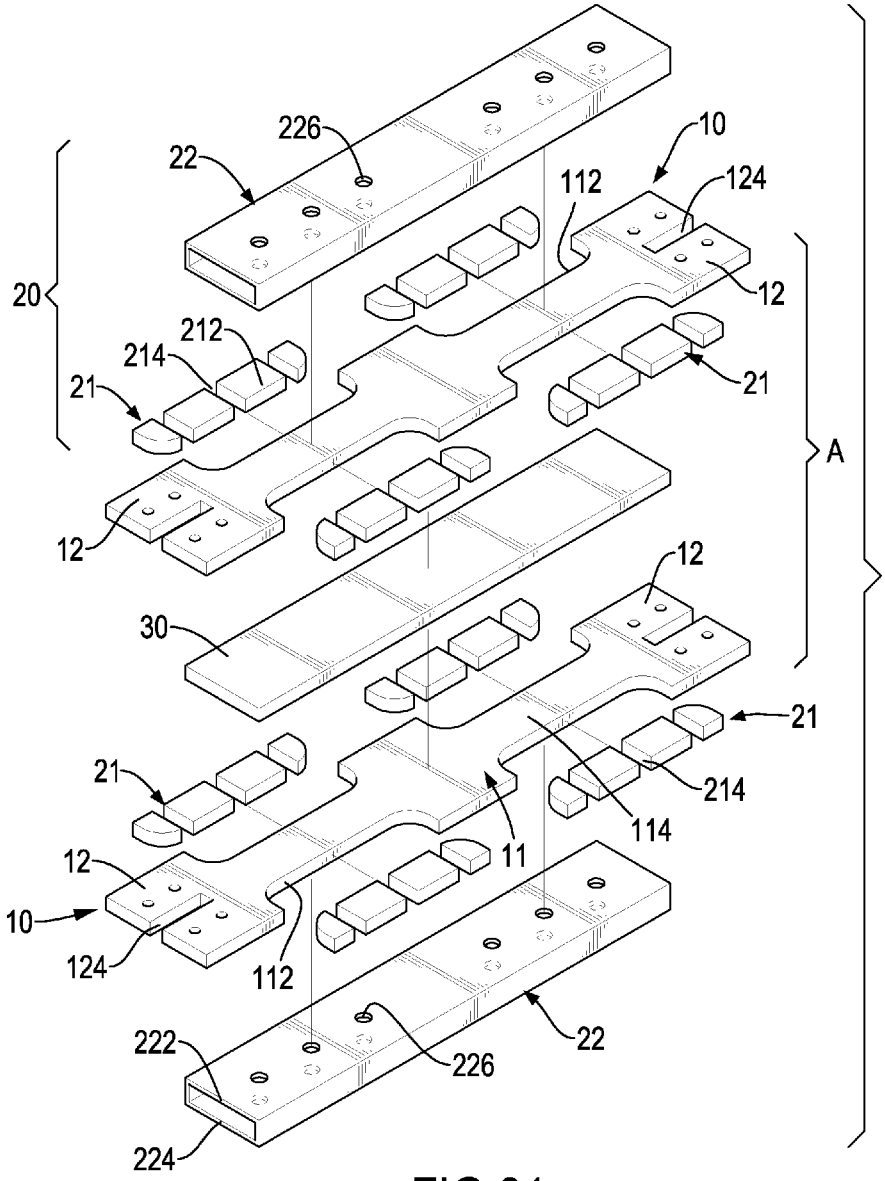
FIG. 81 is an exploded perspective view of an eighty-first embodiment of a bracing device in accordance with the present invention.
Figure 82:
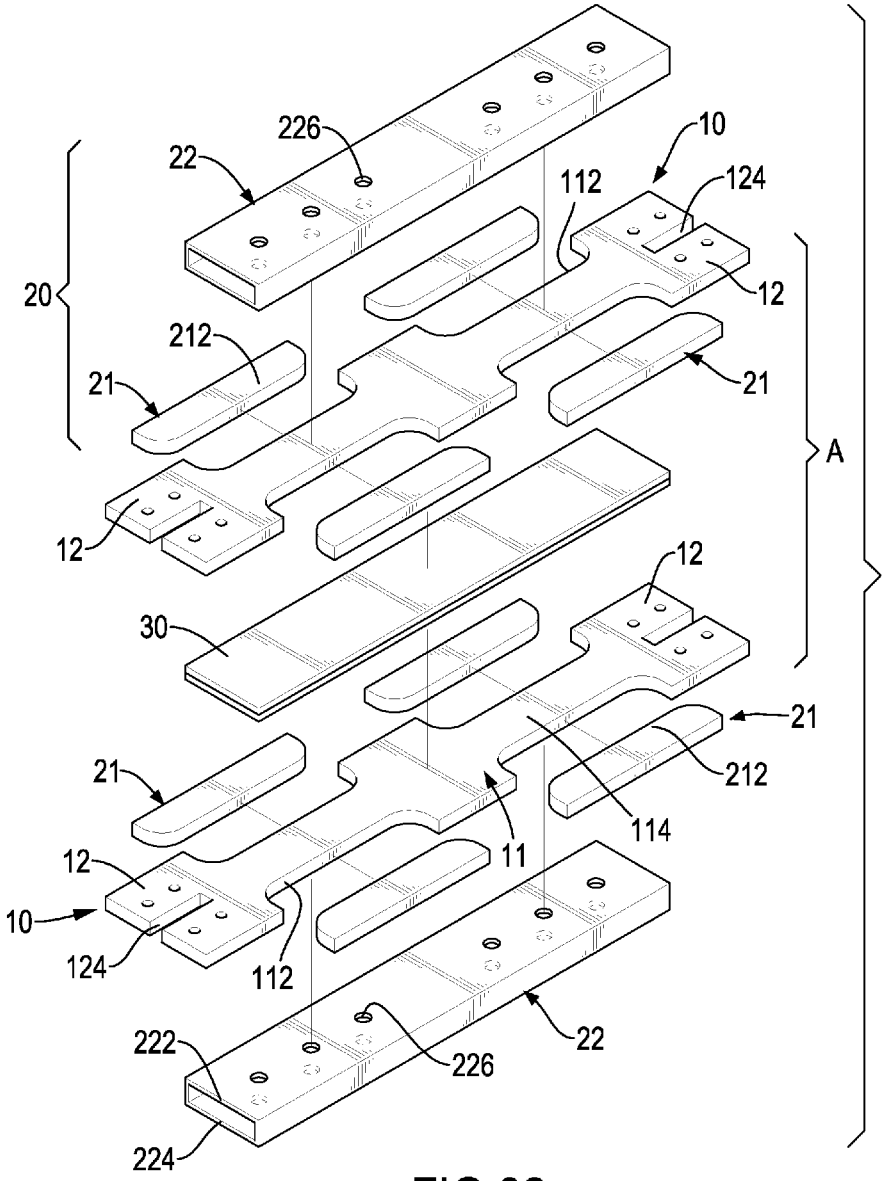
FIG. 82 is an exploded perspective view of an eighty-second embodiment of a bracing device in accordance with the present invention.
Figure 83:
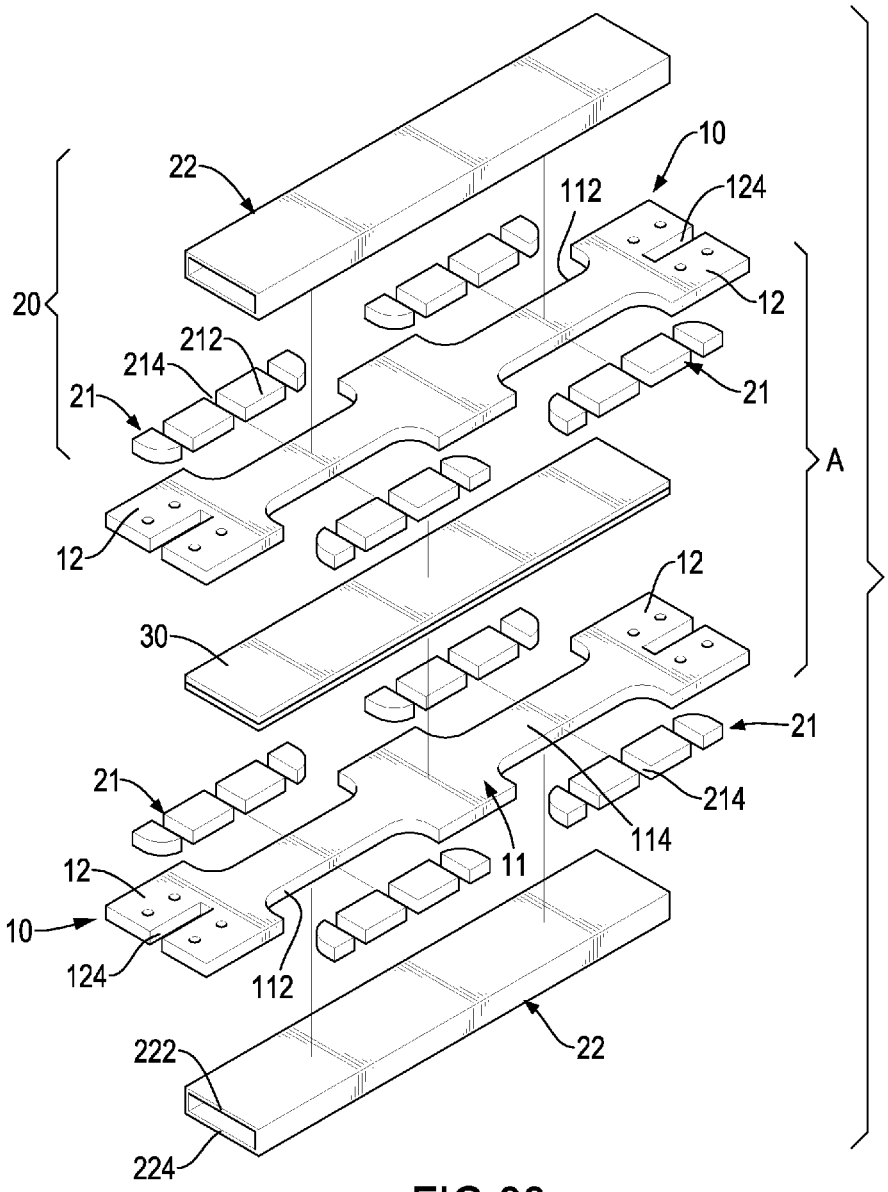
FIG. 83 is an exploded perspective view of an eighty-third embodiment of a bracing device in accordance with the present invention.
Figure 84:
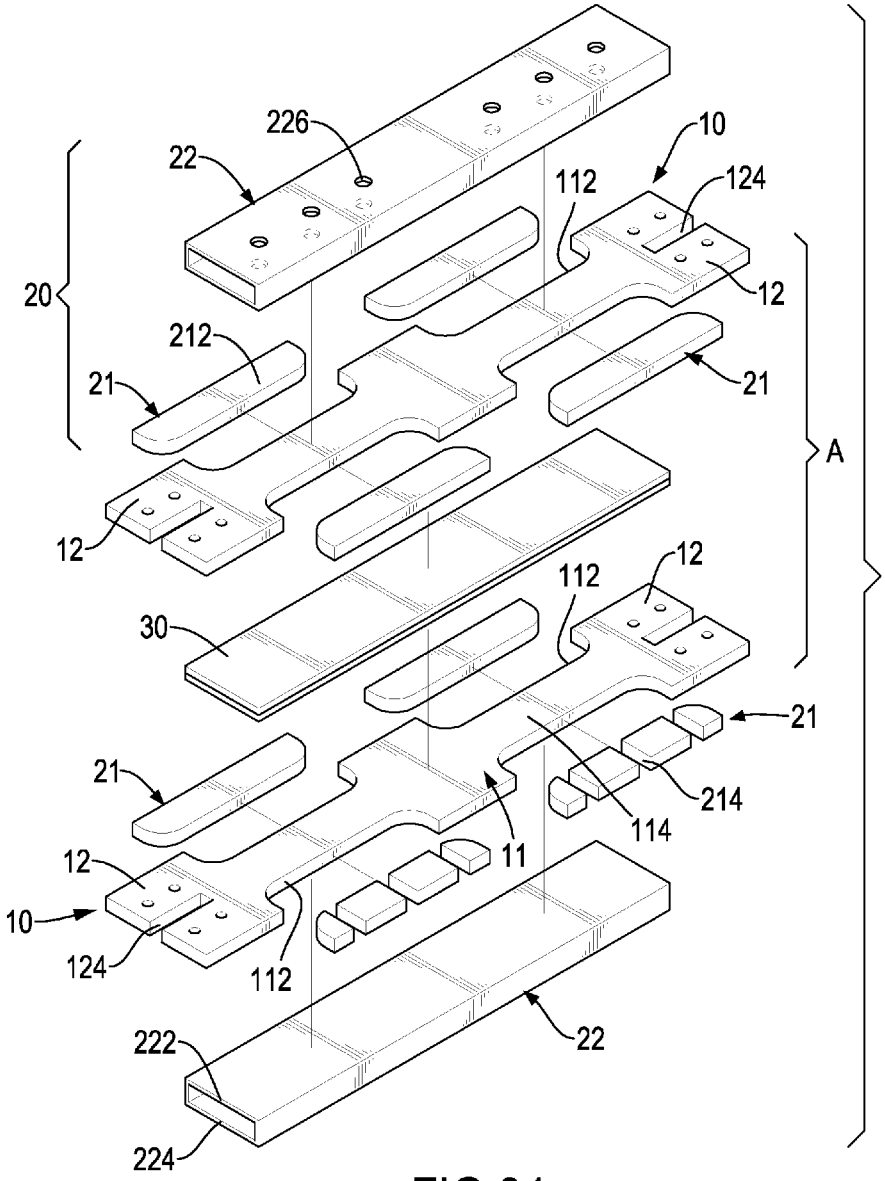
FIG. 84 is an exploded perspective view of an eighty-fourth embodiment of a bracing device in accordance with the present invention.
Figure 85:
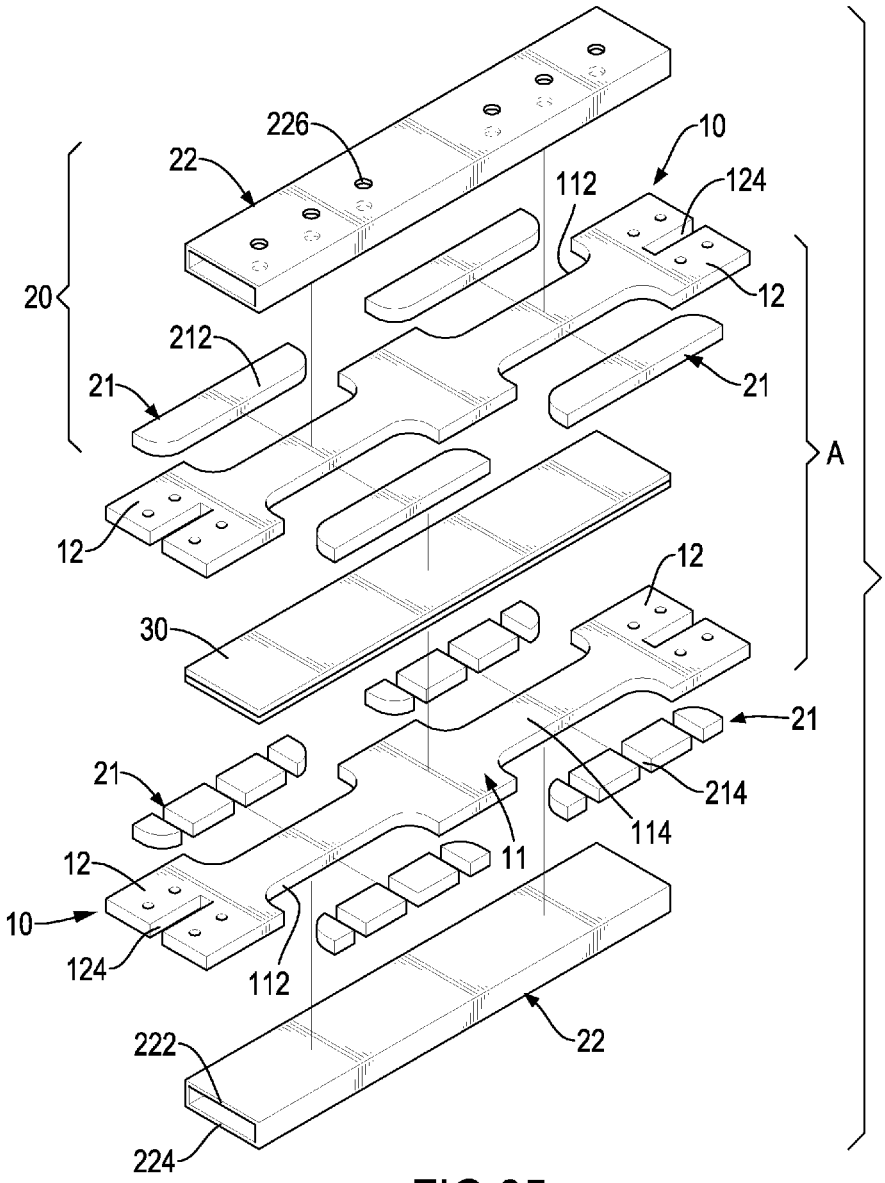
FIG. 85 is an exploded perspective view of an eighty-fifth embodiment of a bracing device in accordance with the present invention.
Figure 86:
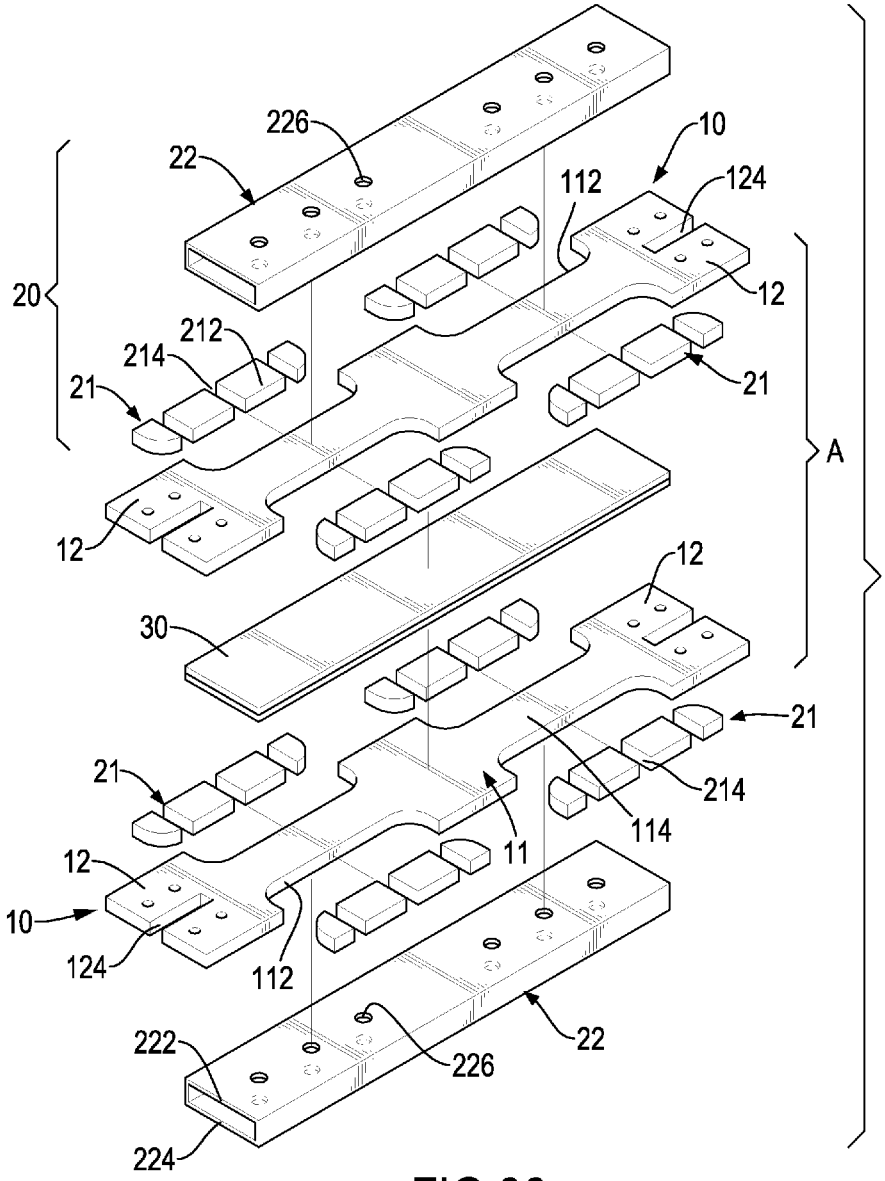
FIG. 86 is an exploded perspective view of an eighty-sixth embodiment of a bracing device in accordance with the present invention.

With reference to FIG. 11, an eleventh embodiment of a bracing device in accordance with the present invention is substantially the same as the seventh embodiment in FIG. 7 except the following features. Each one of the side boards 21 that are mounted in the supporting elements 10 has three viewing holes 214 formed through the side board 21 at intervals, and each one of the restraining boards 22 that are mounted on the supporting elements 10 has three viewing holes 226 formed through the restraining board 22. Then, the user can easily see the loading sections 114 of the supporting elements 10 via the viewing holes 214, 226 of the side boards 21 and the restraining boards 22 of the restraining element 20.

With reference to FIGS. 12 to 16, twelfth to sixteenth embodiments of a bracing device in accordance with the present invention are respectively and substantially the same as the seventh to eleventh embodiments in FIGS. 7 to 11 except the following features. The connecting board 30 is composed of two plates.

With reference to FIGS. 17 to 32, seventeenth to thirty-second embodiments of a bracing device in accordance with the present invention are respectively and substantially the same as the first to sixteenth embodiments in FIGS. 1 to 16 except the following features. The axial segment 11 of each one of the supporting element 10 has four concave edges 112 and two loading sections 114. Two of the concave edges 112 are formed in one of the sidewalls of the axial segment 11 at an interval and the other two concave edges 112 are formed in the other sidewall of the axial segment 11 at an interval. The loading sections 114 of the axial segment 11 are formed on the axial segment 11 between the concave edges 112 that are formed in the sidewalls of the axial segment 11. In addition, the restraining element 20 has four side boards 21 respectively mounted in the concave edges 112 of the axial segment 11 of each one of the supporting elements 10.

With reference to FIGS. 33 to 64, thirty-third to sixty-fourth embodiments of a bracing device in accordance with the present invention are respectively and substantially the same as the first to thirty-second embodiments in FIGS. 1 to 32 except the following features. Each connecting head 12 of each one of the supporting elements 10 has at least one connecting block 122. The at least one connecting block 122 is mounted on the first side or the second side of the connecting head 12 to enable the connecting head 12 to be a T shape. Furthermore, each or at least one connecting head 12 of each one of the supporting elements 10 has two connecting blocks 122 respectively mounted on the first side and the second side of the connecting head 12 to enable the connecting head 12 to be a cross shape. In addition, each one of the at least one connecting block 122 has multiple connecting holes formed through the at least one connecting block 122.

With reference to FIGS. 65 to 70, sixty-fifth to seventy embodiments of a bracing device in accordance with the present invention are respectively and substantially the same as the first to sixth embodiments in FIGS. 1 to 6 except the following features. Each or at least one connecting head 12 of each one of the supporting elements 10 has multiple connecting holes and a connecting notch 124. The connecting holes are formed through the first side and the second side of the connecting head 12 at intervals. The connecting notch 124 is formed through the first side and the second side of the connecting head 12 between the connecting holes of the connecting head 12.

With reference to FIGS. 71 to 76, seventy-first to seventy-sixth embodiments of a bracing device in accordance with the present invention are respectively and substantially the same as the seventeenth to twenty-second embodiments in FIGS. 17 to 22 except the following features. Each connecting head 12 of each one of the supporting elements 10 has multiple connecting holes and a connecting notch 124. The connecting holes are formed through the first side and the second side of the connecting head at intervals. The connecting notch 124 is formed through the first side and the second side of the connecting head 12 between the connecting holes of the connecting head 12.

With reference to FIGS. 77 to 86, seventy-seventh to eighty-sixth embodiments of a bracing device in accordance with the present invention are respectively and substantially the same as the twenty-third to thirty-second embodiments in FIGS. 23 to 32 except the following features. Each connecting head 12 of each one of the supporting elements 10 has multiple connecting holes and a connecting notch 124. The connecting holes are formed through the first side and the second side of the connecting head at intervals. The connecting notch 124 is formed through the first side and the second side of the connecting head 12 between the connecting holes of the connecting head 12.

According to the above-mentioned embodiments of the bracing device in accordance with the present invention, after the earthquake or the strong wind, the user or an inspector can easily and conveniently see and inspect the damage and conditions of the loading sections 114 of each one of the at least one supporting element 10 of the supporting module A via the viewing holes 214, 226 of the side boards 21 and the restraining boards 22 without dismantling the restraining element 20 from the supporting module A. Then, the cost and process of re-constructing the restraining element 20 are naturally disappeared. In addition, the inspector can inspect the structural strength of the supporting module A of the bracing device to ensure the structural safety of the building.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bracing device comprising:

a supporting module having at least one supporting element, and each one of the at least one supporting element having an axial segment being elongated-plate-shaped and having a first side;

a second side;

two connecting ends; and two sidewalls, and each one of the sidewalls having at least one concave edge formed in the sidewall of the axial segment to form at least one loading section on the axial segment at a position corresponding to the at least one concave edge of the sidewall between the connecting ends of the axial segment; and two connecting heads respectively formed on the connecting ends of the axial segment; and a restraining element mounted around the supporting module to provide a restraining-supporting effect to the supporting module and having at least one pair of side boards, and each one of the at least one pair side boards mounted in one of the at least one concave edge of one of the sidewalls of the axial segment;

two restraining boards abutting on the axial segment of the at least one supporting element, connected to the at least one pair of side boards and each one of the restraining boards having a rectangular-shaped cross section;

an inner side facing the at least one supporting element;

an outer side;

two sidewalls formed with the inner side of the restraining board and the outer side of the restraining board to form the rectangular and hollow restraining board;

an inner panel formed on the inner side of the restraining board and abutting on the axial segment of the at least one supporting element; and an outer panel formed on the outer side of the restraining board opposite to the inner panel; and at least one viewing hole formed through the restraining element and aligning along the at least one loading section of the axial segment to enable a user to see the at least one supporting element of the bracing device.

2. The bracing device as claimed in claim 1, wherein each one of the restraining boards of the restraining element has at least one viewing hole formed through the restraining board to align along each one of the at least one loading section of the axial segment.

3. The bracing device as claimed in claim 2, wherein at least one of the at least one pair of side boards of the restraining element has at least one viewing hole formed through the side board to align along each one of the at least one loading section.

4. The bracing device as claimed in claim 2, wherein each one of the at least one pair of side boards that is mounted at the same sidewall of the axial segment of the at least one supporting element has at least one viewing hole formed through the side board to align along each one of the at least one loading section.

5. The bracing device as claimed in claim 2, wherein at least one of the least one pair of side boards that is mounted in one of the at least one supporting element has at least one viewing hole formed through the side board to align along each one of the at least one loading section.

6. The bracing device as claimed in claim 1, wherein one of the restraining boards has at least one viewing hole formed through the outer panel of the restraining board and the inner panel of the restraining board to align along each one of the at least one loading section.

7. The bracing device as claimed in claim 6, wherein at least one of the at least one pair of side boards of the restraining element has at least one viewing hole formed through the side board to align along each one of the at least one loading section.

8. The bracing device as claimed in claim 6, wherein each one of the at least one pair of side boards that is mounted at the same sidewall of the axial segment of the at least one supporting element has at least one viewing hole formed through the side board to align along each one of the at least one loading section.

9. The bracing device as claimed in claim 6, wherein at least one of the least one pair of side boards that is mounted in one of the at least one supporting element has at least one viewing hole formed through the side board to align along each one of the at least one loading section.

10. The bracing device as claimed in claim 1, wherein at least one of the at least one pair of side boards of the restraining element has at least one viewing hole formed through the side board to align along each one of the at least one loading section.

11. The bracing device as claimed in claim 1, wherein each one of the at least one pair of side boards that is mounted at the same sidewall of the axial segment of the at least one supporting element has at least one viewing hole formed through the side board to align along each one of the at least one loading section.

12. The bracing device as claimed in claim 1, wherein at least one of the at least one pair of side boards that is mounted in one of the at least one supporting element has at least one viewing hole formed through the side board to align along each one of the at least one loading section.

13. The bracing device as claimed in claim 1, wherein the amount of the viewing holes of the restraining board that has the at least one viewing hole is two or three to align along each one of the at least one loading section.

14. The bracing device as claimed in claim 1, wherein the amount of the viewing holes of the side board that has the at least one viewing hole is two or three to align along each one of the at least one loading section.

15. The bracing device as claimed in claim 1, wherein the supporting module has one supporting element.

16. The bracing device as claimed in claim 15, wherein the supporting element has two concave edges respectively formed in the sidewalls of the axial segment of the supporting element to form a loading section on the axial segment at a position corresponding to the concave edges.

17. The bracing device as claimed in claim 15, wherein the supporting element has four concave edges, two of the concave edges are formed in one of the sidewalls of the axial segment of the supporting element at an interval and the other two concave edges are formed in the other sidewall of the axial segment at an interval to form two loading sections on the axial segment of the supporting element at an interval.

18. The bracing device as claimed in claim 15, wherein each one of the at least one pair of side boards and each one of the restraining boards of the restraining element are connected to each other by welding.

19. The bracing device as claimed in claim 15, wherein each one of the at least one pair of side boards and each one of the restraining boards of the restraining element are connected to each other by fastening or riveting.

20. The bracing device as claimed in claim 15, wherein each one of the connecting heads of the axial segment of the supporting element is flat.

21. The bracing device as claimed in claim 15, wherein each one of the connecting heads of the axial segment of the supporting element has at least one connecting block to enable the connecting head to be a T shape.

22. The bracing device as claimed in claim 15, wherein each one of the connecting heads of the axial segment of the supporting element has two connecting blocks to enable the connecting head to be a cross shape.

23. The bracing device as claimed in claim 15, wherein each one of the connecting heads of the axial segment of the supporting element has a connecting notch formed through the connecting head.

24. The bracing device as claimed in claim 1, wherein the supporting module has a connecting board being elongated-plate-shaped and having a first side and a second side; and two supporting elements, one of the supporting elements abutting on the first side of the connecting board and the other one supporting element abutting on the second side of the connecting board.

25. The bracing device as claimed in claim 24, wherein each one of the supporting elements has two concave edges respectively formed in the sidewalls of the axial segment of the supporting element to form a loading section on the axial segment at a position corresponding to the concave edges.

26. The bracing device as claimed in claim 24, wherein each one of the supporting elements has four concave edges, two of the concave edges are formed in one of the sidewalls of the axial segment of the supporting element at an interval and the other two concave edges are formed in the other sidewall of the axial segment at an interval to form two loading sections on the axial segment of the supporting element at an interval.

27. The bracing device as claimed in claim 24, wherein each one of the at least one pair side boards is connected to at least one of the restraining boards or the connecting board by welding.

28. The bracing device as claimed in claim 24, wherein each one of the at least one pair side boards is connected to at least one of the restraining boards or the connecting board by fastening or riveting.

29. The bracing device as claimed in claim 24, wherein each one of the connecting heads of the axial segment of the supporting element is flat.

30. The bracing device as claimed in claim 24, wherein each one of the connecting heads of the axial segment of the supporting element has at least one connecting block to enable the connecting head to be a T shape.

31. The bracing device as claimed in claim 24, wherein each one of the connecting heads of the axial segment of the supporting element has two connecting blocks to enable the connecting head to be a cross shape.

32. The bracing device as claimed in claim 24, wherein each one of the connecting heads of the axial segment of the supporting element has a connecting notch formed through the connecting head.

33. The bracing device as claimed in claim 24, wherein the connecting board is composed of two plates.

* * * * *